US008482499B2

(12) United States Patent
Kimura

(10) Patent No.: US 8,482,499 B2
(45) Date of Patent: Jul. 9, 2013

(54) LIQUID CRYSTAL DISPLAY DEVICE, LIQUID CRYSTAL DISPLAY CONTROL DEVICE, ELECTRONIC DEVICE, AND LIQUID CRYSTAL DISPLAY METHOD

(75) Inventor: Hiroaki Kimura, Kawasaki (JP)

(73) Assignee: NLT Technologies, Ltd., Kanagawa (JP)

( * ) Notice: Subject to any disclaimer, the term of this patent is extended or adjusted under 35 U.S.C. 154(b) by 917 days.

(21) Appl. No.: 12/612,469

(22) Filed: Nov. 4, 2009

(65) Prior Publication Data

US 2010/0118006 A1 May 13, 2010

(30) Foreign Application Priority Data

Nov. 10, 2008 (JP) ..... 2008-287482

(51) Int. Cl.
*G09G 3/36* (2006.01)

(52) U.S. Cl.
USPC ..... 345/87

(58) Field of Classification Search
USPC ..... 345/87–89
See application file for complete search history.

(56) References Cited

U.S. PATENT DOCUMENTS

| | | | | |
|---|---|---|---|---|
| 7,956,821 | B2 * | 6/2011 | Ikeno et al. | 345/4 |
| 2008/0088649 | A1 | 4/2008 | Ikeno et al. | |
| 2009/0109351 | A1 | 4/2009 | Shiomi | |
| 2009/0147186 | A1 | 6/2009 | Nakai et al. | |

FOREIGN PATENT DOCUMENTS

| | | | |
|---|---|---|---|
| CN | 101165767 | A | 4/2008 |
| CN | 10126341 7 | A | 9/2008 |
| JP | 64-010223 | A | 1/1989 |
| JP | 11-015012 | A | 1/1999 |
| JP | 2007-286413 | A | 11/2007 |
| JP | 2008-122536 | A | 5/2008 |
| JP | 2008-122940 | A | 5/2008 |
| WO | 2007/040127 | A1 | 4/2007 |
| WO | 2007108183 | A1 | 9/2007 |
| WO | WO 2007108183 | A1 * | 9/2007 |

OTHER PUBLICATIONS

Office Action dated Jun. 18, 2012 issued by the State Intellectual Property Office of P.R. China in Chinese Application No. 200910212131.5.

Communication dated Nov. 20, 2012 issued by the Japanese Patent Office in counterpart Japanese Patent Application No. 2008-287482.

* cited by examiner

*Primary Examiner* — Waseem Moorad
(74) *Attorney, Agent, or Firm* — Sughrue Mion, PLLC

(57) ABSTRACT

To provide a liquid crystal display device and the like, which can improve the contrast ratio. The liquid crystal display device includes a liquid crystal display unit and an image processing unit which supplies video signals inputted from a video source section to the liquid crystal display unit. The liquid crystal display unit is formed by stacking a single first liquid crystal display element and a single or a plurality of second liquid crystal display element(s). For each pixel unit of the second liquid crystal display element, the image processing unit generates, by having each dot of the video signal as a reference point, a drive signal for displaying an image according to processing for extracting a maximum value of relative gradations or relative transmittances among a region of a pixel unit (dot) group including the reference pixel units and the pixel units (dots) neighboring to the reference pixel units.

19 Claims, 39 Drawing Sheets

DISPLAY PATTERN (e)

PIXEL MAXIMUM RELATIVE TRANSMITTANCE : Tpix

REGION MAXIMUM RELATIVE TRANSMITTANCE : Tmax a) CALCULATED VALUES OF ARITHMETIC OPERATION UNIT THAT DOES NOT BELONG TO CONDITIONS OF FIRST EXEMPLARY EMBODIMENT OF PRESENT INVENTION b) GRADATION CHARACTERISTIC THAT DOES NOT BELONG TO CONDITIONS OF FIRST EXEMPLARY EMBODIMENT OF PRESENT INVENTION DISPLAY PATTERN (e)

PIXEL MAXIMUM TRANSMITTANCE : Tpix

AVERAGING PROCESSING : Tave

R G B
R G B
R G B
R G B W
R G B W
R G B Y
R G B Y
R G B
R G B
R G B W
R G B Y
R G B
R G B
R G B

LIQUID CRYSTAL DISPLAY DEVICE, LIQUID CRYSTAL DISPLAY CONTROL DEVICE, ELECTRONIC DEVICE, AND LIQUID CRYSTAL DISPLAY METHOD

CROSS-REFERENCE TO RELATED APPLICATION

This application is based upon and claims the benefit of priority from Japanese patent application No. 2008-287482, filed on Nov. 10, 2008, the disclosure of which is incorporated herein in its entirety by reference.

BACKGROUND OF THE INVENTION

1. Field of the Invention

The present invention relates to a liquid crystal display device (liquid crystal display) and, more specifically, to improving contrast ratios of the liquid crystal display device.

2. Description of the Related Art

Liquid crystal display devices (liquid crystal display) exhibit a characteristic of being capable of implementing high definition with low power consumption, and those display devices are employed broadly to various devices from small portable telephones to large television monitors.

While the liquid crystal displays are used broadly, there is an issue in terms of the contrast ratios. The contrast ratio of the liquid crystal display in a dark place is normally about 1000:1. This is inferior to that of discharge-type displays such as CRT, plasma display, and FED/SED. This fails to provide a sense of lively reality, when displaying an image source such as a movie with a full expression in black sections.

There is Japanese Unexamined Patent Publication S64-010223 (Patent Document 1), for example, as a technique for overcoming such issue. FIG. 39 is an explanatory illustration showing a structure of a liquid crystal display panel 900 according to Patent Document 1. This liquid crystal display panel 900 includes a plurality of TN-type liquid crystal display panels 941 and 942 which are substantially in a same shape. Each of the liquid crystal display panels 941 and 942 is formed with a pair of transparent substrates 911, 912 and a pair of transparent substrates 913, 914 having electrodes for driving liquid crystals, TN-type liquid crystal layers 931, 932 interposed between the pair of transparent substrates, and polarization plates 901, 902, 903, 904 disposed on both sides of the pair of transparent substrates. Each of corresponding electrodes 921-924 are stacked to be superimposed one on another completely in the direction of an optical axis 951, and each of the liquid crystal display panels 941 and 942 are driven simultaneously with a same drive signal.

Through employing such structure, it is possible to improve the contrast ratio that is about 10-15 with a structure using a single liquid crystal display panel to about 100:1 by stacking two panels, when the contrast ratio is measured by using a laser beam. Further, the contrast ratio can be improved to about 1000:1 by stacking three panels. It is so described in Patent Document 1 that such structure can achieve the contrast ratio that is above the limit of the contrast that can be displayed with a single liquid crystal display panel.

Further, Japanese Unexamined Patent Publication 2007-286413 (Patent Document 2) discloses a technique which decreases color changes generated due to a viewing direction by providing a color filter to one of n-pieces of stacked liquid crystal display panels, considering the fact that light passes through different-color layers of color filter layers and the colors are mixed on a lower-layer liquid crystal display panel and an upper-layer liquid crystal display panel when a viewer moves the visual field physically in a case where the liquid crystal display panels having color filter layers are stacked. This technique further applies averaging processing on a video source by corresponding to a single to (n−1)-pieces of liquid crystal display panels among the n-pieces of stacked liquid crystal display panels so as to decrease a parallax generated due to the viewing directions while improving the contrast ratio of the liquid crystal display device greatly.

Further, Japanese Unexamined Patent Publication 2008-122940 (Patent Document 3) discloses a technique which keeps luminance of regions with luminance 100 in bright-point display having the bright luminance 100, and applies averaging processing on a luminance distribution where there is a change in the brightness (light and dark) in a part with luminance 0 in the boundary sections between pixels of luminance 100 and pixels of luminance 0. Japanese Unexamined Patent Publication H11-015012 (Patent Document 4) discloses a display device having three or more stacked liquid crystal display panels, in which the liquid crystal display panel as an intermediate layer is thinner than the other layers, and a nonlinear element is provided to one of two substrates sandwiching the intermediate layer.

It is true that Patent Document 1 is capable of improving the contrast ratio through driving the two stacked liquid crystal display panels by same signals from a same signal source. However, the liquid crystal layers are isolated by a specific distance in the thickness direction. Thus, when a viewer moves the visual field physically, position shift (parallax) in the displays occurs between those liquid crystal layers depending on the angles (viewing directions). This raises another issue such as deterioration in the visibility.

In the meantime, the technique depicted in Patent Document 2 is capable of displaying videos with a sense of lively reality since it can provide a full expression in black sections when displaying videos of relatively moderate luminance changes, such as images of nature displayed often on TVs and movies.

However, the technique of Patent Document 2 applies averaging means to the video source, so that images generated thereby come to have a dull difference between the levels of the luminance. Thus, transmittance is deteriorated in the liquid crystal elements of one to (n−1)-pieces of liquid crystal panels among the n-pieces of stacked liquid crystal display panels. Therefore, display luminance of such liquid crystal display device in which the panels are stacked comes to be deteriorated when displaying videos of sharp luminance changes, such as text display and fine pattern display.

Further, the technique of Patent Document 3 can keep the luminance of the one to (n−1)-pieces of liquid crystal display panels among the n-pieces of stacked liquid crystal display panels in the regions located in the perpendicular direction of the panels of the pixels regions of luminance 100, so that luminance deterioration does not occur in the front visual field. Therefore, the technique of Patent Document 3 can be considered effective in this respect.

However, with the technique of Patent Document 3, position shift occurs in the n-pieces of stacked liquid crystal display panels depending on the viewing directions, and the luminance in that region is deteriorated since the luminance of the one to (n−1)-pieces of liquid crystal display panels among the n-pieces of stacked liquid crystal display panels is attenuated. Further, with the technique of Patent Document 3, there still remains an issue of having color changes since the ratio of light amount passing through each dot of the liquid crystal display panels having the color filter layer changes. The technique of Patent Document 4 is designed to overcome generation of parallax through forming the liquid crystal display panel as the intermediate layer to be thinner than the other layers. However, the distance in the thickness direction is not reduced, so that it is not possible to overcome the issues of luminance deterioration and color changes.

SUMMARY OF THE INVENTION

An exemplary object of the present invention is to overcome the above-described issues of luminance deterioration and color changes caused due to changes in the viewing direction, and to provide a liquid crystal display device, a liquid crystal display control device, an electronic device, and a liquid crystal display method, which can improve the contrast ratio.

In order to achieve the foregoing exemplary object, the liquid crystal display device according to an exemplary aspect of the invention is a liquid crystal display device which displays a video signal inputted from a video source on a liquid crystal display unit. The liquid crystal display device includes: the liquid crystal display unit that is formed by stacking a single first liquid crystal display element and a single or a plurality of second liquid crystal display element(s) for displaying an image, each of the first liquid crystal display element and the second liquid crystal element being formed with a plurality of pixel units arranged in matrix for displaying the image; and an image processing unit which, by having each pixel unit of the video signal as reference point, generates a drive signal for displaying an image based on processing which extracts a maximum value of relative gradations that are ratios of gradations with respect to a maximum gradation of the video signal or a maximum value of relative transmittances that are ratios of transmittances with respect to a maximum transmittance of the video signal among a group of pixel units including the pixel units taken as the reference points and a region including the pixel units neighboring to the pixel units taken as the reference points, and displays the image on the second liquid crystal display element at positions corresponding to the pixel units taken as the reference points based on the generated drive signal.

In order to achieve the foregoing exemplary object, the liquid crystal display control device according to another exemplary aspect of the invention is a liquid crystal display control device which executes a control to display an image on a stacked first liquid crystal display element and a second liquid crystal display element. The liquid crystal display control device includes an image processing unit which, by having each pixel unit of a video signal inputted from a video source as a reference point, generates a drive signal for displaying an image based on processing which extracts a maximum value of relative gradations or a maximum value of relative transmittances among a group of pixel units including the pixel units taken as the reference points and a region including the pixel units neighboring to the pixel units taken as the reference points.

In order to achieve the foregoing exemplary object, the liquid crystal display method according to still another exemplary aspect of the invention is a liquid crystal display method for displaying a video signal inputted from a video source on a liquid crystal display unit, which uses, as the liquid crystal display unit, a single first liquid crystal display element and a single or a plurality of second liquid crystal display element(s) stacked on one another for displaying an image. The method includes: by having each pixel unit of the video signal as a reference point, generating a drive signal for displaying an image based on processing which extracts a maximum value of relative gradations that are ratios of gradations with respect to a maximum gradation of the video signal or a maximum value of relative transmittances that are ratios of transmittances with respect to a maximum transmittance of the video signal among a group of pixel units including the pixel units taken as the reference points and a region including the pixel units neighboring to the pixel units taken as the reference points; and displaying the image on the second liquid crystal display element at positions corresponding to the pixel units taken as the reference points based on the generated drive signal.

BRIEF DESCRIPTION OF THE DRAWINGS

FIGS. 7A and 7B show explanatory illustration of examples of region maximum relative transmittance Tmax(i, j) of video display with a sharp luminance change calculated with the prescribed pixel region and the weight coefficient shown in FIG. 6, in which FIG. 7A shows the pixel maximum relative transmittance and the region maximum relative transmittance Tmax(i, j) of a case where video signal inputted from a video source section has the relative transmittance of 0.9 and is a dot in a size of 1 pixel in each direction or smaller, and FIG. 7B shows the pixel maximum relative transmittance and the region maximum relative transmittance Tmax(i, j) of a case where the image signal inputted from the video source section has the relative transmittance of 0.5 and is a dot in a size of 1 pixel in each direction or smaller;

FIGS. 8C and 8D show illustrations following those of FIGS. 7A and 7B, in which FIG. 8C shows the pixel maximum relative transmittance and the region maximum relative transmittance Tmax(i, j) of a case where the video signal inputted from the video source section has the relative transmittance of 0.9 and is a dot in a size of 3 pixels in each direction or smaller, and FIG. 8D shows the pixel maximum relative transmittance and the region maximum relative transmittance Tmax(i, j) of a case where the image signal inputted from the video source section has the relative transmittance of 0.9 and is a straight line in a width of 1 pixel or smaller;

FIG. 9 shows illustrations following those of FIGS. 7A and 7B and FIGS. 8C and 8D, in which FIG. 9E shows the pixel maximum relative transmittance and the region maximum relative transmittance Tmax(i, j) of a case where the video signal inputted from the video source section has the relative transmittance of 0.5 and is a set of dots in a size of 1 pixel in each direction or smaller;

FIGS. 11A-11C show graphs of examples regarding the calculated values and the gradation characteristics obtained by processing executed by the arithmetic operation unit shown in FIG. 4, in which FIG. 11A shows the relative transmittances T1 and T2 to be displayed on the first and second liquid crystal display elements with respect to the region maximum relative transmittance Tmax, FIG. 11B shows the relative luminance with respect to the gradation characteristic, and FIG. 11C is a graph showing the enlarged low gradation part of FIG. 11B.

FIGS. 12A-12C show graphs of examples regarding the calculated values and the gradation characteristics obtained by processing executed by the arithmetic operation unit shown in FIG. 4 while the errors generated on the low gradation side are improved, in which FIG. 12A shows the relative transmittances T1 and T2 to be displayed on the first and second display elements with respect to the region maximum relative transmittance Tmax, FIG. 12B shows the relative luminance with respect to the gradation characteristic, and FIG. 12C is a graph showing the enlarged low gradation part of FIG. 12B;

FIGS. 13A and 13B show graphs of examples regarding calculated values and calculated gradation characteristics which do not belong to the condition of the exemplary embodiment obtained by the arithmetic operation unit shown in FIG. 4, in which FIG. 13A shows the relative transmittances T1 and T2 to be displayed on the first and second display elements with respect to the region maximum relative transmittance Tmax, and FIG. 13B shows the relative luminance with respect to the gradation characteristic;

FIGS. 14A-14D are graphs of other examples regarding the calculated values and the calculated gradation characteristics obtained by the arithmetic operation unit shown in FIG. 4, in which FIG. 14A shows gradations S1 and S2 to be displayed on the first and second liquid crystal display elements with respect to region maximum gradation Smax(i, j), FIG. 14B shows the relative transmittances T1 and T2 to be displayed on the first and second liquid crystal display elements with respect to the region maximum relative transmittance Tmax, FIG. 14C shows the relative luminance with respect to the gradation characteristic, and FIG. 14D shows the enlarged low gradation part of FIG. 14C;

FIGS. 16A and 16B show graphs of examples of the region averaging processing according to the related technique shown in FIG. 15, in which FIG. 16A shows the pixel maximum transmittance and the region maximum transmittance Tmax(i, j) of a case where video signal inputted from a video source section has the relative transmittance of 0.9 and is a dot in a size of 1 pixel in each direction or smaller, and FIG. 16B shows the pixel maximum transmittance and the region maximum transmittance Tmax(i, j) of a case where the video signal inputted from the video source section has the relative transmittance of 0.5 and is a dot in a size of 1 pixel in each direction or smaller;

FIGS. 17C and 17D show illustrations following those of FIGS. 16A and 16B, in which FIG. 17C shows the pixel maximum transmittance and the region maximum transmittance Tmax(i, j) of a case where the video signal inputted from the video source section has the relative transmittance of 0.9 and is a dot in a size of 3 pixels in each direction or smaller, and FIG. 17D shows the pixel maximum transmittance and the region maximum transmittance Tmax(i, j) of a case where the video signal inputted from the video source section has the relative transmittance of 0.9 and is a straight line in a width of 1 pixel or smaller;

FIG. 18 shows illustrations following those of FIGS. 16A and 16B and FIGS. 17C and 17D, in which FIG. 18E shows the pixel maximum transmittance and the region maximum transmittance Tmax(i, j) of a case where the video signal inputted from the video source section has the relative transmittance of 0.5 and is a set of dots in a size of 1 pixel in each direction or smaller;

FIGS. 19A-19C show graphs of inputted image signals and distributions of outputted relative transmittances regarding the region maximum value extraction processing according to the exemplary embodiment and the region averaging processing according to the related technique, respectively, in which FIG. 19A shows the inputted signals, FIG. 19B shows the relative transmittance outputted with the maximum value extraction processing according to the exemplary embodiment, and FIG. 19C shows the relative transmittance outputted with the region averaging processing according to the related technique;

FIGS. 21A-21C show explanatory charts showing chromaticity changes in the display on the liquid crystal display device depending on the viewing direction, which are of the averaging processing according to the related technique, in which FIG. 21A shows the relative transmittance distribution of the liquid crystal display element recognized by a viewer from the front side, FIG. 21B shows the relative transmittance distribution of the second liquid crystal display element, and FIG. 21C shows the luminance distribution of the liquid crystal display device;

FIGS. 22A-22C show the charts following those of FIG. 21, in which FIG. 22A shows the relative transmittance distribution of the first liquid crystal display element recognized by the viewer from the oblique direction, FIG. 22B shows the relative transmittance distribution of the second liquid crystal display element, and FIG. 22C shows the luminance distribution of the liquid crystal display device;

FIGS. 23A-23C show explanatory charts showing chromaticity changes in the display on the liquid crystal display device depending on the viewing direction, which are of the maximum value extraction processing according to the exemplary embodiment, in which FIG. 23A shows the relative transmittance distribution of the first liquid crystal display element recognized by a viewer from the front side, FIG. 23B shows the relative transmittance distribution of the second liquid crystal display element, and FIG. 23C shows the luminance distribution of the liquid crystal display device;

FIGS. 24A-24C show the charts following those of FIGS. 23A-23C, in which FIG. 24A shows the relative transmittance distribution of the first liquid crystal display element recognized by the viewer from the oblique direction, FIG. 24B shows the relative transmittance distribution of the second liquid crystal display element, and FIG. 24C shows the luminance distribution of the liquid crystal display device;

DETAILED DESCRIPTION OF THE EXEMPLARY EMBODIMENTS

First Exemplary Embodiment

Figure 1:
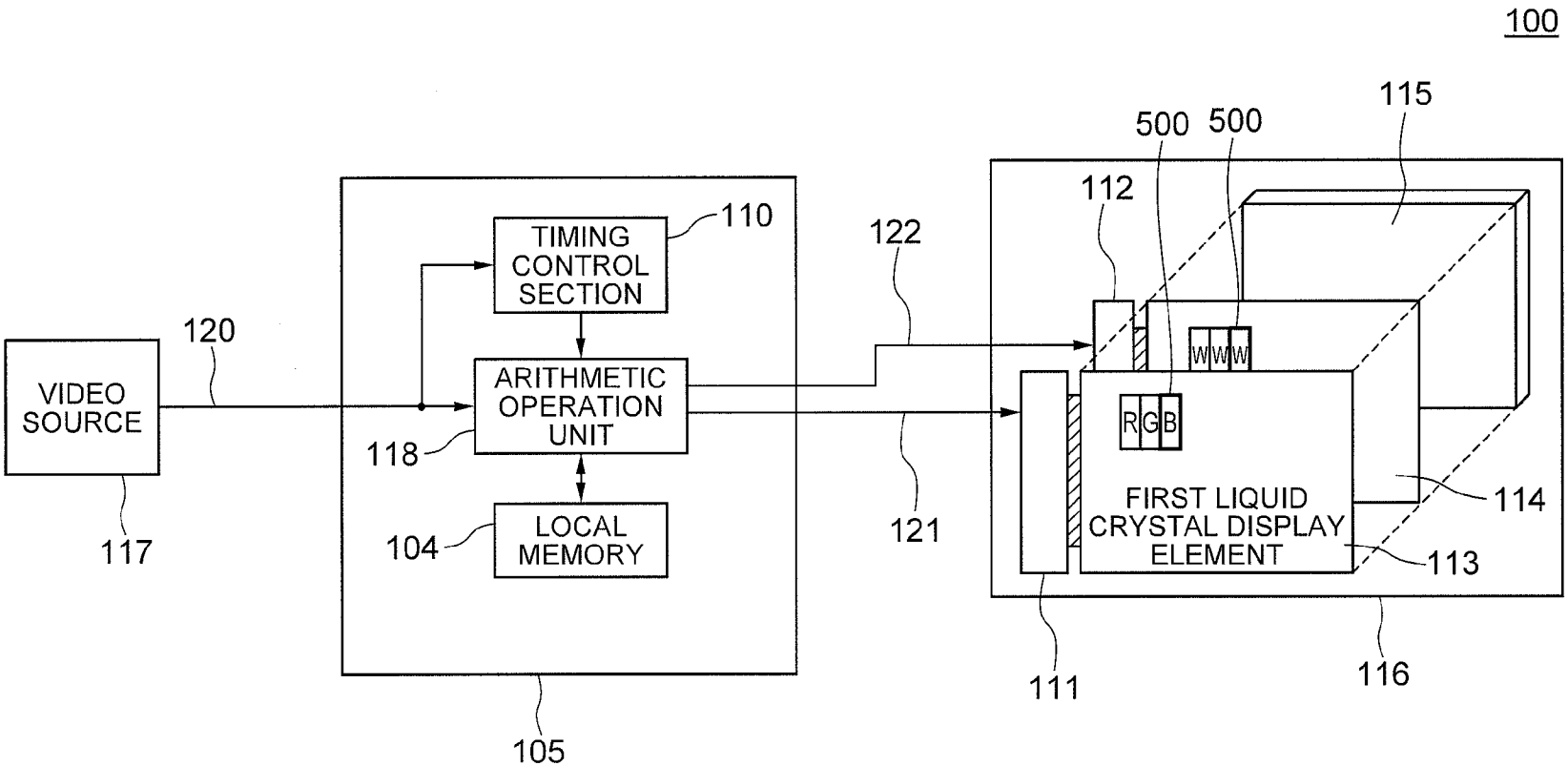
FIG. 1 is an explanatory illustration showing a structure of a liquid crystal display device according to a first exemplary embodiment of the invention.

Hereinafter, a structure of an exemplary embodiment of the invention will be described by referring to FIG. 1.

First, basic contents of the first exemplary embodiment will be described, and more specific contents thereof will be described thereafter.

An image display device 100 according to the first exemplary embodiment is a liquid crystal display device which includes a liquid crystal display unit 116, and an image processing unit 105 which supplies video signals inputted from a video source section 117 to the liquid crystal display unit 106. The liquid crystal display unit 116 is formed by stacking a first liquid crystal display element 113 and a second liquid crystal display element 114. Provided therein are a single first liquid crystal display element 113 and a single or a plurality of second liquid crystal display element(s) 114. For each pixel unit of the second liquid crystal display element 114, the image processing unit 105 takes each dot of video signals as reference point, and generates drive signals for displaying images according to processing which extracts a maximum value of relative gradations or a maximum value of relative transmittances among a region of a pixel unit (dot) group including the pixel unit (dot) 500 taken as the reference point and the pixel units (dots) neighboring to the pixel unit (dot) taken as the reference point, and displays an image at a position corresponding to the pixel unit of the second liquid crystal display element taken as the reference point based on the generated drive signals. Note that a dot may be used as a pixel unit. Alternatively, a pixel formed with a plurality of dots may be used as the pixel unit, as will be described later.

When generating the drive signal for displaying the image, in a case where the video signal inputted from the video source section 117 is of a display with bright-color dot display in a dark background, the image processing unit may generate, for each dot of the second liquid crystal display element 114, the drive signal for displaying synthesized relative gradation S2 that satisfies S2≧S in a pixel unit (dot) group including the bright-color pixel units (dots) and pixel units (dots) neighboring to one of those pixel units (dots), provided that relative gradation of the display with the bright-color pixel units (dots) based on the video signal inputted from the video source section 117 is S, and the synthesized relative gradation that is a product of the relative gradations displayed in each of the liquid crystal display elements of the second liquid crystal display elements 114 is S2. Note here that the relative gradation may be replaced with the relative transmittance.

Further, the image processing unit 105 may include: an in-region maximum transmittance extracting section 401 which, when generating the drive signal for displaying the image, by having each dot of the video signal as the reference point, extracts an in-region maximum relative gradation that is a maximum value of the relative gradations of the video signal among the group of pixel units including the pixel units (dots) taken as the reference points and the region including the pixel units (dots) neighboring to the pixel units (dots) taken as the reference points; and a second display element image arithmetic operation section 402 which performs an arithmetic operation of image data to be displayed on the second liquid crystal display element based on the extracted region maximum relative gradation. The second liquid crystal display element arithmetic operation section may generate the drive signal to display synthesized relative gradation S2 that is displayed on the second liquid crystal display element to satisfy S2≧Smax, provided that the region maximum relative gradation extracted from the video signal is Smax, and the synthesized relative gradation displayed on the second liquid crystal display element is S2. Note that the relative gradation may be replaced with the relative transmittance, and the synthesized relative gradation may be replaced with the synthesized relative transmittance. In that case, the region maximum relative gradation is replaced with the maximum region relative transmittance that is the maximum value among the relative transmittances.

When generating the drive signal for displaying the image, the image processing unit 105 may generate, for each of the pixel units (dots) of the first liquid crystal display element 113, the drive signal with which relative gradation S1 to be displayed on the first liquid crystal display element 113 satisfies S1=0 when S2=0 and satisfies S1=S/S2 when S2≠0, provided that the relative gradation of the video signal inputted from the video source section 117 is S and the synthesized relative gradation displayed on the second liquid crystal display element 114 is S2. In that case, the relative gradation may be replaced with the relative transmittance, and the synthesized relative gradation may be replaced with the synthesized relative transmittance as well.

Through employing such structures, the first exemplary embodiment can improve the contrast ratio of the entire liquid crystal display device with the outputs from the second liquid crystal display element 114.

This will be described in more details hereinafter.

FIG. 1 is an explanatory illustration showing the structure of the image display device 100 according to the first exemplary embodiment of the invention. The image display device 100 includes the image processing unit 105 which receives outputs from the video source section 117 that outputs video data and converts the received video data to signals corresponding to each liquid crystal display element, and includes the liquid crystal display unit 116 which displays videos according to the converted signals. Each unit is connected via transmission paths 120-122. The liquid crystal display unit 116 includes a plurality of stacked liquid crystal display elements (first and second liquid crystal display elements 113 and 114 in FIG. 1). In the case of FIG. 1, a dot 500 is used as the pixel unit.

As the display modes of the first and second liquid crystal display elements 113 and 114, it is possible to combine and employ various kinds of modes such as IPS (In Plane Switching) mode, TN (Twisted Nematic) mode, and VA (Vertical Alignment) mode as appropriate. Described herein as a way of example is a case where the first and second liquid crystal display elements 113 and 114 are of the IPS mode.

The video source section 117 rebuilds video data, typically pictures and moving images, into electronic image data, and generates video signals that can be transmitted to the image processing unit 105. The video signals generated herein are transmitted to the image processing unit 105 via the transmission path 120. The video source section 117 may be of any kinds which output video data. For example, the video source section 117 may be a personal computer, a broadcast receiving section which decodes television broadcast (analog broadcast, terrestrial digital broadcast, etc.) or a reproducing device which reproduces various kinds of recorded video sources.

Further, the transmission path 120 may be of any kinds, as long as it is capable of transmitting the video signals outputted from the video source section 117 to the image processing unit 105. Already-known interfaces can be used according to the structure of the system. For example, in a case of external transmission between casings, digital transmission such as DVI (Digital Visual Interface) or analog transmission such as analog RGB signals may be used. In a case of transmission within a device, serial transmission such as LVDS (Low Voltage Differential Signal) or parallel transmission signals of CMOS (Complementary Metal Oxide Semiconductor) or the like, or transmission between logic circuits inside a same gate array may be employed.

The image processing unit 105 includes: a timing control section 110 for controlling timings at which signals are outputted to the liquid crystal display unit 116; an arithmetic operation unit 118 for executing arithmetic operation processing on the video signals received from the video source section 117; and a local memory 104. The image processing unit 105 uses the arithmetic operation unit 118 to execute signal conversion (image processing) on the video signals received via the transmission path 120, and transmits drive signals for driving each of the liquid crystal display elements to each of a plurality of liquid crystal display elements which form the liquid crystal display unit 116 via the transmission paths 121 and 122.

The timing control section 110 controls the timing for the arithmetic operation unit 118 to output the signals to the liquid crystal display unit 116 to have the images displayed on each of the liquid crystal display elements 113 and 114 synchronized with each other. The local memory 104 will be described later.

The image processing unit 105 may be structured as a logic circuit in a single or a plurality of FPGA (Field Programmable Gate Array) or ASIC (Application Specific Integrated circuit). Further, the image processing performed by the image processing unit 105 can employ not only the image processing by hardware but also image processing by software. For example, the processing of the video source section 117 and the image processing unit 105 may be executed in a same casing by the software processing using a CPU or by using a graphic chip such as an MPEG decoder.

Further, as in the case of the transmission path 120, the transmission paths 121 and 122 may be of any kinds, as long as signals outputted from the video source section 117 for displaying images to each of the liquid crystal display elements can be transmitted therewith to the image processing unit 105. Typical interfaces may be employed depending on the structure of the system. For example, in a case of external transmission between devices, digital transmission such as DVI or analog transmission such as analog RGB signals may be used. In a case of transmission within a casing, serial transmission such as LVDS or parallel transmission signals of CMOS or the like may be employed.

The liquid crystal display unit 116 includes liquid crystal driving circuits 111, 112, the first and second liquid crystal display elements 113, 114, and a light source 115. The first liquid crystal display element 113 is structured as a liquid crystal display element for color display, and the second liquid crystal display element 114 is structured as a liquid crystal display element for monochrome display. The placing order of the first and second liquid crystal display elements 113 and 114 may be inverted from the order shown in FIG. 1. That is, the liquid crystal display element 114 for monochrome display may be placed on the side closer to the viewer, and the liquid crystal display element 113 for color display may be placed on the side closer to the light source.

Each of the liquid crystal driving circuits 111 and 112 drives the first and second liquid crystal display elements 113 and 114 based on the signals received from the image processing unit 105. The light source 115 radiates light to the first and second liquid crystal display elements 113 and 114 from the back-face side thereof. The light emitted from the light source 115 is modulated based on the drive signals inputted to the second liquid crystal display element 114 when passing through the second liquid crystal display element 114, and then makes incident onto the first liquid crystal display element 113. In the first liquid crystal display element 113, the displayed image is controlled based on the inputted drive signals. The viewer observes the displayed image by observing the light transmitted through the first and second liquid crystal display elements 113 and 114 from the light source 115 side.

Figure 2:
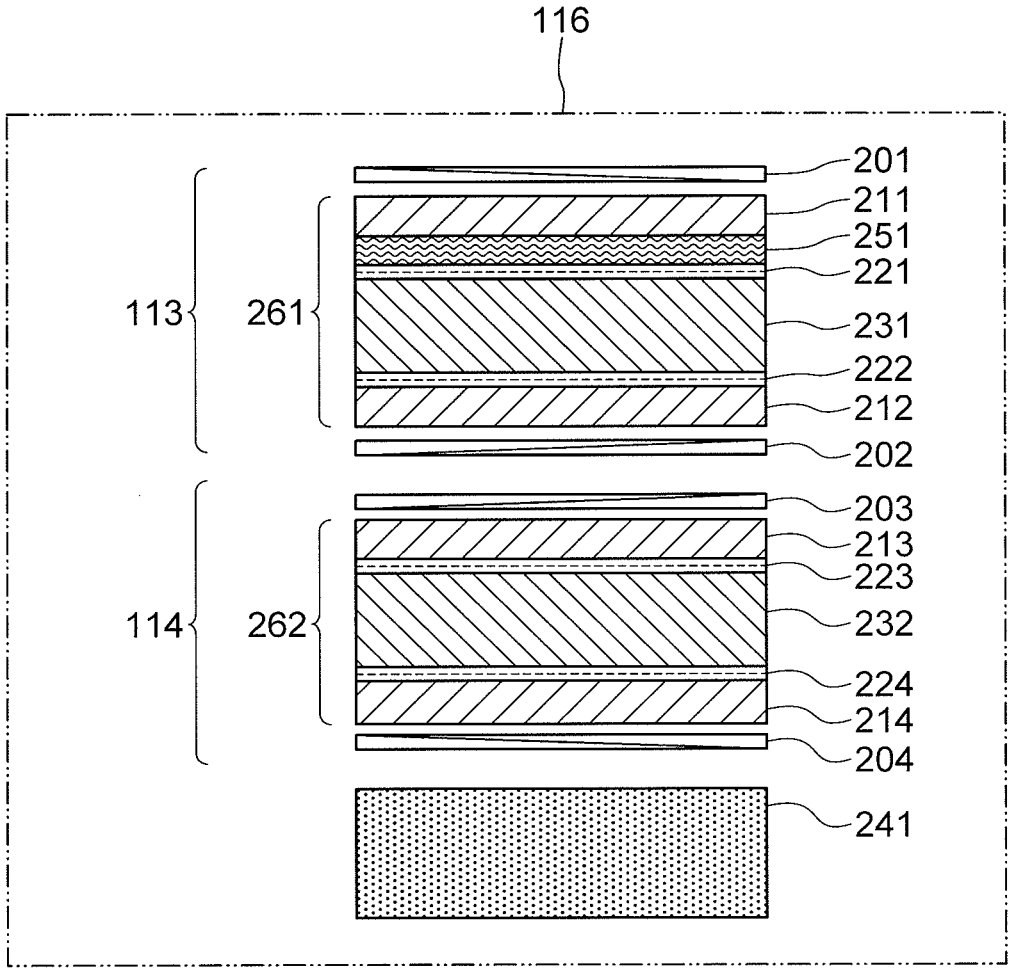
FIG. 2 is an explanatory illustration showing a sectional structure of a liquid crystal display element part of a liquid crystal display unit shown in FIG. 1.

FIG. 2 is an explanatory illustration showing a sectional structure of the liquid crystal display element part of the liquid crystal display unit 116 shown in FIG. 1. In the first liquid crystal display element 113, a polarization plate 201, a transparent substrate 211, a color filter layer 251, an alignment film 221, a liquid crystal layer 231, an alignment film 222, a transparent substrate 212, and a polarization plate 202 are disposed in order from the light emission side. In the second liquid crystal display element 114 on a light source 241 (115) side, a polarization plate 203, a transparent substrate 213, an alignment film 223, a liquid crystal layer 232, an alignment film 224, a transparent substrate 214, and a polarization plate 204 are disposed in order from the light emission side.

Hereinafter, for conveniences' sake, the transparent substrate 211, the color filter layer 251, the alignment film 221, the liquid crystal layer 231, the alignment film 222, the transparent substrate 212, and the like are called a first liquid crystal display panel 261, and the first liquid crystal display panel 261 and a pair of polarization plates 201 and 202, etc. are called the first liquid crystal display element 113. Further, the transparent substrate 213, the alignment film 223, the liquid crystal layer 232, the alignment film 224, the transparent substrate 214, and the like are called a second liquid crystal display panel 262, and the second liquid crystal display panel 262 and a pair of polarization plates 203 and 204, etc. are called the second liquid crystal display element 114.

On the liquid crystal layer side of the transparent substrate 212 which forms the first liquid crystal display element 113, signal lines and scanning lines are disposed in matrix, and a 3-terminal type TFT (Thin Film Transistor) nonlinear element is disposed in the vicinity of each intersection point, thereby forming one dot. Within the dot, a drain electrode connected to one end of source/drain of the TFT and a common electrode connected to a common wiring are formed in a comb-like shape. The liquid crystal layer 231 is driven by a lateral electric field generated by the drain electrode and the common electrode formed in the comb-like shape.

The color filter layer 251 is formed to the transparent substrate 211, in which red (R), green (G), and blue (B) layers, for example, are disposed in a stripe form where R, G, and B are repeated to correspond to the electrode matrix disposed on the transparent substrate 213. One pixel is formed with three dots having neighboring color filters of R, G, and B.

A manufacturing method of the first liquid crystal display element 113 will be described. The alignment films 221 and 222 are applied respectively to the surface of the transparent substrate 211 on the color filter layer 251 side and the surface of the transparent substrate 212 on the side where the electrodes in matrix are disposed, and liquid crystal alignment processing such as rubbing is executed. Thereafter, the surfaces of the transparent substrates 211 and 222 where the alignment films 221 and 222 are formed are placed to face with each other with a prescribed gap therebetween in such a manner that the liquid crystal alignment directions become in parallel or in antiparallel to each other.

In this gap, a liquid crystal material is disposed to be the first liquid crystal display panel 261. Further, the polarization plates 201 and 202 are disposed on the outer side of the first liquid crystal display panel 261. In this manner, the first liquid crystal display element 113 is formed. At this time, the polarization plates 201 and 202 are disposed in such a manner that the light transmission axes or the light absorption axes of the polarization plates 201 and 202 become almost orthogonal to each other, and the light absorption axis of either one of the polarization plates 201 and 202 becomes in parallel to the liquid crystal alignment direction of the liquid crystal layer 231.

The structure of the second liquid crystal display element 114 is almost the same as that of the first liquid crystal display element 113. It is an only difference that no color filter layer is disposed in the transparent substrate 213 of the second liquid crystal display element 114, whereas the color filter layer 251 is disposed in the transparent substrate 211 of the first liquid crystal display element 113. Note here that the resolution of pixel unit is the same for the first liquid crystal display element 113 and the second liquid crystal display element 114.

That is, it is not essential to have three dots of a single color in a set as one pixel by having the same dot size in the first liquid crystal display element 113 and the second liquid crystal display element 114. For example, as will be described later, when a pixel formed with a plurality of dots is used as a pixel unit, it is unnecessary for one pixel of the second liquid crystal display element 114 to be divided into three dots by corresponding to R, G, and B unlike the case of the first liquid crystal display element 113, since the second liquid crystal display element 114 does not have the color filter layer. One pixel of the second liquid crystal display element 114 can be formed with one dot.

The liquid crystal display unit 116 is formed by stacking the first liquid crystal display element 113 and the second liquid crystal display element 114 in such a manner that the pixel positions of the two liquid crystal display elements can substantially correspond with each other. At this time, the two liquid crystal display elements are disposed in such a manner that the liquid crystal alignment direction of the first liquid crystal display element 113 and that of the second liquid crystal display element 114 become substantially parallel or perpendicular with respect to each other.

Further, it is preferable for the first liquid crystal display element 113 and the second liquid crystal display element 114 to be stacked in such a manner that the light transmission axes or the light absorption axes of the polarization plate 202 of the first liquid crystal display element 113 on the light incident side and the polarization plate 203 of the second liquid crystal display element 114 on the light emission side become almost parallel. With this, the light transmitted through the polarization plate 203 can efficiently transmit the polarization plate 202 of the first liquid crystal display element 113 on the light incident side.

Based on such perspective, the exemplary embodiment has been described by referring to the case where the polarization plate 202 is disposed in the first liquid crystal display element and the polarization plate 203 is disposed in the second liquid crystal display element. However, the present invention can employ a structure in which either the polarization plate 202 or the polarization plate 203 is omitted, and only a single polarization plate is placed between the first liquid crystal display element and the second liquid crystal display element.

As described above, in the exemplary embodiment, only the first liquid crystal display element out of a plurality of liquid crystal display elements configuring the image display device 100 has the color filter layer formed therein.

In the exemplary embodiment, the display element on the upper layer side that is away from the backlight is taken as the first liquid crystal display element. However, it is also possible to define the panel on the lower layer side close to the backlight as the first liquid crystal display element and define the upper layer side as the second display element. In the liquid crystal display device of the present invention, there is no specific limit set for the vertical positional relation regarding the first liquid crystal display element where the color layer is provided and the second liquid crystal display element where no color layer is provided. In the liquid crystal display device of the present invention, it is simply required that a single or a plurality of liquid crystal display element(s) having no color layer is stacked on a single liquid crystal display element that has the color layer formed therein.

Now, there will be described the reason why it is decided in the exemplary embodiment to have "single" first liquid crystal display element where the color layer is formed. If a plurality of first liquid crystal display elements with the color layers are stacked, three-dimensional shift (called parallax hereinafter) in the positional relation occurs depending on the angles (called viewing directions hereinafter), when the viewer moves the visual field physically. Due to this, light may transmits different color regions in the color filter layer on the lower layer side and the color filter layer of the upper layer side. For example, when light transmitted through a red color filter in a given layer transmits a blue color filter of another layer, the display chromaticity may change largely depending on the viewing directions.

The liquid crystal display unit 116 of the present invention is formed including only a single first liquid crystal display element where the color layer is formed. Thus, changes in the chromaticity that may be generated depending on the viewing directions do not occur.

Since the liquid crystal display unit 116 of the present invention is in such structure in which a single first liquid crystal display element where the color layer is formed is stacked with a single or a plurality of second liquid crystal display element(s) where no color layer is formed, it does not happen that transmission light transmits through the color filters of different colors depending on the viewing directions. However, parallax depending on the viewing directions is still generated, because of the structure in which a plurality of display elements are stacked.

Therefore, in a case where a plurality of stacked liquid crystal display elements in the image display device 100 of the above-described structure are driven with same signals from a same signal source, the distances between the viewing point of the viewer and the liquid crystal layers of each liquid crystal display elements vary for each liquid crystal display element. Therefore, there may be cases where the displays cannot be seen clearly due to the parallax, depending on the viewing directions.

In order to compensate the differences in the appearances of the observed display due to the parallax, the exemplary embodiment applies image processing on the signals for driving the first liquid crystal display element 113 and the signals for driving the second liquid crystal display element 114 on the basis of the video signals inputted from the video source section as the reference.

In order to implement easy understanding of the features of the present invention, there will be described a concept of the image processing method for enabling a sense of parallax felt by the viewer depending on the viewing directions to be eliminated in the structure where a plurality of liquid crystal display elements are stacked. Further, there will be described a method for defining a distance range r within for performing the maximum value extracting processing of a single dot in the first liquid crystal display element 113.

Figure 3:
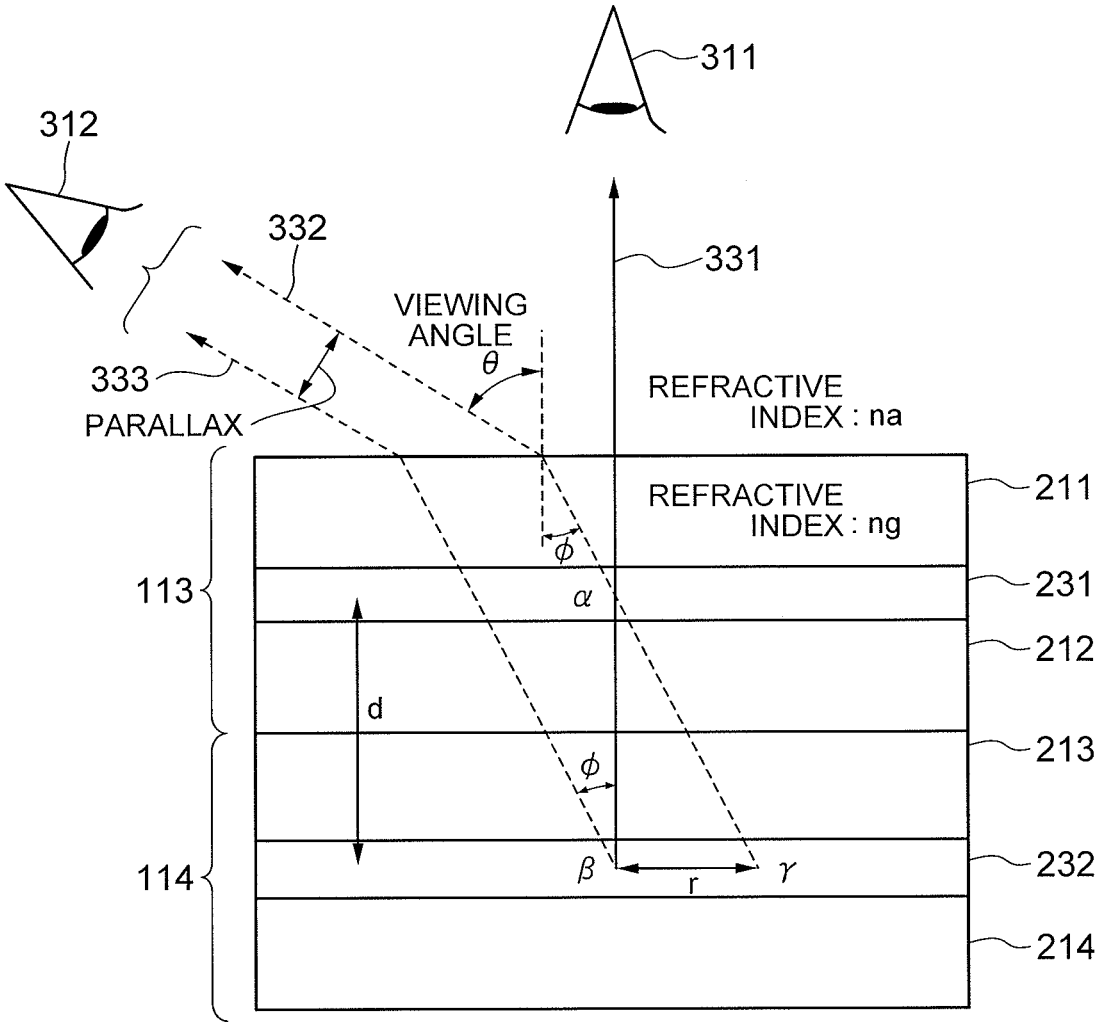
FIG. 3 is an explanatory illustration showing a fragmentary enlarged sectional view of a main part of the liquid crystal display unit shown in FIG. 1.

FIG. 3 is an explanatory illustration showing a fragmentary enlarged sectional view of the main part of the liquid crystal display unit 116 that is shown in FIG. 1. Further, FIG. 3 is also a fragmentary conceptual diagram of the part that is necessary for describing the stacked liquid crystal display elements illustrated in FIG. 2.

Now, described is a relation between the viewer's viewing direction and the visibility in a case where same image information is displayed on the stacked first liquid crystal display element 113 and second liquid crystal display element 114. When the viewer visually recognizes the liquid crystal display elements 113 and 114 from a viewing point 311 that is in the perpendicular direction of the display surfaces thereof, lines of eyesight 331 overlap in the same direction. Thus, information α displayed on the first liquid crystal display element 113 and information β displayed on the second liquid crystal display element 114 are recognized in an overlapped manner. Therefore, the viewer does not feel a sense of uncomfortable feeling, such as seeing double images.

However, when observing the image information from the direction of viewing point 312, i.e., from the directions other than the perpendicular direction of the display surfaces of the liquid crystal display elements 113 and 114, lines of eyesight 332 and 333 for observing the information α and information β are shifted in the directions away from each other. Thus, the positions of the video become shifted, so that the observed image is seen in double. The viewer feels a sense of uncomfortable feeling because of the double image generated due to the parallax between the lines of eyesight 332 and 333. In order to eliminate such uncomfortable feeling caused by the parallax, the arithmetic operation unit 118 the image processing unit 105 executes image processing that is described below.

Assuming that the viewing angle of the viewer shifted from the perpendicular direction of the display surfaces of the liquid crystal display elements 113 and 114 is θ, and the angle of the light emitted from the backlight and traveling the inside of the liquid crystal display elements 113 and 114 is ϕ, a following formula applies based on Snell's law.

$$n_a \sin\theta = n_g \sin\phi \qquad \text{[Expression 1]}$$

Note that "ng" is the refractive index of the transparent substrates of the liquid crystal display element 113 and 114, and "na" is the refractive index of air. When this is transformed, the angle of the light traveling the inside of the liquid crystal display elements 113 and 114 can be expressed with a following formula.

$$\phi = \sin^{-1}((n_a/n_g)\sin\theta) \qquad \text{[Expression 2]}$$

Based on the relationship above, the amount r (position shift amount) by which the display positions on the first liquid crystal display element 113 and the second liquid crystal element 114 vary when viewed from the direction of the viewing angle θ can be expressed with a following formula.

$$\tan\phi = r/d \qquad \text{[Expression 3]}$$

$$r = d\tan\phi$$

$$= d\tan(\sin^{-1}((n_a/n_g)\sin\theta))$$

In order to eliminate the parallax in the oblique visual field of angle θ, the information that is supposed to be displayed at the position of β may be displayed by extending it to the position of point γ by the distance range of r. Thus, the arithmetic operation unit 118 executes the image processing for expanding the information of the point β to the distance range r for the entire screen for the signals that drive the second liquid crystal display element 114. Through enabling the second liquid crystal display element to display the information by considering the parallax, it is possible to overcome the sense of uncomfortable feeling, such as seeing the image in double due to the parallax.

When executing the image processing for expanding the image to the distance range r, the arithmetic operation unit 118 executes, for each dot of the video signals inputted from the video source section 117, processing for extracting the maximum value of the relative transmittance from the dot group containing the reference dot and the dots in the neighboring region of the reference dot by having the each dot as the reference point. That is, in a prescribed region for executing the image processing, the arithmetic operation unit 118 executes the processing by defining the distance range from the outer periphery of the reference dot to include the region having the position shift amount r on the basis of the viewing direction where the dot group is anticipated.

Further, the arithmetic operation unit 118 executes the image processing on the signals outputted to the second liquid crystal display element 14 that has no color filter layer. The reason that the arithmetic operation unit 118 performs the image processing for expanding the image to the distance range r on the signals to the second liquid crystal display element 114 is as follows. That is, if the arithmetic operation unit 118 performs the image processing on the signals outputted to the first liquid crystal display element 113 for displaying the color image, color information is mixed, thereby causing changes in colors and missing of colors. Further, the second liquid crystal display element on which the image processing is performed is not necessarily placed on the viewer side. There is no specific influence imposed, even if the second liquid crystal display element is placed on the opposite side. Therefore, the second liquid crystal display element 114 is not limited to be placed on the viewer side.

The image processing will be described by returning to FIG. 1 once again. The video signals inputted from the video source section 117 via the transmission path 120 are received, and inputted to the arithmetic operation unit 118 and the timing control section 110. Here, the arithmetic operation unit 118 executes accumulation of the images and the image processing in parallel by using the local memory 104 which accumulates the video signals inputted from the video source section. The local memory 104 can be achieved with a structure including (N−1)-number of line memories, provided that the prescribed region corresponds to a size of N-number of scanning lines, for example.

For each dot of the second liquid crystal display element 114, the arithmetic operation unit 118 generates drive signals for displaying the image based on the processing which extracts the maximum value of the relative transmittance among the dot group including the reference dots and the dots in a prescribed region neighboring to the reference dots by having each dot of the video signals inputted from the video source section 117 as the reference point (called a reference dot hereinafter). For each dot of the first liquid crystal display panel, the arithmetic operation unit 118 generates drive signals for displaying the image which is so generated that the display on the liquid crystal display device formed with n-pieces (n is an integer of 2 or larger) of stacked liquid crystal display elements becomes the same as the video signals inputted from the video source section.

The timing control section 110 adjusts the transmission timing of the drive signals by considering the processing delay time of the image processing, in such a manner that the images are displayed on the first and second liquid crystal display elements 113 and 114 at a same timing. The generated drive signals are transmitted to the liquid crystal display unit 116 via the transmission paths 121 and 122.

Figure 4:
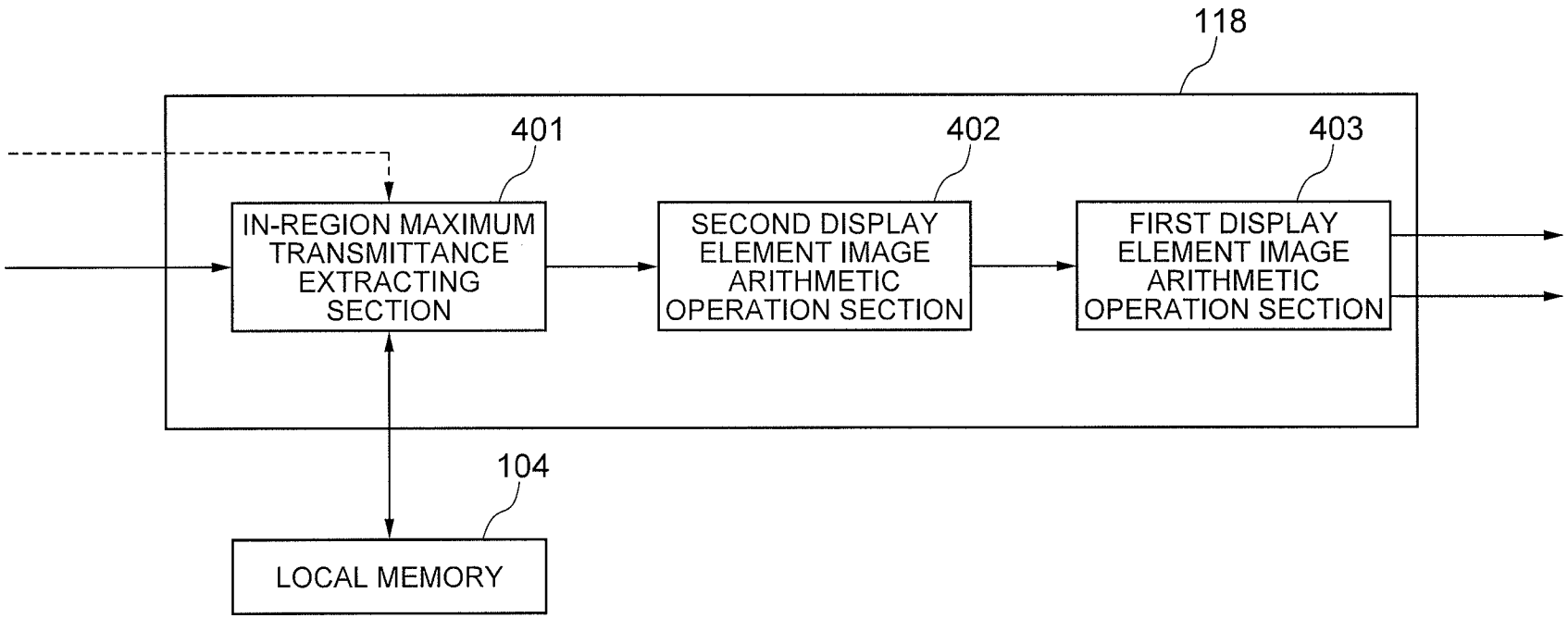
FIG. 4 is an explanatory illustration showing a more detailed functional block structure of an arithmetic operation unit shown in FIG. 1.

FIG. 4 is an explanatory illustration showing more detailed structures of functional blocks of the arithmetic operation unit 118 shown in FIG. 1. The arithmetic operation unit 118 includes: an in-region maximum transmittance extracting section 401 which performs maximum value extraction processing described later; and a first display element image arithmetic operation section 403 and a second display element image arithmetic operation section 402, which respectively perform arithmetic operations of the image data to be displayed on the first and second liquid crystal display elements 113 and 114. The arithmetic operation unit 118 receives image signals from the transmission path 120 of FIG. 1, and inputs the received image signals to the in-region maximum transmittance extracting section 401 within the arithmetic operation unit 118. This exemplary embodiment is described by referring to the case where the input signals are of RGB colorimetric system and a single pixel of the liquid crystal display unit 116 is formed with three dots of RGB.

The in-region maximum transmittance extracting section 401 writes and accumulates the received image signals to the local memory 104. At the same time, the in-region maximum transmittance extracting section 401 timely reads out the accumulated image signals at the timing for being used in the arithmetic operation processing, and performs arithmetic operation on the video signals to be displayed on the first and second liquid crystal display elements 113 and 114. Hereinafter, the inputted image signal of each dot is expressed with a coordinate system of two directions, i.e., directions i and j towards the display surface, and a gradation signal of each dot is expressed as Sdot(i, j).

For each of the dots forming the pixel, the in-region maximum transmittance extracting section 401 calculates the relative transmittance Tdot(i, j) by having the minimum transmittance as 0 and the maximum transmittance as 1, based on the inputted image signals. For example, if the inputted image signals are of N-bit resolution and have a gradation characteristic called γ curve, the relative transmittance can be calculated with a following formula.

$$T_{dot}(i,j)=\{S_{dot}(i,j)/(2N-1)\}^{\gamma} \quad \text{[Expression 4]}$$

The in-region maximum transmittance extracting section 401 sets in advance a prescribed dot region with −P1 to +P2 dots in the i direction and −Q1 to +Q2 dots in the j direction including the region of the position shift amount r by having each dot as the reference point, and calculates the maximum relative transmittance among the group of dots located within the prescribed range from the reference dot as the region maximum relative transmittance Tmax(i, j). Note that "k=−P1 to +P2", and "l=−Q1 to +Q2".

$$T_{max}=\max(T_{dot}(i+k,j+l)) \quad \text{[Expression 5]}$$

For the prescribed dot region, it is more effective when the in-region maximum transmittance extracting section 401 expands the prescribed dot region by −P1 to +P2 dots in the direction and −Q1 to +Q2 dots in the j direction including the region of the position shift amount r, sets a weight coefficient G(i, j) for each dot, and calculates the region maximum relative transmittance Tmax(i, j) with a following formula.

$$T_{max}=\max(T_{dot}(i+k,j+l)\times G(k,l)) \quad \text{[Expression 6]}$$

Figure 5:
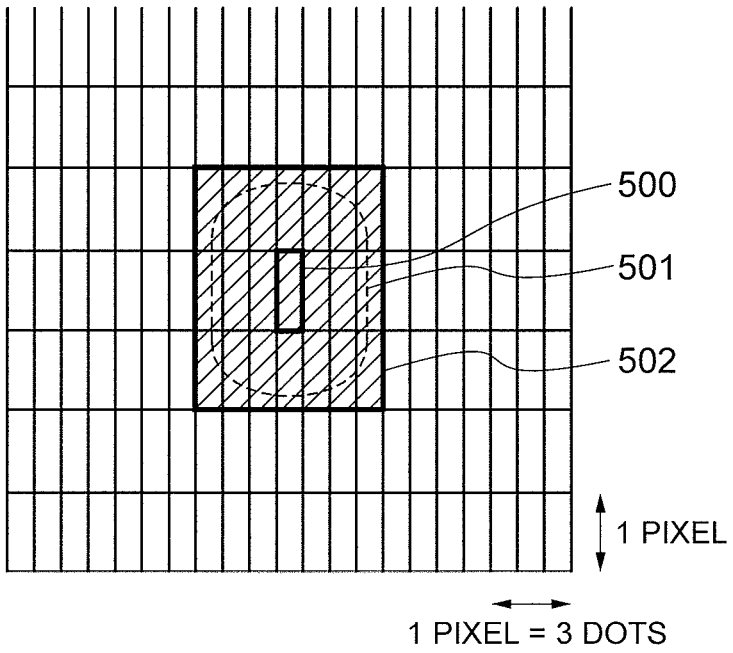
FIG. 5 is an explanatory illustration showing an example of processing regarding a prescribed dot region and a weight coefficient when an in-region maximum transmittance extracting section shown in FIG. 4 executes the processing.

FIG. 5 is an illustration for describing the processing executed by the in-region maximum transmittance extracting section 401 that is shown in FIG. 4, and it is an explanatory illustration showing an example of the processing for the reference dot and the dot region neighboring to the reference dot as well as the processing for the weight coefficient. The in-region maximum transmittance extracting section 401 estimates in advance a region 501 that is shifted by the above-described position shift amount r from the outer periphery of the reference dot 500 as the reference point. Further, the in-region maximum transmittance extracting section 401 takes the region of the pixels P1=P2=3 and Q1=Q2=1 including the region 501 of the position shift amount r as a dot region 502, and sets the weight coefficient inside the dot region 502 as 1.

Furthermore, the in-region maximum transmittance extracting section 401 expands the dot region 502 to the surrounding region, and takes the region of P3=P4=6 and Q3=Q4=2 as a prescribed dot region 503. Further, the in-region maximum transmittance extracting section 401 sets the weight coefficient of the expanded region as a value equal to 1 or smaller as in a following expression.

[Expression 7]

$$G(k,1)=\begin{Bmatrix} 0 & 0.5 & 0.5 & 0.5 & 0.5 & 0.5 & 0.5 & 0.5 & 0.5 & 0.5 & 0.5 & 0.5 & 0 \\ 0.5 & 0.5 & 0.5 & 1.0 & 1.0 & 1.0 & 1.0 & 1.0 & 1.0 & 1.0 & 0.5 & 0.5 & 0.5 \\ 0.5 & 0.5 & 0.5 & 1.0 & 1.0 & 1.0 & 1.0 & 1.0 & 1.0 & 1.0 & 0.5 & 0.5 & 0.5 \\ 0.5 & 0.5 & 0.5 & 1.0 & 1.0 & 1.0 & 1.0 & 1.0 & 1.0 & 1.0 & 0.5 & 0.5 & 0.5 \\ 0 & 0.5 & 0.5 & 0.5 & 0.5 & 0.5 & 0.5 & 0.5 & 0.5 & 0.5 & 0.5 & 0.5 & 0 \end{Bmatrix}$$

As shown in FIG. 5, the in-region maximum transmittance extracting section 401 performs the processing for extracting the maximum value of the relative transmittance from reference dot and the group of dots neighboring to the reference dot. However, the in-region maximum transmittance extracting section 401 may perform processing for extracting the maximum value of the relative transmittance from a pixel as a reference point (called a reference pixel hereinafter) and a group of pixels in a prescribed region neighboring to the reference pixel. Through this, the resolution of the second liquid crystal display element 114 can be made coarse from the dot unit to the pixel unit, thereby making it possible to cut the cost.

The in-region maximum transmittance extracting section 401 writes and accumulates the received image signals to the local memory 104. At the same time, the in-region maximum transmittance extracting section 401 timely reads out the accumulated image signals at the timing for being used in the arithmetic operation processing, and performs arithmetic operation on the video signals to be displayed on the first and second liquid crystal display elements 113 and 114. Hereinafter, the inputted image signal of each pixel is expressed with a coordinate system of two directions, i.e., directions i and j towards the display surface, and a gradation signal of each dot is expressed as Sx(i, j). Note that "x" is one of colors R (red), G (green), and B (blue). When there is a subscript "x" in following expressions, it also indicates R, G, or B unless there is a specific explanation.

For each of the dots forming the pixel, the in-region maximum transmittance extracting section 401 calculates the relative transmittance Tx(i, j) by having the minimum transmittance as 0 and the maximum transmittance as 1, based on the inputted image signals. For example, if the inputted image signals are of N-bit resolution and have a gradation characteristic called γ curve, the relative transmittance can be calculated with a following formula.

$$T_X(i,j)=\{S_X/(2N-1)\}\gamma \quad \text{[Expression 8]}$$

For the calculated relative transmittance of each dot, the in-region maximum transmittance extracting section 401 compares the relative transmittances TR(i, j), TG(i, j), and TB(i, j) for each of the components R, G, and B of each dot by a pixel unit, and extracts the maximum value as a pixel maximum relative transmittance Tpix(i, j).

$$T_{pix}(i,j)=\max(T_R(i,j),T_G(i,j),T_B(i,j)) \quad \text{[Expression 9]}$$

The in-region maximum transmittance extracting section 401 sets in advance a prescribed pixel region with −P1 to +P2 pixels in the i direction and −Q1 to +Q2 pixels in the j direction including the region of the position shift amount r by having each pixel as the reference point, and calculates the maximum relative transmittance among the group of pixels located within the prescribed range from the reference pixel as the region maximum relative transmittance Tmax(i, j). Note that "k=−P1 to +P2", and "l=−Q1 to +Q2".

$$T_{max}=\max(T_{pix}(i+k,j+l)) \quad \text{[Expression 10]}$$

For the prescribed pixel region, it is more effective when the in-region maximum transmittance extracting section 401 expands the prescribed pixel region by −P1 to +P2 pixels in the i direction and −Q1~+Q2 pixels in the j direction including the region of the position shift amount r, sets a weight coefficient G(i, j) for each pixel, and calculates the region maximum relative transmittance Tmax(i, j) with a following formula.

$$T_{max}=\max(T_{pix}(i+k,j+l)\times G(k,l)) \quad \text{[Expression 11]}$$

Figure 6:
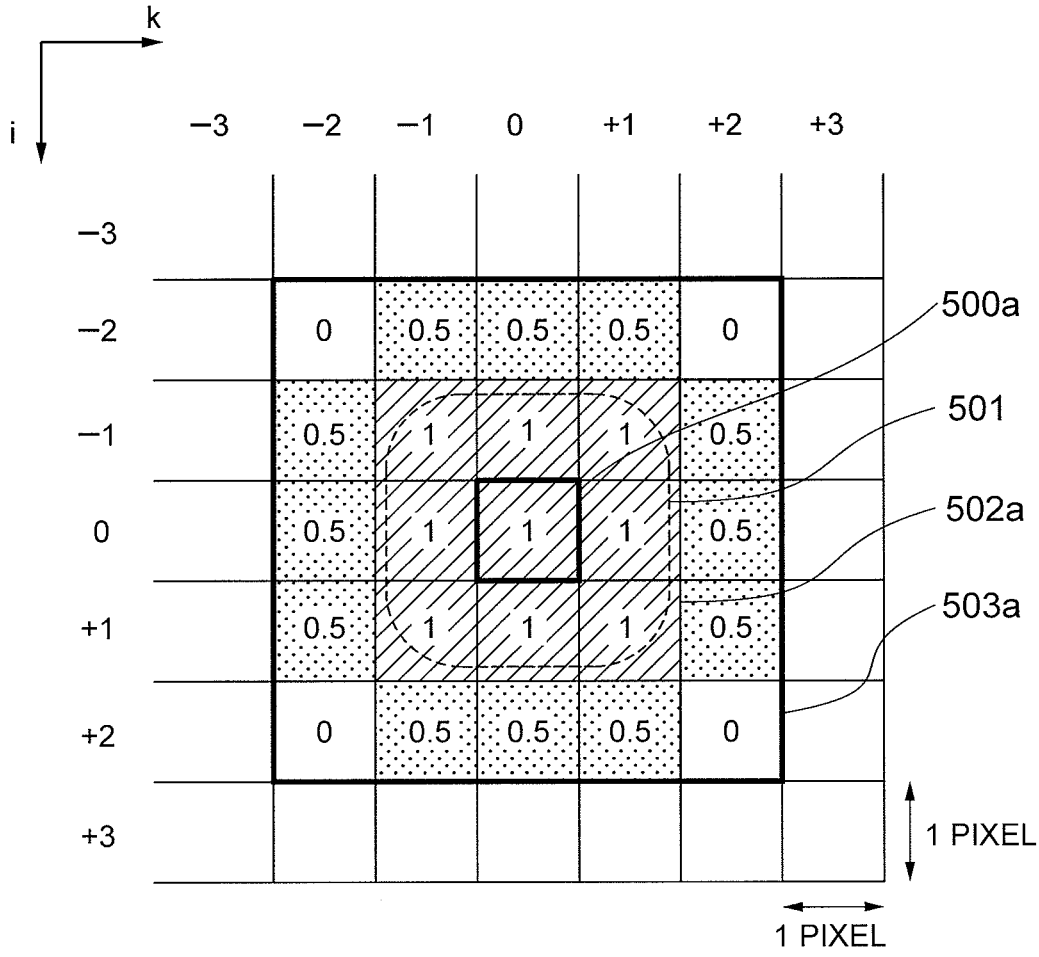
FIG. 6 is an explanatory illustration showing an example of processing regarding a prescribed pixel region and a weight coefficient when the in-region maximum transmittance extracting section shown in FIG. 4 executes the processing.

FIG. 6 is an illustration for describing the processing executed by the in-region maximum transmittance extracting section 401 that is shown in FIG. 4, and it is an explanatory illustration for specifically describing an example of the processing for the pixel region and the processing for the weight coefficient by the in-region maximum transmittance extracting section 401. In the above, the case of taking the dot as the pixel unit has been described. However, in the case of FIG. 6, a single pixel formed with two or more dots is used as the pixel unit. The in-region maximum transmittance extracting section 401 estimates in advance a region 501 that is shifted by the above-described position shift amount r from the outer periphery of the reference pixel 500*a* as the reference point. Further, the in-region maximum transmittance extracting section 401 takes the region of the pixels P1=P2=3 and Q1=Q2=1 including the region 501 of the position shift amount r from the reference pixel 500*a* as a pixel region 502 including the position shift amount r, and sets the weight coefficient inside the pixel region 502 as 1.

Furthermore, the in-region maximum transmittance extracting section 401 expands the pixel region 502 to the surrounding by 1 pixel, and takes the region of P3=P4=Q3=Q4=2 as a prescribed pixel region (G(k, l)) 503. Further, the in-region maximum transmittance extracting section 401 sets the weight coefficient of the expanded region as a value equal to 1 or smaller as in a following expression.

$$G(k, 1) = \begin{pmatrix} 0 & 0.5 & 0.5 & 0.5 & 0 \\ 0.5 & 1 & 1 & 1 & 0.5 \\ 0.5 & 1 & 1 & 1 & 0.5 \\ 0.5 & 1 & 1 & 1 & 0.5 \\ 0 & 0.5 & 0.5 & 0.5 & 0 \end{pmatrix} \quad \text{[Expression 12]}$$

Figure 7:
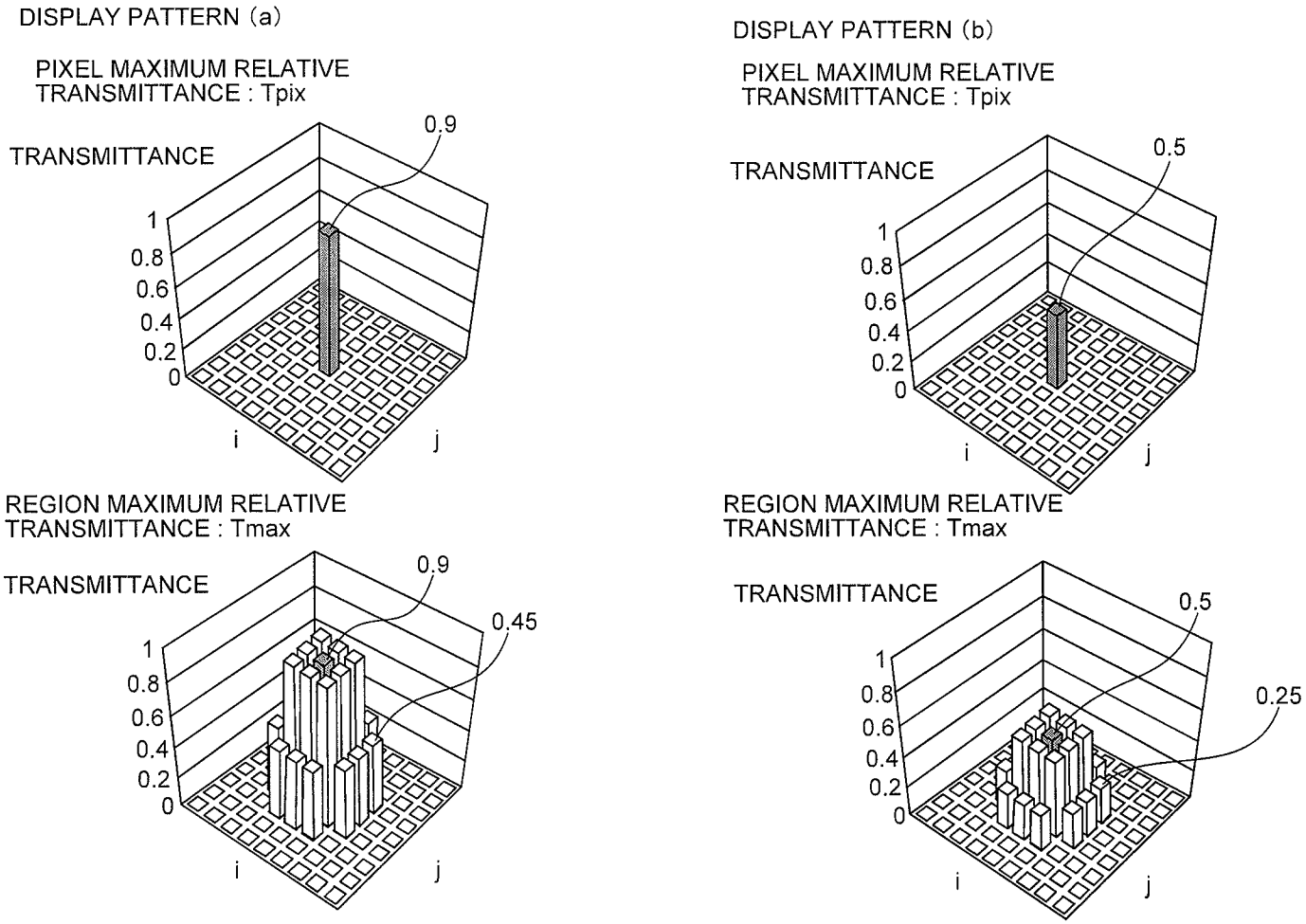
Figure 8:
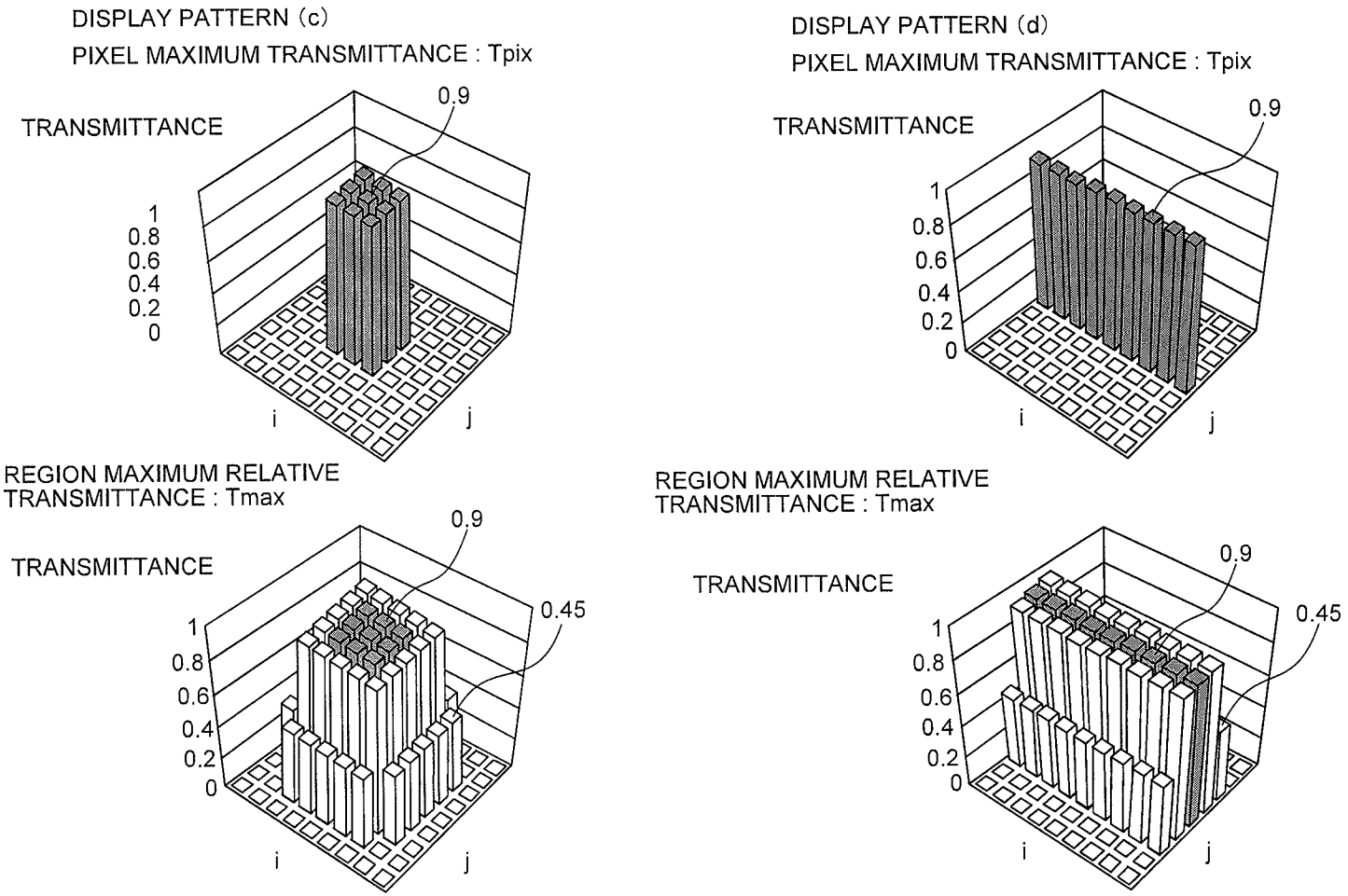
Figure 9:
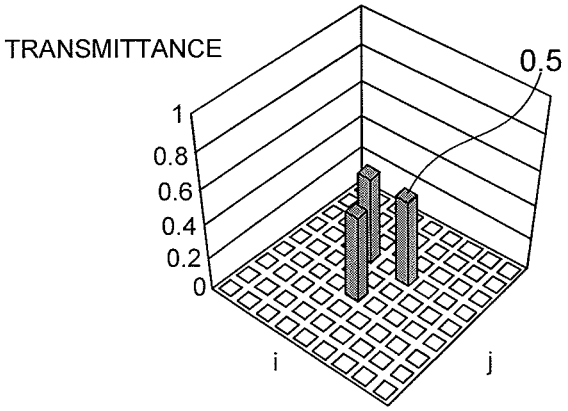
Figure 9:
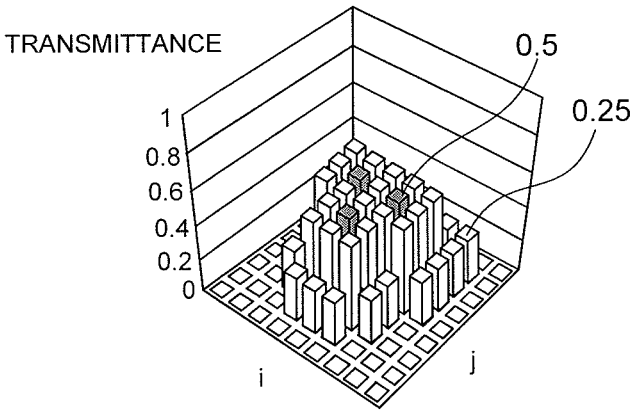

FIG. 7-FIG. 9 are explanatory illustrations showing an example of the region maximum relative transmittance Tmax (i, j) in the video display with sharp luminance changes, which is calculated with the prescribed pixel region and the weight coefficient shown in FIG. 6.

FIG. 7A shows the pixel maximum relative transmittance and the region maximum relative transmittance Tmax(i, j) of a case where the video signal inputted from the video source section 117 has the relative transmittance of 0.9 and is a dot in a size of 1 pixel in each direction or smaller, and FIG. 7B shows the pixel maximum relative transmittance and the region maximum relative transmittance Tmax(i, j) of a case where the image signal inputted from the video source section 117 has the relative transmittance of 0.5 and is a dot in a size of 1 pixel in each direction or smaller.

Further, FIG. 8C shows the pixel maximum relative transmittance and the region maximum relative transmittance Tmax(i, j) of a case where the video signal inputted from the video source section 117 has the relative transmittance of 0.9 and is a dot in a size of 3 pixels in each direction or smaller, and FIG. 8D shows the pixel maximum relative transmittance and the region maximum relative transmittance Tmax(i, j) of a case where the image signal inputted from the video source section 117 has the relative transmittance of 0.9 and is a straight line in a width of 1 pixel or smaller.

Furthermore, FIG. 9E shows the pixel maximum relative transmittance and the region maximum relative transmittance Tmax(i, j) of a case where the video signal inputted from the video source section 117 has the relative transmittance of 0.5 and is a set of dots in a size of 1 pixel in each direction or smaller.

As shown in FIG. 7-FIG. 9, with the region maximum relative transmittance Tmax(i, j) calculated by the in-region maximum transmittance extracting section 401 of the present invention, the relative transmittance of the image signals that are inputted to all the pixels are not attenuated, regardless of the value of the relative transmittance the inputted image signals may have. In the pixel region 502 including the region of the position shift r, the distribution of the relative transmittance becomes flat.

Further, even in the case where the inputted image signals display the videos with sharp luminance change, the processing can be executed to expand the bright region of the display pattern to the prescribed pixel region 502 from the external periphery of the bright region and in the width defined by the weight coefficient G (k, l). Thus, a following relation applies for all the pixels. Note that "k=−P1 to +P2" and "l=−Q1 to +Q2".

$$T_{max}(i,j) \geqq T_x(i+k,j+l) \quad \text{[Expression 13]}$$

Returning to FIG. 4, the region maximum relative transmittance Tmax(i, j) calculated by the in-region maximum transmittance extracting section 401 is transmitted to the following second display element image operation section 402. The second display element image operation section 402 applies conversion processing to the region maximum relative transmittance Tmax(i, j) to calculate relative transmittance T2(*i, j*) to be displayed on the second display element. The conversion processing may be performed on any conversion formula such as a following formula, as long as it is a formula that does not lower the region maximum relative transmittance Tmax(i, j).

$$T_2(i,j) = f(T_{max}(i,j)) \geqq T_{max}(i,j) \quad \text{[Expression 14]}$$

Figure 10:
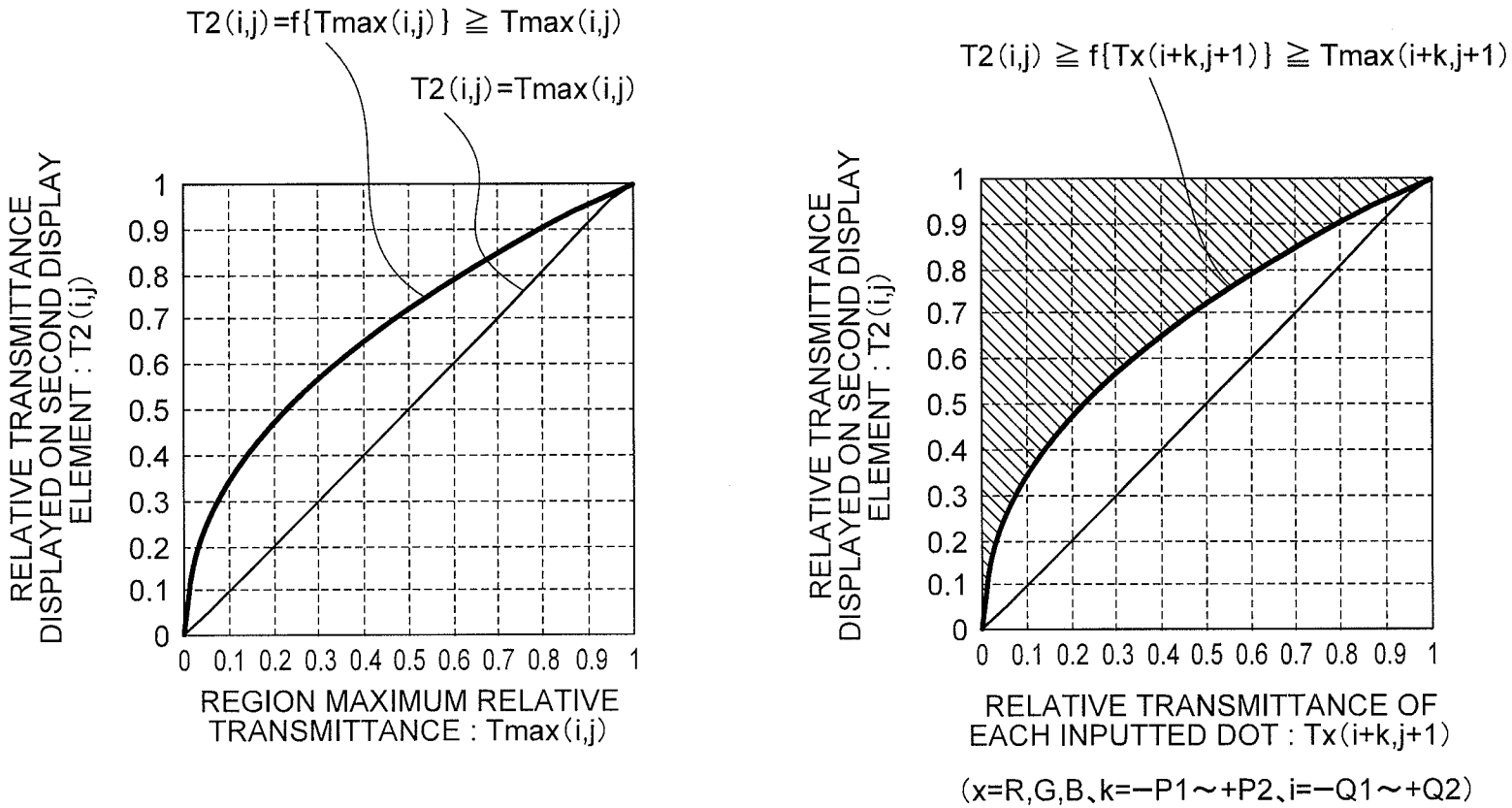
FIG. 10 shows graphs of a relation between the region maximum relative transmittance Tmax(i, j) shown in Expression 10 and relative transmittance T2(*i, j*) displayed on a second display element.

FIG. 10 shows graphs of a relation between the region maximum relative transmittance Tmax(i, j) shown in Expression 10 and the relative transmittance T2(*i, j*) displayed on the second display element. With the conversion formula in the relation of Expression 10, together with the processing of the above-described in-region maximum transmittance extracting section 401, a following relation is established as shown in FIG. 10 between the relative transmittance T2(*i, j*) displayed on the second display element and the relative transmittances TR(i, j), TG(i, j), TB(i, j) of each inputted dot. Note that "k=−P1 to +P2" and "l=−Q1~+Q2".

$$T_2(i,j) \geqq f(T_x(i+k,j+l)) \geqq T_x(i+k,j+l) \quad \text{[Expression 15]}$$

That is, when the relative transmittance of the video signal inputted from the video source section 117 is Tx and the relative transmittance displayed on the second liquid crystal display element 114 is T2, "T2≧Tx" applies in each of the pixel units, regardless of the displays that may be formed with the video signals inputted from the video source section 117. Further, for example, in a case where the video signals inputted from the video source section 117 form a display structured with bright pixel units on a dark background, "T2≧Tx'" applies in a group of the bright pixel units or at least in a group of pixel units neighboring to the bright pixel units, provided that the relative transmittance of the display structured with the bright pixel units of the video signals inputted from the video source section 117 is Tx' and the relative transmittance displayed on the second liquid crystal display element 114 is T2.

The calculated relative transmittance T2(*i, j*) displayed on the second liquid crystal display element 114 is transmitted to the first display element image arithmetic operation section 403 along with the relative transmittance Tx(i, j) of the pixel (pixel unit) located at the same position on the screen.

The viewer observing the liquid crystal display unit 116 observes the light transmitted through the first liquid crystal display element 113 and the second liquid crystal display element 114, so that the luminance (total transmittance) of the image observed by the viewer is the product of the transmittances of each of the liquid crystal display elements 113 and 114. The first display element image arithmetic operation section 403 performs arithmetic operation in such a manner that the gradation characteristic of the image displayed on the first liquid crystal display element 113 is not changed from that of the video signals inputted from the video source section 117.

For example, when the second liquid crystal display element 114 shown in this exemplary embodiment is structured with a single liquid crystal display element, the first display element image arithmetic operation section 403 may calculate the relative transmittance T1*x*(i, j) to be displayed on the first liquid crystal display element 113 with following formulae by using the relative transmittance T2(*i, j*) displayed on the second liquid crystal display element 114 and the relative transmittance Tx(i, j) of the pixel (pixel unit) located at the same position on the screen.

$$\text{WHEN } T_2(i,j)=0,\ T_{1x}(i,j)=0$$

$$\text{WHEN } T_2(i,j)\neq 0,\ T_{1x}(i,j)=T_x(i,j)/T_2(i,j) \quad \text{[Expression 16]}$$

At last, the second display element image arithmetic operation section 402 and the first display element image arithmetic operation section 401 respectively convert the calculated relative transmittance T2(*i, j*) to be displayed on the second liquid crystal display element 114 and the relative transmittance T1*x*(i, j) to be displayed on the first liquid crystal display element 113 to gradation value S2(*i, j*) to be displayed on the second display element and gradation value S1*x*(i, j) to be displayed on the first display element in accordance with the gradation characteristics of the respective display elements.

For example, the gradation values can be calculated with following formulae, in a case where the first liquid crystal display element 113 and the second liquid crystal display element 114 have N-bit resolution and the gradation characteristic called γ curve.

$$S_{1x}(i,j)=(2N-1)T_{1x}(1/\gamma)$$

$$S_2(i,j)=(2N-1)T_2(1/\gamma) \quad \text{[Expression 17]}$$

The gradation value S1*x*(i, j) to be displayed on the first liquid crystal display element 113 calculated through the above-described processing is inputted and displayed on the first liquid crystal display element 113 via the following transmission path 121. In the meantime, the gradation value S2(*i, j*) to be displayed on the second liquid crystal display element 114 is inputted and displayed on the second liquid crystal display element 114 via the following transmission path 122.

Figure 11:
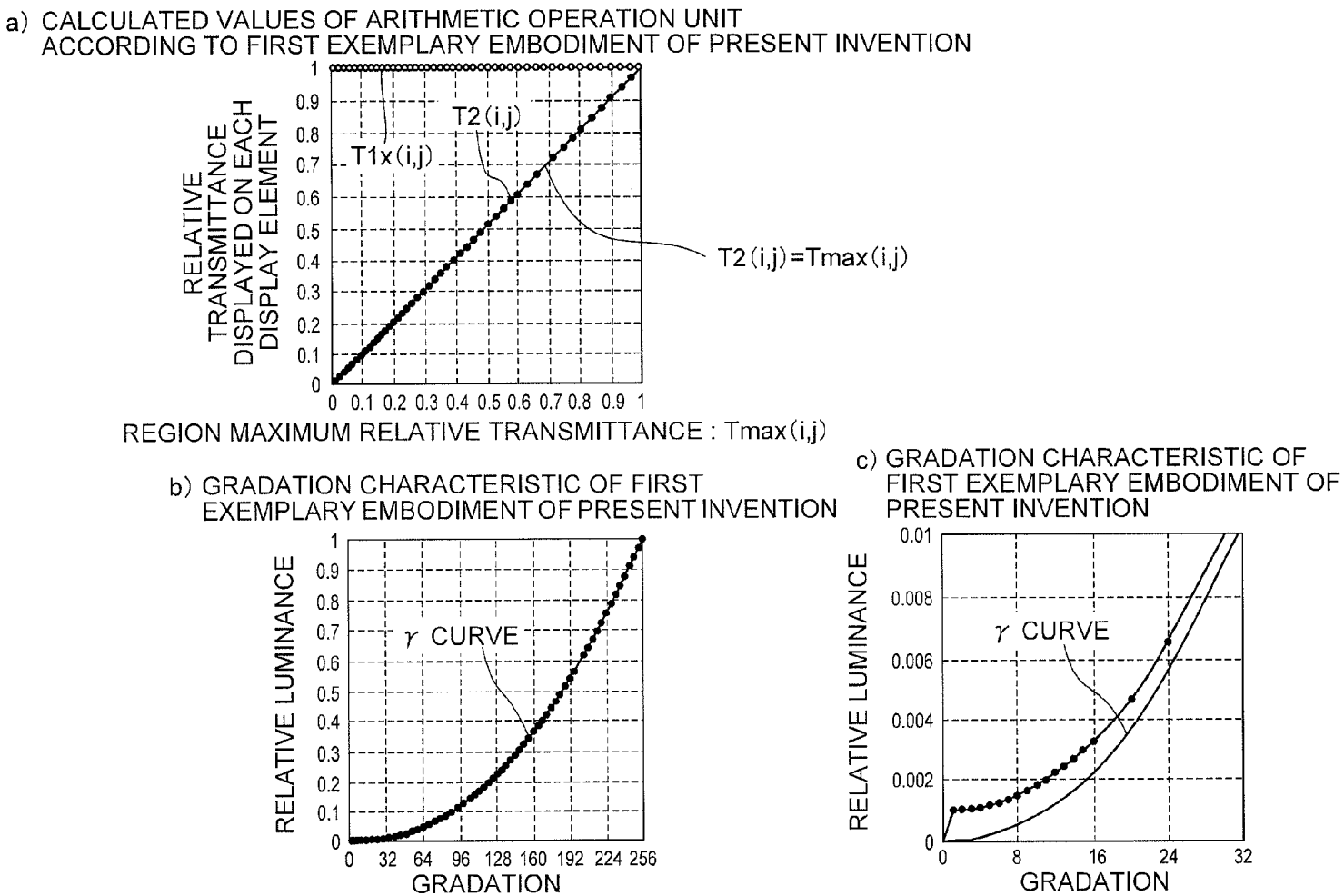
Figure 12:
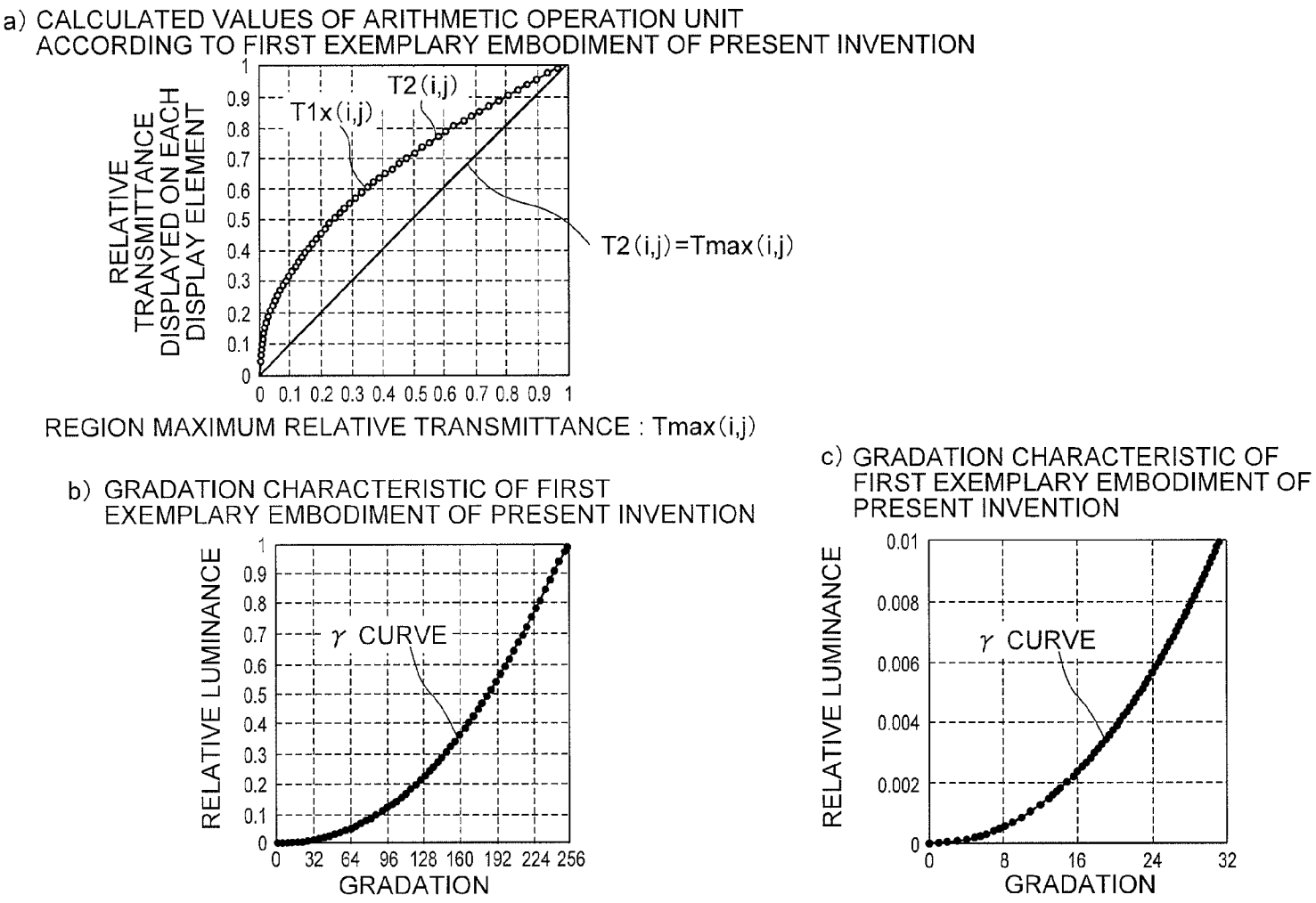

FIG. 11-FIG. 12 are graphs showing examples of the calculated values and the gradation characteristic obtained by the processing executed by the arithmetic operation unit 118 shown in FIG. 4. FIG. 11 shows the values obtained by calculating a following formula as the conversion processing applied to the region maximum relative transmittance Tmax (i, j) by the second display element image arithmetic operation section 402 described above.

$$T_2(i,j)=T_{max}(i,j) \quad \text{[Expression 18]}$$

FIG. 11A shows the relative transmittances T1 and T2 to be displayed on the first and second liquid crystal display elements 113 and 114 with respect to the region maximum relative transmittance Tmax. FIG. 11B shows the relative luminance with respect to the gradation characteristic, and FIG. 11C is a graph showing the enlarged low gradation part of FIG. 11B. As shown in the graphs, the relative transmittance T2(*i, j*) displayed on the second liquid crystal display element 114 and the relative transmittance T1*x*(i, j) displayed on the first liquid crystal display element 113 are higher than the region maximum relative transmittance Tmax(i, j). The relative transmittance T1*x*(i, j) displayed on the first liquid crystal display element 113 is expressed with following formulae, and the changes thereof becomes discontinuous.

$$\text{WHEN } T_{max}(i,j)=0,\ T_{1x}(i,j)=0$$

$$\text{WHEN } T_{max}(i,j)\neq 0,\ T_{1x}(i,j)=1 \quad \text{[Expression 19]}$$

In this case, black luminance radically changes in the vicinity of the region maximum relative transmittance Tmax(i, j)=0 also in the gradation characteristic of the liquid crystal display system of the present invention, as shown in FIG. 11C. Therefore, an error is generated in the gradation characteristic on the low gradation side.

FIG. 12 shows graphs obtained by calculating a following formula as the conversion processing applied to the region maximum relative transmittance Tmax(i, j) by the second display element image arithmetic operation section 402 in order to improve the error described above. Note that coefficient A is 0.5.

$$T_2(i,j)=f(T_{max}(i,j))=T_{max}(i,j)A \quad \text{[Expression 20]}$$

FIG. 12A shows the relative transmittances T1 and T2 to be displayed on the first and second display elements with respect to the region maximum relative transmittance Tmax. FIG. 12B shows the relative luminance with respect to the gradation characteristic, and FIG. 12C is a graph showing the enlarged low gradation part of FIG. 12B. As shown in FIG. 12A, each of the relative transmittance T2(*i, j*) displayed on the second liquid crystal display element 114 and the relative transmittance T1*x*(i, j) displayed on the first liquid crystal display element 113 changes continuously.

In this case, the gradation characteristic of the liquid crystal display system according to the present invention becomes the gradation characteristic that is equivalent to that of the video signal inputted from the video source section, as shown in FIG. 12B and FIG. 12C. This is a preferable example for the embodiment of the present invention.

Figure 13:
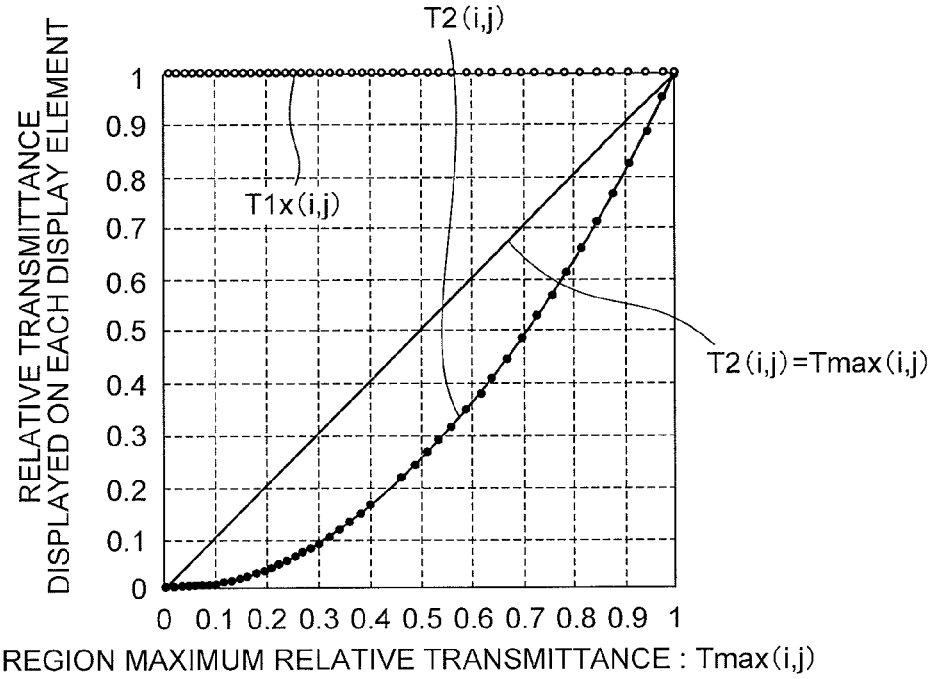
Figure 13:
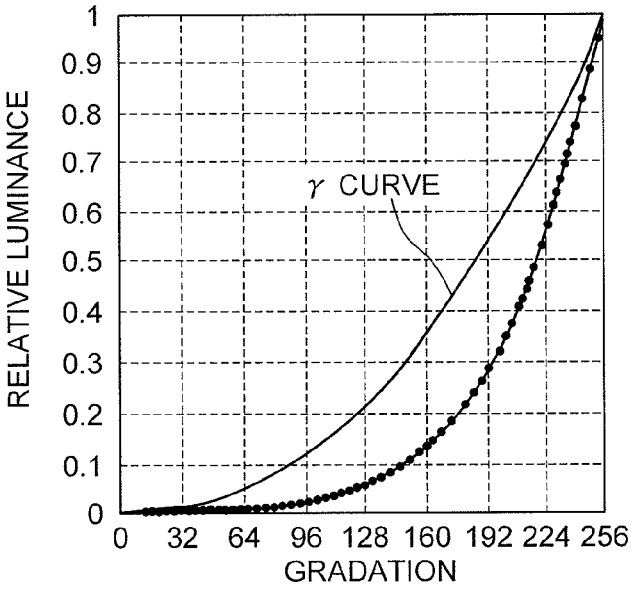

FIG. 13 shows graphs shows graphs of examples regarding calculated values and the calculated gradation characteristics which do not belong to the condition of the exemplary embodiment obtained by the arithmetic operation unit 118 shown in FIG. 4. FIG. 13 shows graphs obtained by calculating a following formula as the conversion processing applied to the region maximum relative transmittance Tmax(i, j) by the second display element image arithmetic operation section 402.

$$T_2(i,j)<T_{max}(i,j) \quad \text{[Expression 21]}$$

FIG. 13A shows the relative transmittances T1 and T2 to be displayed on the first and second display elements with respect to the region maximum relative transmittance Tmax. FIG. 13B shows the relative luminance with respect to the gradation characteristic. As shown in FIG. 13A, the relative transmittance T1*x*(i, j) displayed on the first liquid crystal display element 113 is calculated to have a value of larger than 1, and "1" that is the maximum transmittance of the liquid crystal display element is taken as the upper limit thereof. In this case, the gradation characteristic of the liquid crystal display system becomes different from that of the video signal inputted from the video source section 117, as shown I FIG. 13B.

In a case where the input signals are of RGB colorimetric system, a single pixel of the liquid crystal display unit 116 is formed with three dots of RGB, and the relative transmittance characteristics of each of the liquid crystal display elements 113 and 114 are exponential functions of the gradation signals and are same exponential functions (e.g., each of the liquid crystal display elements is set to have the gradation characteristic called γ curve), the gradation values may be used instead of the relative transmittances.

For example, when each dot of RGB is of N-bit resolution, the in-region maximum transmittance extracting section 401 compares the gradations SR(i, j), SG(i, j), and SB(i, j) of each dot by a pixel unit, and extracts the maximum value as a pixel maximum gradation Spix(i, j) as in a following formula.

$$S_{pix}(i,j)=\mathrm{Max}(S_R(i,j),S_G(i,j),S_B(i,j)) \quad \text{[Expression 22]}$$

The in-region maximum transmittance extracting section 401 sets a prescribed pixel region with −P3 to +P4 pixels in the i direction and −Q3 to +Q4 pixels in the j direction (expressed as k=−P3 to +P4 and l=−Q3 to +Q4, respectively) and sets the weight coefficient G(i, j) for each pixel within that region by having each pixel (pixel unit) as a reference point to calculate the region maximum gradation Smax(i, j) with a following formula. Then, the in-region maximum transmittance extracting section 401 transmits it to the second display element image arithmetic operation section 402.

$$S_{max}(i,j)=\mathrm{Max}(S_{pix}(i+k,j+l)*G(k,l)) \quad \text{[Expression 23]}$$

The second display element image arithmetic operation section 402 calculates the gradation S2(*i, j*) to be displayed on the second liquid crystal display element 114 by applying the conversion processing on the region maximum gradation Smax(i, j). The transmittance conversion processing may be any conversion which is a conversion formula that does not reduce region maximum gradation Smax(i, j) shown in Expression 20. For example, the gradation S2(*i, j*) displayed on the second display element is calculated by formula expressed in Expression 21.

$$S_2(i,\ j) = f(S_{max}(i,\ j)) \geqq S_{max}(i,\ j) \quad \text{[Expression 24]}$$

$$S_2(i,\ j) = B + C * S_{max}(i,\ j)) \quad \text{[Expression 25]}$$
$$B = 2N/4$$
$$C = 1 - \frac{B}{2N-1}$$

The second display element image arithmetic operation section 402 transmits the calculated gradation S2(*i, j*) to be displayed on the second liquid crystal display element 114 to the first display element image arithmetic operation section 403 along with the gradation Sx(i, j) of the pixel (pixel unit) located at the same position of the screen. With following formulae, the first display element image arithmetic operation section 403 calculates the gradation S1*x*(i, j) displayed on the first display element for displaying the image to be displayed on the first liquid crystal display element 113 in such a manner that the relative gradation is not changed from that of the image signal inputted from the video source section 117.

$$\text{WHEN } S_2(i,\ j) = 0,\ S_{1x}(i,\ j) = 0 \quad \text{[Expression 26]}$$
$$\text{WHEN } S_2(i,\ j) \neq 0,$$
$$S_{1x}(i,\ j) = \frac{S_x(i,\ j)}{(S_2(i,\ j)/(2N-1))}$$

The first display element image arithmetic operation section 403 inputs the calculated gradation value S1*x*(i, j) displayed on the first liquid crystal display element 113 to the first liquid crystal display element 113 via the following transmission path 121. The second display element image arithmetic operation section 402 inputs the calculated gradation value S2(*i, j*) displayed on the second liquid crystal display element 114 to the second liquid crystal display element 114 via the following transmission path 122. With this structure, it is not necessary to execute the processing for converting the gradation to the relative transmittance and the processing for converting the relative transmittance to the gradation. Therefore, the scale of processing can be decreased.

Figure 14:
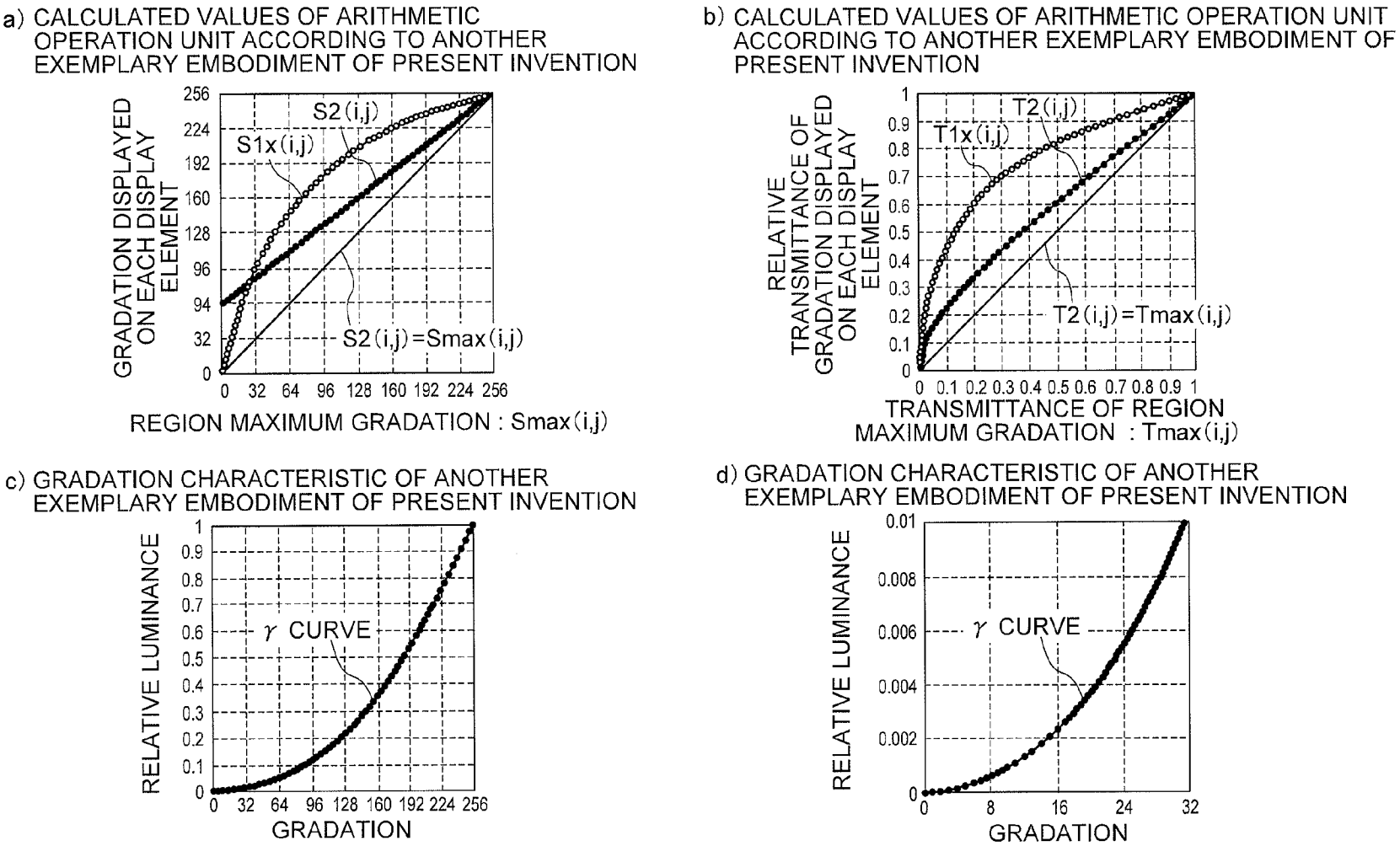

FIG. 14 are graphs of other examples regarding calculated values and the calculated gradation characteristics which do not belong to the condition of the exemplary embodiment obtained by the arithmetic operation unit 118 shown in FIG. 4. FIG. 14A shows the gradations S1 and S2 to be displayed on the first and second liquid crystal display elements 113 and 114 with respect to the region maximum gradation Smax(i, j). FIG. 14B shows the relative transmittances T1 and T2 to be displayed on the first and second liquid crystal display elements 113 and 114 with respect to the region maximum relative transmittance Tmax(i, j). FIG. 14C shows the relative luminance with respect to the gradation characteristic, and FIG. 14D shows the enlarged low gradation part of FIG. 14C.

As shown in FIG. 14A, the relative gradation S2(*i, j*) displayed on the second display element and the relative gradation S1*x*(i, j) displayed on the first liquid crystal display element become discontinuous. However, each of the transmittances displayed on each of the display elements changes continuously as in FIG. 14B, so that the gradation characteristic of the liquid crystal display system becomes equivalent to that of the video signal inputted from the video source section, as shown in FIG. 14C and FIG. 14D. Therefore, this can be also considered a preferable exemplary embodiment of the invention.

In this case, when gradation value of the video signal inputted from the video source section 117 is Sx and the gradation value displayed on the second liquid crystal display element 114 is S2, "S2≧Sx" applies in each dot, regardless of the displays that may be formed with the video signals inputted from the video source section 117.

Further, for example, in a case where the video signals inputted from the video source section 117 form a display structured with bright dots on a dark background, "S2≧Sx'" applies in a group of the bright dots or at least in a group of dots neighboring to the bright dots, provided that the gradation value of the display structured with the bright dots of the video signals inputted from the video source section 117 is Sx' and the gradation value displayed on the second liquid crystal display element 114 is S2.

Figure 15:
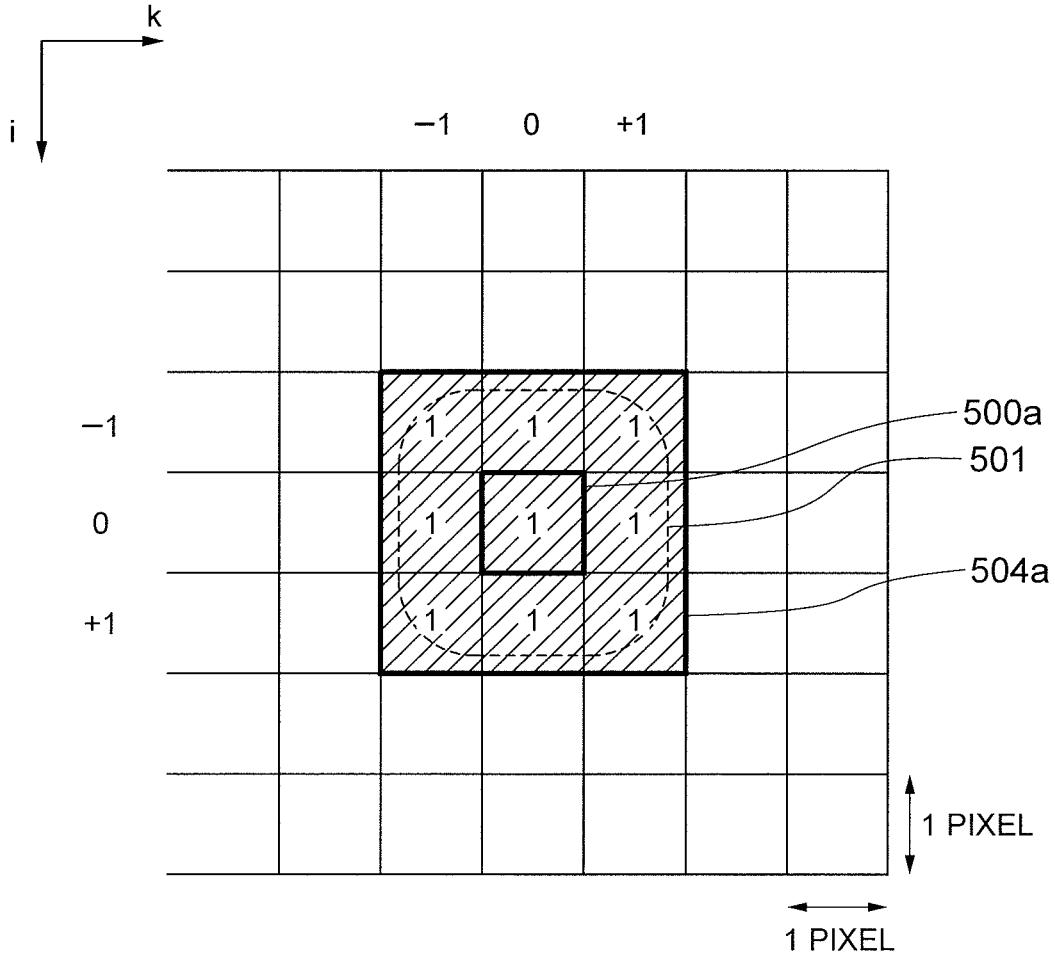
FIG. 15 is a graph showing an example of region averaging processing according to a related technique (Patent Document 2, for example)

Next, the region maximum value extraction processing according to this exemplary embodiment and the region averaging processing according to the technique depicted in Patent Document 2 or the like will be described. First, the region averaging processing of the technique of Patent Documents will be described. FIG. 15 shows a graph of a case of the region averaging processing according to the technique depicted in Patent Document 2 and the like. The pixel region including the region 501 that is shifted by the position shift amount r from the outer periphery of the pixel 500*a* as the reference point of the averaging processing is defined as a pixel region 504. Assuming that weight coefficient G' (k, l) within the prescribed pixel region 504 is 1, the average transmittance Tave(i, j) within the region is calculated with a following formula. Note that M and N indicate the number of display dots of the entire image display device 100. The maximum value of i is M, and the maximum value of j is N.

$$G'(k,\ 1) = \begin{Bmatrix} 1 & 1 & 1 \\ 1 & 1 & 1 \\ 1 & 1 & 1 \end{Bmatrix} \quad \text{[Expression 27]}$$

$$T_{ave}(i,\ j) = \frac{1}{(2M+1)(2N+1)} \times \sum_{k=-M}^{M} \sum_{K=-N}^{N} \{f(i+k,\ j+1) \times G'(k,\ 1)\} \quad \text{[Expression 28]}$$

Figure 16:
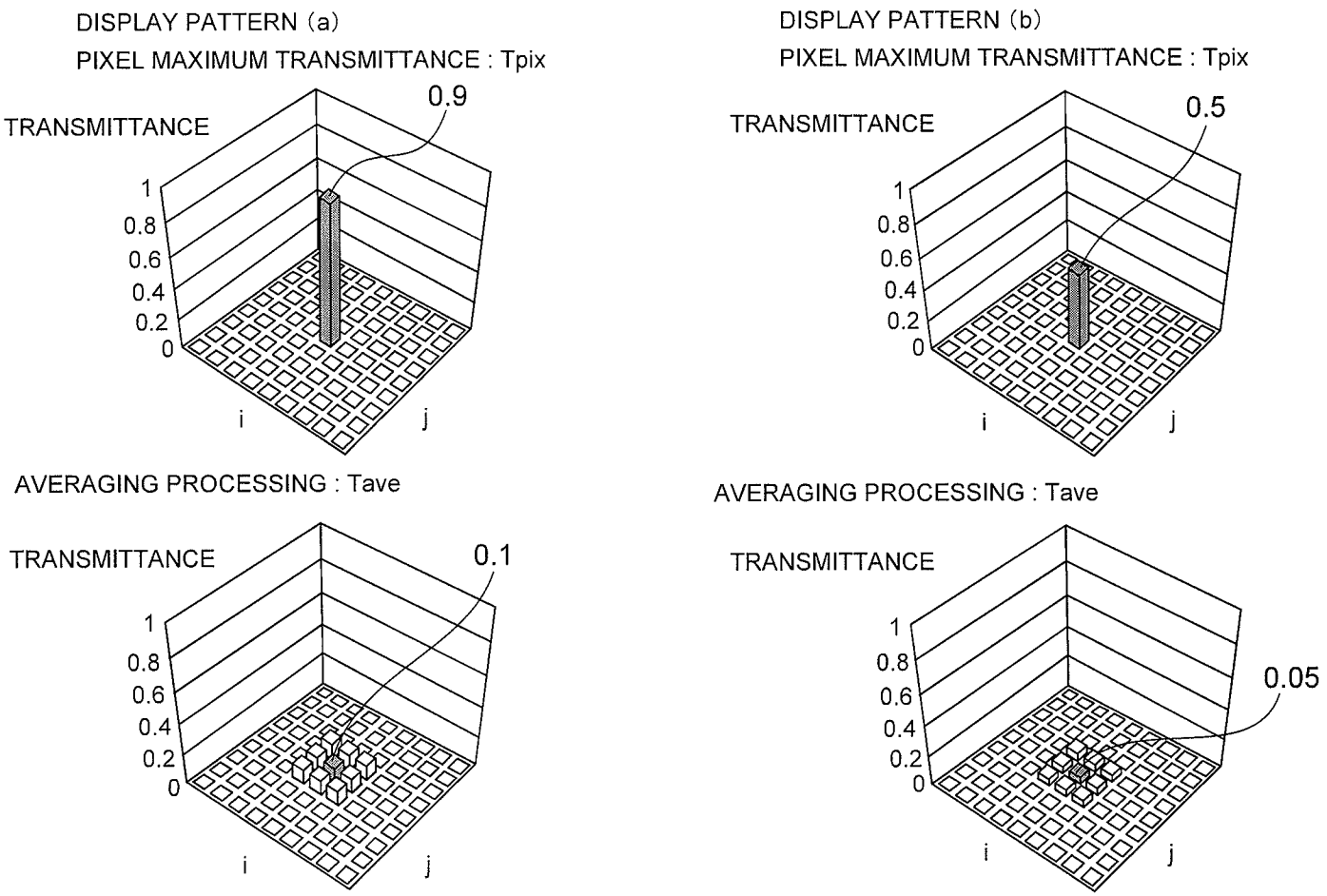
Figure 17:
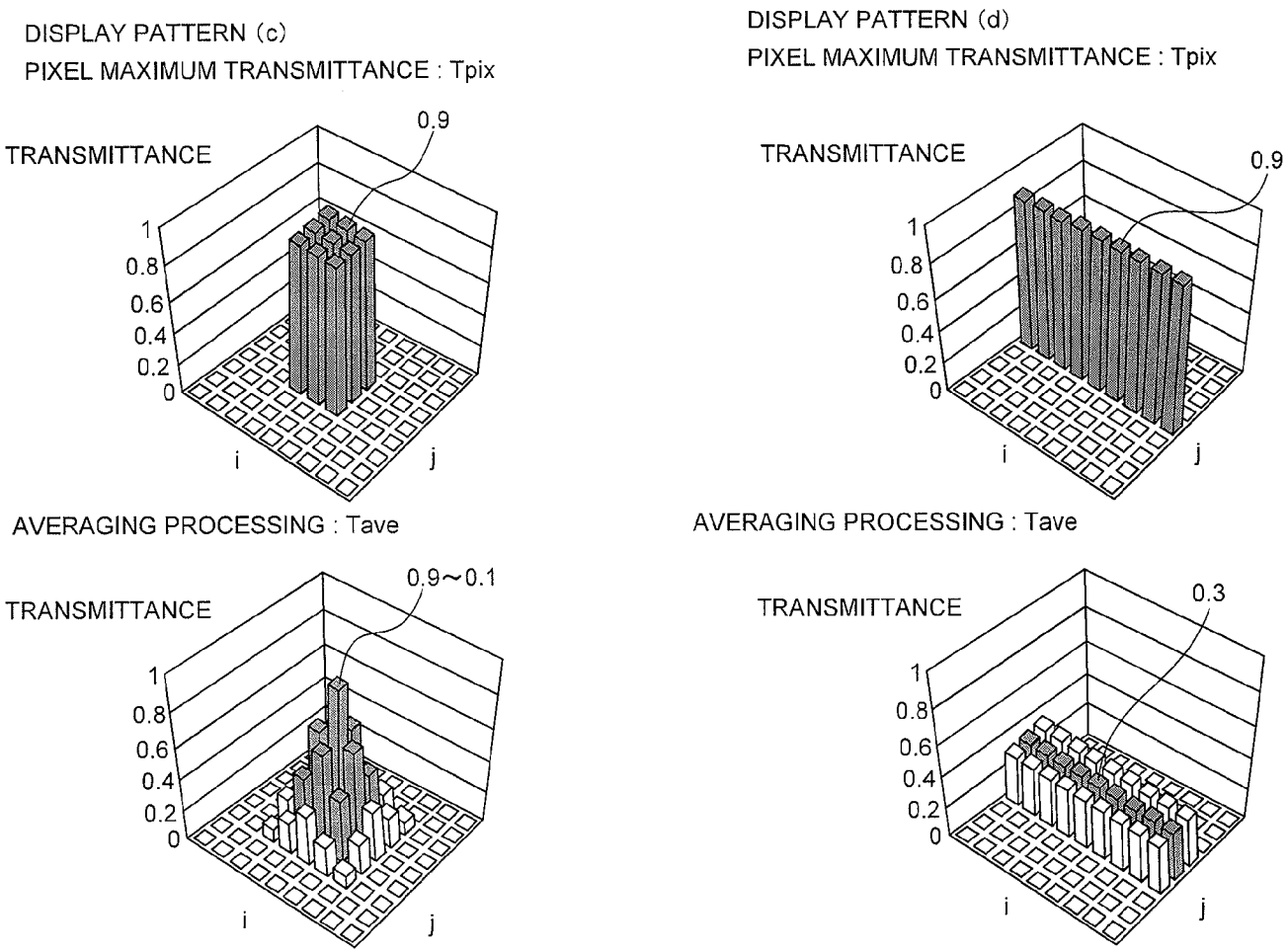
Figure 18:
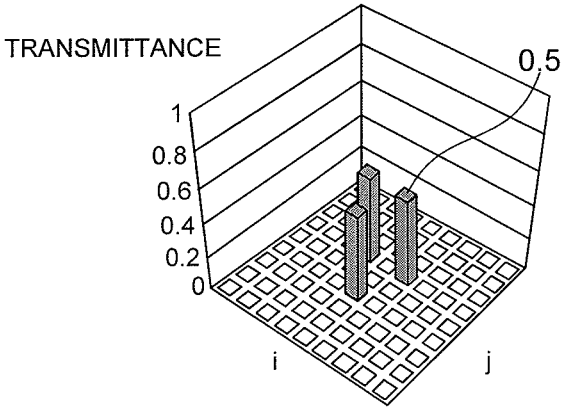
Figure 18:
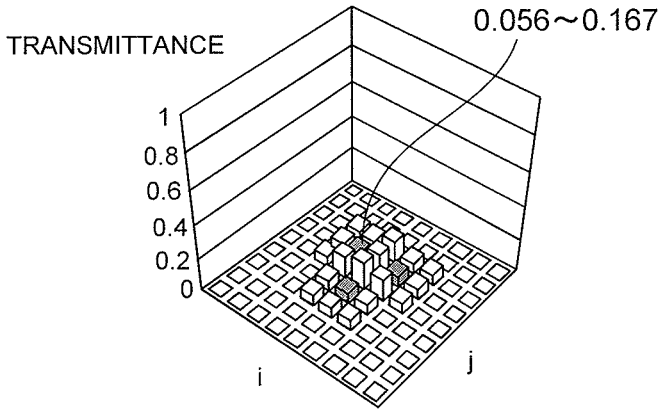

FIG. 16-FIG. 18 are graphs showing the examples of the averaging processing of the region shown in FIG. 15. FIG. 16A shows the pixel maximum transmittance of the video signal inputted from the video source section and the region maximum transmittance Tmax(i, j) in a case where the relative transmittance of the video signal inputted from the video source section is 0.9 and the video signal is a dot in a size of 1 pixel or less, FIG. 16B shows a case where the relative transmittance of the video signal inputted from the video source section is 0.5 and the video signal is a dot in a size of 1 pixel or less, FIG. 17C shows a case where the relative transmittance of the video signal inputted from the video source section is 0.9 and the video signal is a dot in a size of 3 pixels or less, FIG. 17D shows a case where the relative transmittance of the video signal inputted from the video source section is 0.9 and the video signal is a straight line in a width of 1 pixel or less, and FIG. 18E shows a case where the relative transmittance of the video signal inputted from the video source section is 0.5 and the video signal is a set of dots in a size of 1 pixel or less.

As shown in FIG. 16-FIG. 18, with the region averaging processing, the relative transmittance is attenuated than that of the video signal inputted from the video source section when the inputted image signals are of a display pattern with a high spatial frequency. Furthermore, it is the processing with which the way of spreading from the bright region changes depending on the display pattern of the video signals inputted from the video source section, and the transmittance distribution becomes shifted even within the prescribed pixel region 504.

Figure 19:
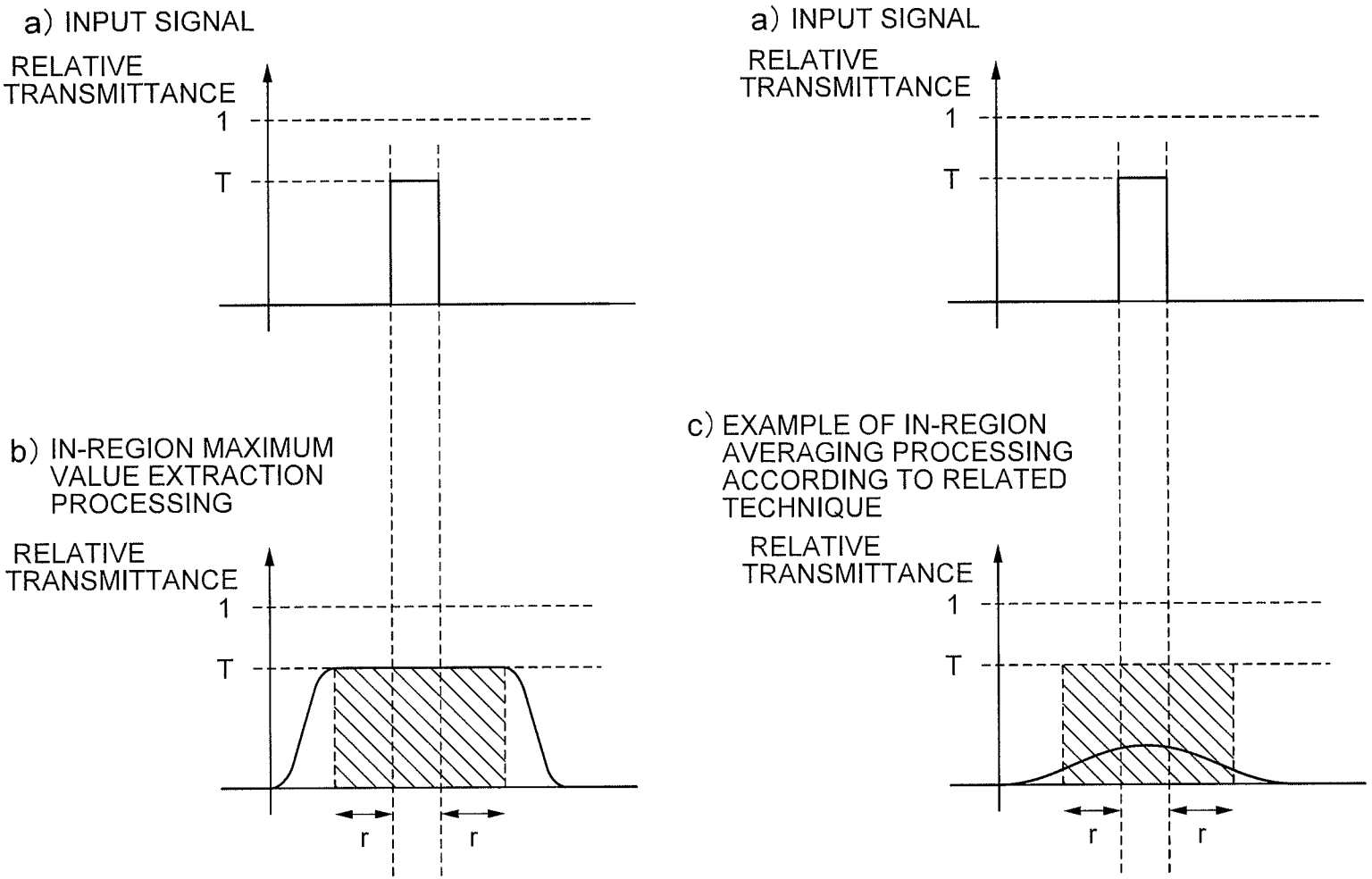

FIG. 19 shows graphs showing the inputted image signals and the distributions of the outputted relative transmittances regarding the region maximum value extraction processing according to the exemplary embodiment and the region averaging processing according to the related technique, respectively. FIG. 19A shows the inputted signals, FIG. 19B shows the relative transmittance outputted with the maximum value extraction processing according to the exemplary embodiment, and FIG. 19C shows the relative transmittance outputted with the region averaging processing according to the related technique.

With the maximum value extraction processing according to the exemplary embodiment, the relative transmittance of the image signals inputted to all the pixels is not attenuated regardless of the relative transmittance the inputted image signals may have, thereby providing flat relative transmittance distribution in the pixel region including the region of the position shift amount r. Further, the maximum extraction processing according to the exemplary embodiment is the processing which spatially expands the bright region of the display pattern to the prescribed pixel region 503 from the outer periphery thereof and in the region width defined by the weight coefficient G(k, l), even if the inputted image signals are of the display pattern with a high spatial frequency.

The averaging processing according to the related technique is the processing with which the relative transmittance is attenuated than that of the video signals inputted from the video source section when the inputted image signals are of a display pattern with a high spatial frequency. Furthermore, it is the processing with which the way of spreading from the bright region changes depending on the display pattern of the image signals inputted, and the transmittance distribution becomes shifted even within the prescribed pixel region 504.

When the transmittance distribution calculated by the region averaging processing according to the related technique is used directly to the relative transmittance T2(*i, j*) of the second liquid crystal display element, a condition of T2(*i, j*)<Tmax(i, j) applies as in the case shown in FIG. 13A. In a case where the display pattern of the inputted image signals is a bright display, a value larger than 1 is calculated for the relative transmittance T1*x*(i, j) to be displayed on the first liquid crystal display element. The value comes to a limit at 1 that is the maximum transmittance of the liquid crystal element, so that the luminance of the liquid crystal display system becomes attenuated thereby.

Figure 20:
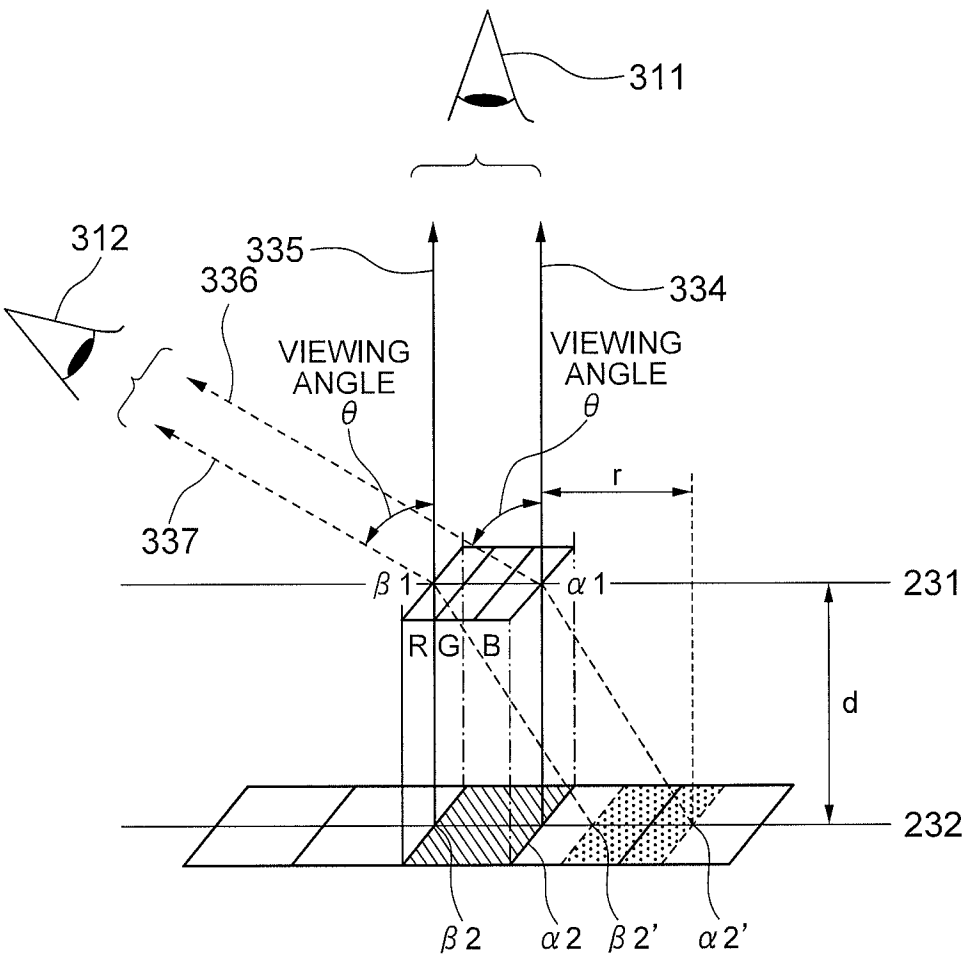
FIG. 20 is an explanatory illustration showing a fragmentary sectional view of the main part of the liquid crystal display unit 116 shown in FIG. 3.

Next, changes in the display in the oblique visual field at angle θ caused due to the difference in the transmittance distribution will be described. FIG. 20 is an explanatory illustration showing a fragmentary sectional view of the main part of the liquid crystal display unit 116 shown in FIG. 3. In this illustration, liquid crystal layers 231 and 232 of the first and second liquid crystal display elements 113 and 114 are extracted and illustrated. The liquid crystal layer 231 on the viewer side is taken as the first liquid crystal display element 113 in which one pixel is formed with three pixels of RGB, and the other liquid crystal layer 232 is taken as the second liquid crystal display element 114 in which one pixel (pixel unit) is formed with a single colorless (white) dot. Lines of eyesight 334 and 335 are the lines when viewed from the viewing point 311 in the perpendicular direction, and lines of eyesight 336 and 337 are lines when viewed from the viewing point 312 in the oblique direction.

As shown in FIG. 20, the display viewed at the viewing point 311 in the perpendicular direction is the transmission light from the positions α2 and β2 of the second liquid crystal display element 114, while the display viewed at the viewing point 312 in the oblique visual field at angle θ is the transmission light from the positions α2' and β2' of the second liquid crystal display element 114 shifted by the position shift amount r, respectively.

Therefore, when the relative transmittance of the region of α2' and β2' becomes attenuated with respect to that of the region of α2 and β2 of the second liquid crystal display element 114, the luminance of the display becomes deteriorated depending on the viewing angle.

Furthermore, in the first liquid crystal display element 113, 1-pixel region is divided into different color regions. Thus, when there is a difference in the transmittance distributions in the region of α2' and β2' with respect to the region of α2 and β2 of the second liquid crystal display element 114, the color balance of the display changes depending on the viewing direction. This results in generating changes in chromaticity.

Figure 21:
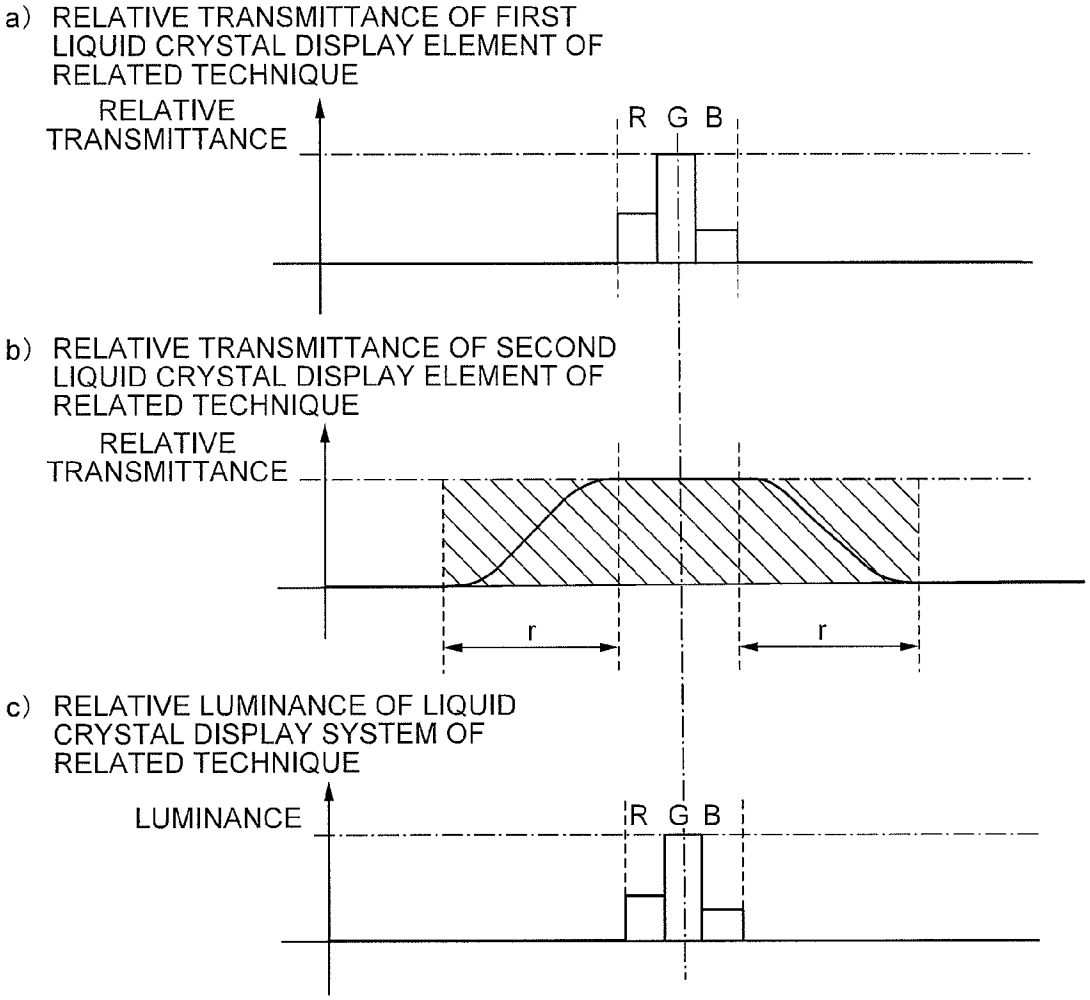
Figure 22:
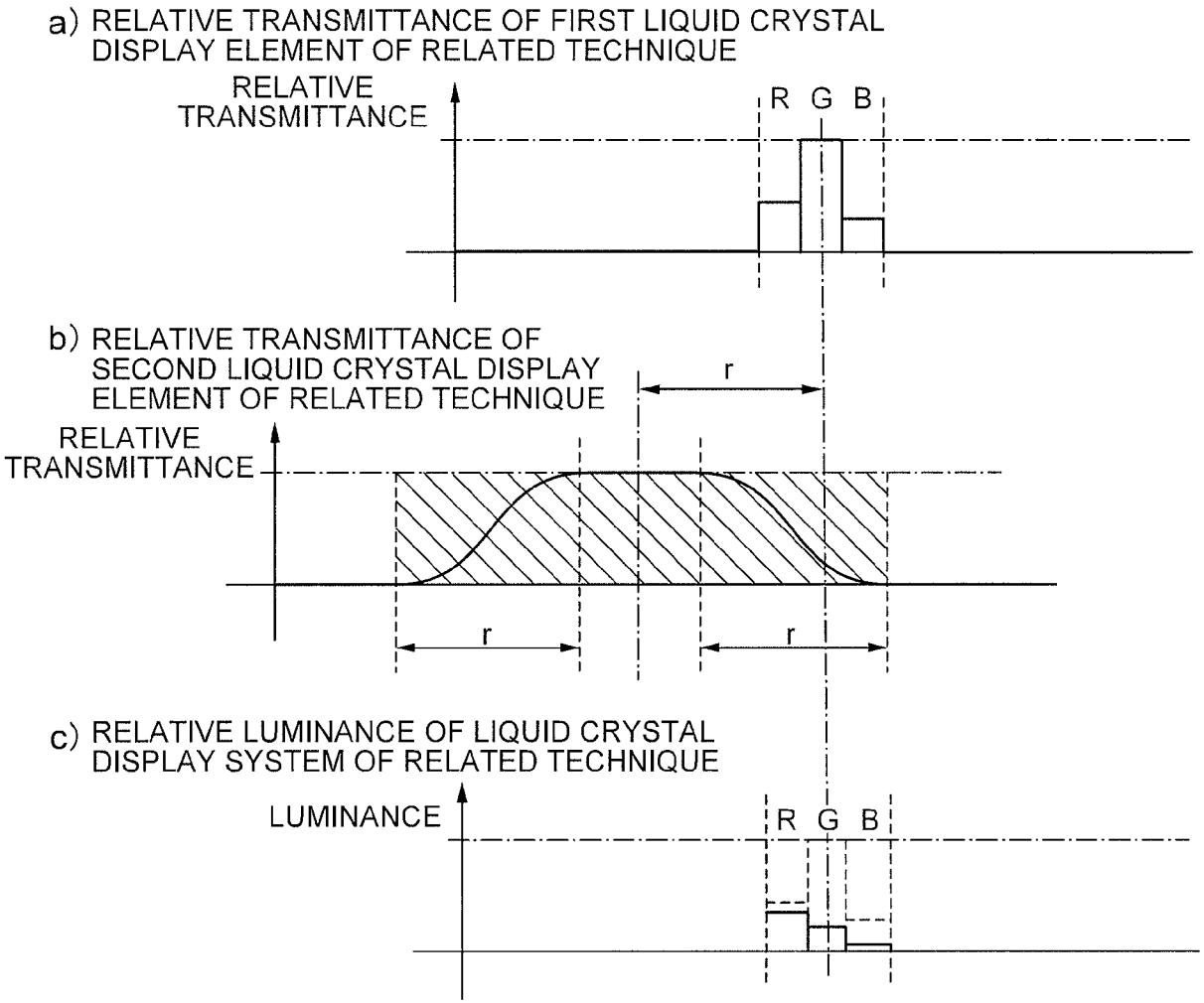

FIG. 21-FIG. 22 are explanatory charts showing the chromaticity changes in the display on the liquid crystal display device depending on the viewing direction, which are of the averaging processing according to the related technique. FIGS. 21A-21C show the charts regarding the display recognized at the viewing point 311 from the front side, in which FIG. 21A shows the relative transmittance distribution of the first liquid crystal display element, FIG. 21B shows the relative transmittance distribution of the second liquid crystal display element, and FIG. 21C shows the luminance distribution of the liquid crystal display device, and each chart is illustrated in such a manner that the transmittances of the same eyesight line overlap with each other in the longitudinal direction on the paper face.

Meanwhile, FIGS. 22A-22C show the charts regarding the display recognized at the viewing point 312 from the oblique direction. FIG. 22A shows the relative transmittance distribution of the first liquid crystal display element, FIG. 22B shows the relative transmittance distribution of the second liquid crystal display element, and FIG. 22C shows the luminance distribution of the liquid crystal display device. In FIG. 22B, the distribution is shifted laterally by the position shift amount r from that of FIG. 21B because the display is observed obliquely, so that the transmittances of the same eyesight line overlap with each other in the longitudinal direction on the paper face.

As shown in FIG. 21B and FIG. 22B, the relative transmittance of the second liquid crystal display element based on the averaging processing according to the related technique comes to have the distribution where the relative transmittance has a slope within a range of the position shift amount r that is of the shift when the display is observed obliquely with respect to the bright region of the second liquid crystal display element. As a result, as shown in FIG. 21C and FIG. 22C, luminance changes and chromaticity changes occur in the display depending on the viewing direction.

Figure 23:
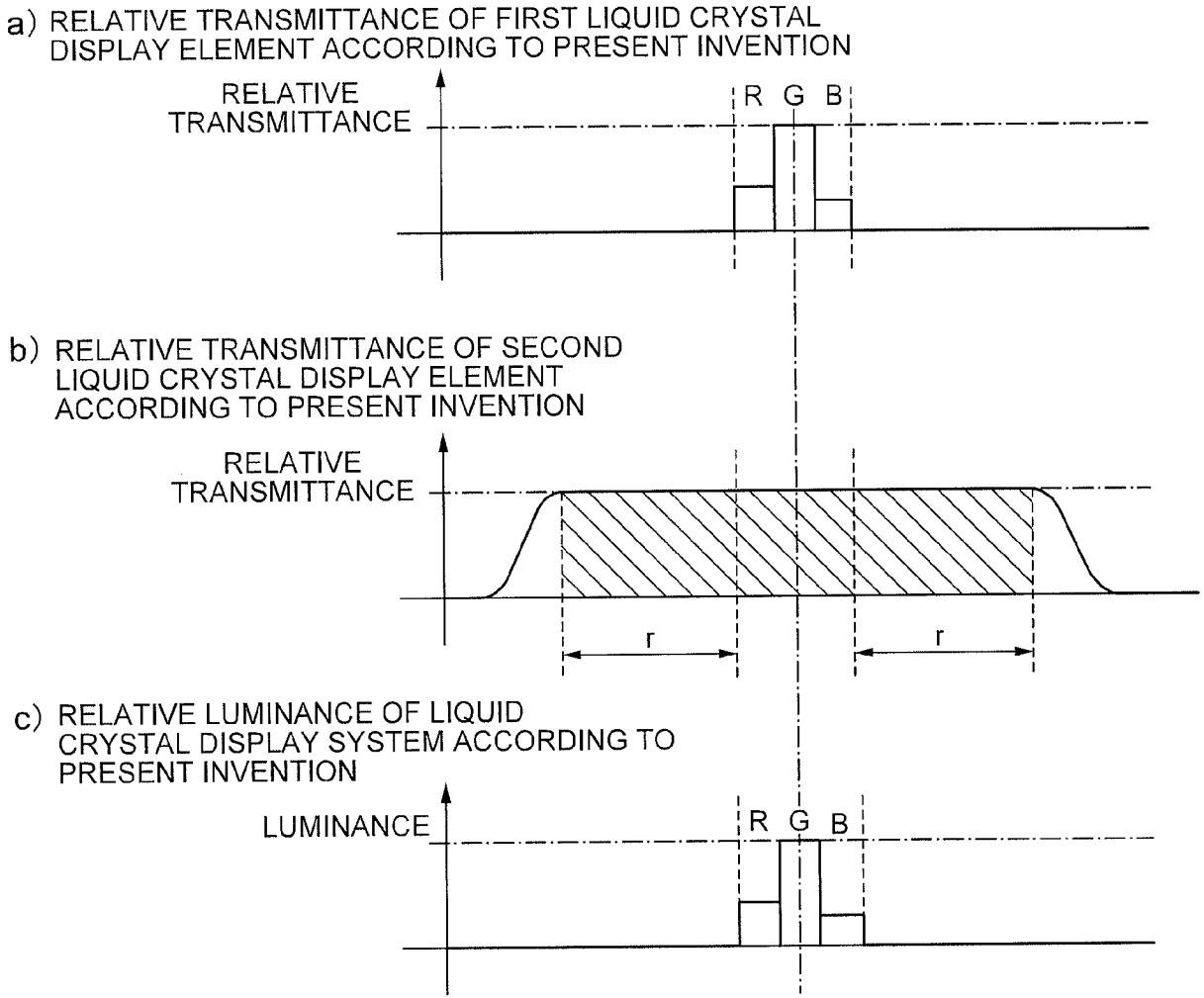
Figure 24:
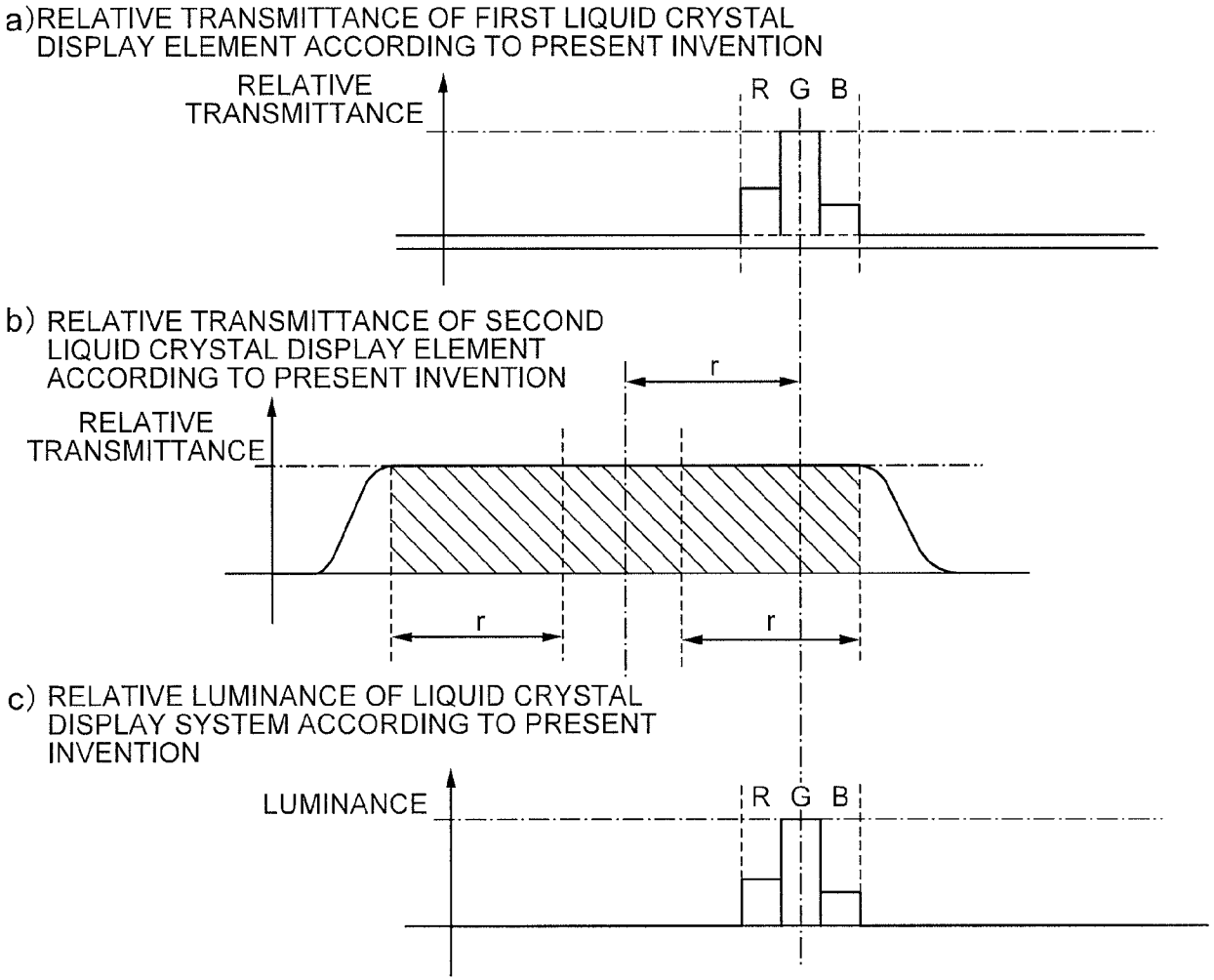

In the meantime, FIG. 23-FIG. 24 are explanatory charts showing the chromaticity changes in the display on the liquid crystal display device depending on the viewing direction, which are of the maximum value extraction processing according to the exemplary embodiment. FIGS. 23A-23C show the charts regarding the display recognized at the viewing point 311 from the front, in which FIG. 23A shows the relative transmittance distribution of the first liquid crystal display element 113, FIG. 23B shows the relative transmittance distribution of the second liquid crystal display element 114, and FIG. 23C shows the luminance distribution of the liquid crystal display device, and each chart is illustrated in such a manner that the transmittances of the same eyesight line overlap with each other in the longitudinal direction on the paper face.

Meanwhile, FIGS. 24A-24C show the charts regarding the display recognized at the viewing point 312 from the oblique direction. FIG. 24A shows the relative transmittance distribution of the first liquid crystal display element 113, FIG. 24B shows the relative transmittance distribution of the second liquid crystal display element 114, and FIG. 24C shows the luminance distribution of the liquid crystal display device. In FIG. 24B, the distribution is shifted laterally by the position shift amount r from that of FIG. 23B because the display is observed obliquely, so that the transmittances of the same eyesight line overlap with each other in the longitudinal direction on the paper face.

As shown in FIG. 23B and FIG. 24B, the relative transmittance of the second liquid crystal display element based on the maximum value extraction processing of the present invention comes to have the flat distribution within a range of the position shift amount r that is of the shift when the display is observed obliquely with respect to the bright region of the second liquid crystal display element 114. As a result, as shown in FIG. 23C and FIG. 24C, luminance changes and chromaticity changes do not occur in the display depending on the viewing direction.

As described above, the maximum value extraction processing according to the exemplary embodiment is the processing (bright region expanding processing) which expands the bright region of the display pattern of the video signals inputted from the video source section to a prescribed region width. Through employing the value determined in advance by considering the viewing direction for the prescribed region width, luminance deteriorations and chromaticity changes depending on the viewing direction can be suppressed regardless of the display pattern of the video signals inputted from the video source section.

In order to investigate the effects of the exemplary embodiment, the signals having the above-described image processing executed thereon were inputted to each of the first liquid crystal display element 113 and the second liquid crystal display element 114 of the image display device 100 to display images. As a result, for the contrast, a high contrast ratio of 500000:1 was obtained.

Further, it was possible to suppress the luminance deterioration and the chromaticity changes also in the video displays with sharp luminance changes, such as a text display and a fine pattern display. Even when the viewer moved the visual field physically, it was possible to obtain a display that is as accurate as the case where the normal image signals are displayed only on the first liquid crystal display element 113.

The liquid crystal display device of the exemplary embodiment can achieve a high contrast ratio. At the same time, the liquid crystal display device of the exemplary embodiment makes it possible to suppress luminance deteriorations and chromaticity changes generated depending on the viewing direction, regardless of the display pattern of the video signals inputted from the video source section.

Next, the overall operations of the first exemplary embodiment will be described. A driving method of the liquid crystal display device according to the present invention uses, as the liquid crystal display unit, a single first liquid crystal display element and a single or a plurality of second liquid crystal display element(s) stacked on one another for displaying an image. For each pixel unit of the second liquid crystal display element, the method, by having each pixel unit of the video signal inputted from the video source as a reference point, extracts a maximum value of the relative gradations or a maximum value of the relative transmittances among a group of pixel units including the pixel units taken as the reference points and a region including the pixel units neighboring to the pixel units taken as the reference points, and outputs the signal based on the maximum value of the relative gradations or the relative transmittances to the liquid crystal display unit.

At that time, when the video signal inputted from the video source is of a display with bright-color pixel units in a dark background, for each pixel unit of the second liquid crystal display element, the processing for outputting the signal to the liquid crystal display unit outputs to the liquid crystal display unit the drive signal for displaying synthesized relative gradation S2 or the synthesized relative transmittance S2 that satisfies S2≧S in a pixel unit group including the bright-color dots and dots neighboring to one of those dots, provided that relative gradation or the relative transmittance of the display with the bright-color pixel units based on the video signal inputted from the video source section is S, and the synthesized relative gradation or the synthesized relative transmittance displayed on the second liquid crystal display elements is S2.

Further, for each pixel unit of the second liquid crystal display element, the processing for outputting the signal to the liquid crystal display unit outputs to the liquid crystal display unit the signal to display synthesized relative gradation S2 or the synthesized relative transmittance S2 to satisfy S2≧Smax on the second liquid crystal display, provided that the region maximum relative gradation or the region maximum relative transmittance extracted from the video signal is Smax, and the synthesized relative gradation or the synthesized relative transmittance displayed on the second liquid crystal display element is S2.

In the meantime, for each pixel unit of the first liquid crystal display element, the processing for outputting the signal to the liquid crystal display unit outputs the signal with which relative gradation S1 or the relative transmittance S1 which satisfies S=0 when S2=0 and satisfies S1=S/S2 when S2≠0, provided that the relative gradation or the relative transmittance of the video signal inputted from the video source section is S and the relative gradation or the relative transmittance displayed on the second liquid crystal display element is S2.

With the related technique, distribution of the panel transmittance becomes moderate by applying the averaging means on the video signals inputted from the video source section with the video display with sharp luminance changes, such as a text display and a fine pattern display, so that luminance deteriorations and chromaticity changes may occur depending on the viewing direction. In the meantime, the exemplary embodiment is structured to display the images by executing the processing on each dot of the video signals inputted from the video source section for extracting the maximum relative transmittance among the reference dot and a group of the dots in a prescribed region neighboring to the reference dots by having each dot as the reference point.

Therefore, the exemplary embodiment sets the prescribed region to the width that is equal to or larger than the parallax of the stacked panels when the prescribed region is observed from the oblique visual field. Thus, the distribution of the relative transmittance of the second liquid crystal display element can expand the bright part of the display to be equal to or larger than the prescribed region width even in the video display with a sharp luminance change, such as a text display and a fine pattern display. Therefore, the exemplary embodiment exhibits such an effect of overcoming the luminance deteriorations and chromaticity changes which may otherwise occur depending on the viewing directions.

Therefore, the exemplary embodiment exhibits a great effect when it is used in a field where no high contrast images are required and no display change of the video signals inputted from the video source section is allowed, e.g., when used as a video display unit of a diagnostic imaging device, a monitor used in a broadcast station, an image display unit of an electronic device used at a place where videos are provided in a dark place such as a movie theater for showing movies.

Modification Example of First Exemplary Embodiment

The first exemplary embodiment described above is not necessarily limited to the form described above. Various changes and modifications are possible without departing from the scope and the spirit of the present invention.

Figure 33:
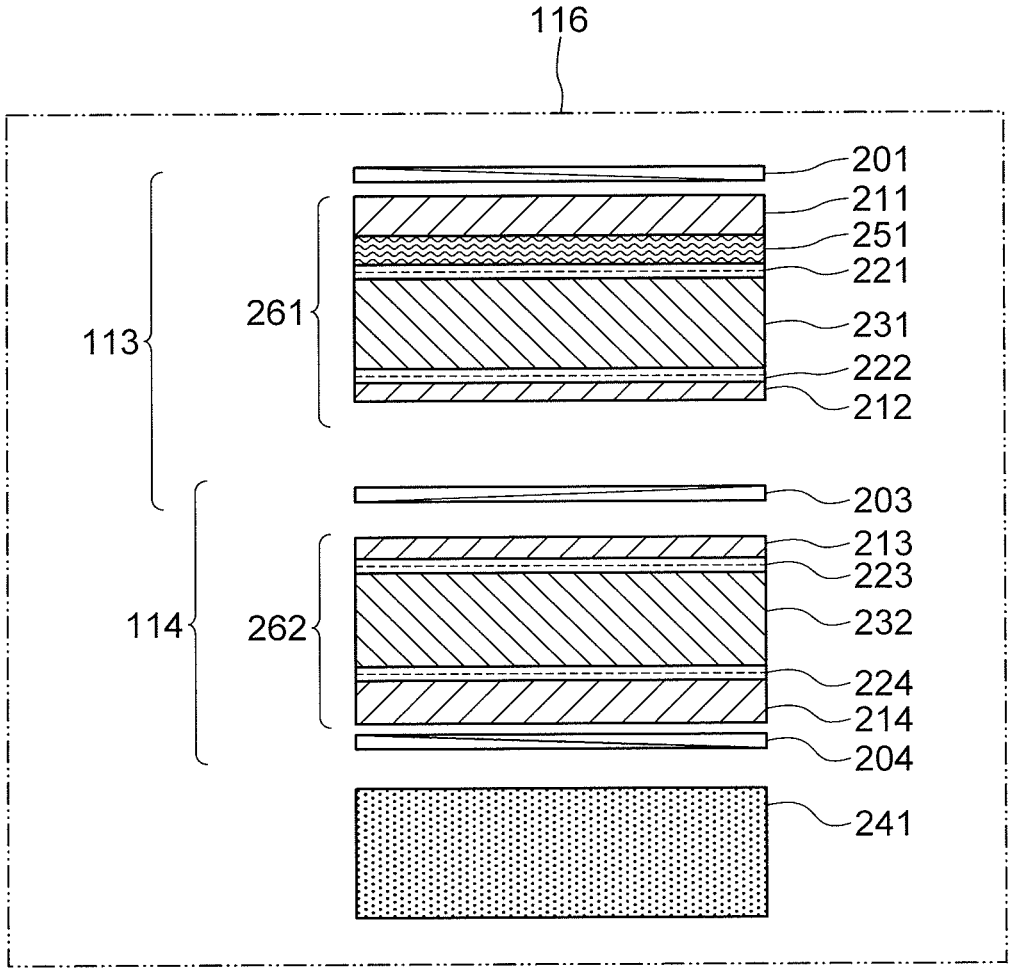
FIG. 33 is an explanatory illustration showing a modification of the first exemplary embodiment, in which the transparent substrate sandwiched between the liquid crystal layers is formed thinner than the liquid crystal layers of the liquid crystal display elements and the transparent substrates sandwiching the liquid crystal layers of the liquid crystal display elements from the outer side.

For example, neither the first liquid crystal element nor the second liquid crystal display element may have a color filter. Further, as shown in FIG. 33, the transparent substrates 212, 213 sandwiching the liquid crystal layers 231, 232 from the inner side may be formed thinner than the transparent substrates 211, 214 sandwiching the liquid crystal layers 231, 232 of the stacked liquid crystal display elements 113, 114 from the outer side. Various kinds of other modifications of the exemplary embodiment are also possible. Such modifications will be described in more details hereinafter.

Figure 25:
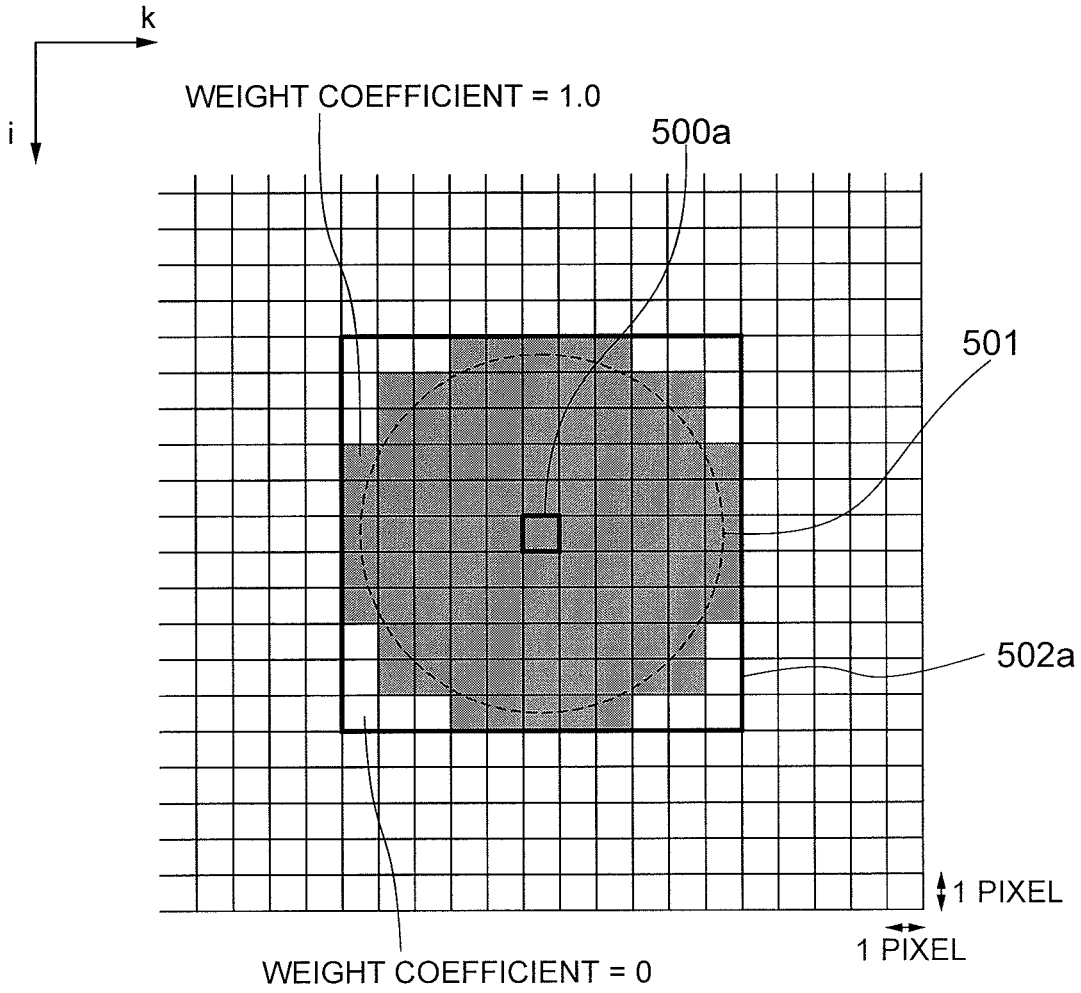
FIG. 25 is an explanatory illustration showing a modification example of the first exemplary embodiment, in which size of a pattern is changed appropriately in accordance with position shift amount r estimated according to the supposed view angle direction.
Figure 26:
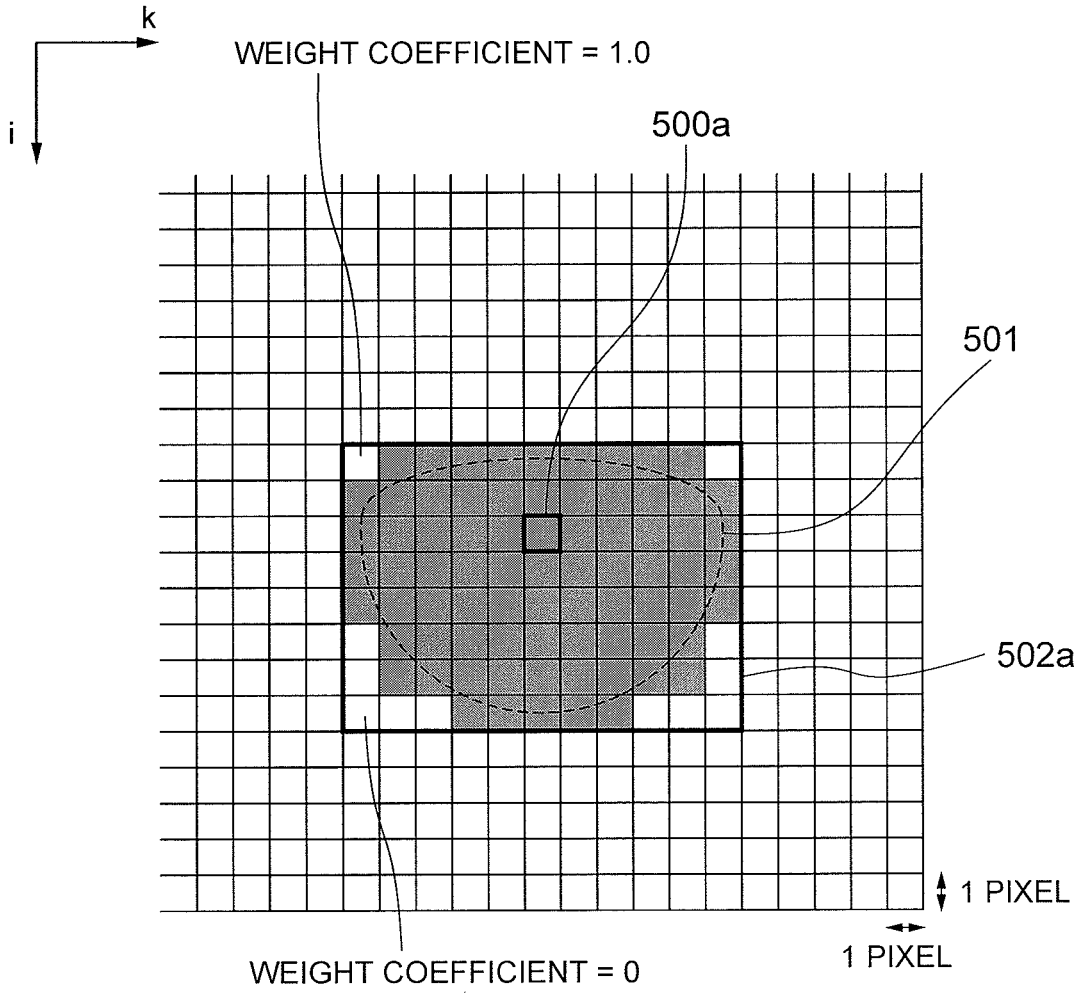
FIG. 26 is an explanatory illustration showing a modification example of the first exemplary embodiment, in which the pattern with the position shift amount r is formed as a non-uniform shape accordingly when the supposed viewing directions vary in the vertical direction.

The prescribed region that is set by having each dot as the reference point and the weight coefficient are not limited to those described above. As shown in FIG. 25, the size of the region 502 including the pixels neighboring to the reference pixel 500*a* may be changed in accordance with the position shift amount r with respect to the reference pixel 500*a* estimated according to the supposed view angle direction. In FIG. 25, the weight coefficient of the white part is 0, and the weight coefficient of the gray part is 1. In FIG. 25, reference numeral 501 is a region that is shifted from the reference pixel 500*a* by the position shift amount r. As shown in FIG. 25, it is also possible to change the pattern of the region 501 with the position shift amount r. Further, as shown in FIG. 26, when the supposed viewing directions vary in the vertical direction, the pattern of the region 501 shifted from the reference pixel 500*a* by the position shift amount r may be formed as a non-uniform shape within the pixel region 502 including the position shift amount r accordingly. In FIG. 26, the weight coefficient of the white part is 0, and the weight coefficient of the gray part is 1.

Figure 27:
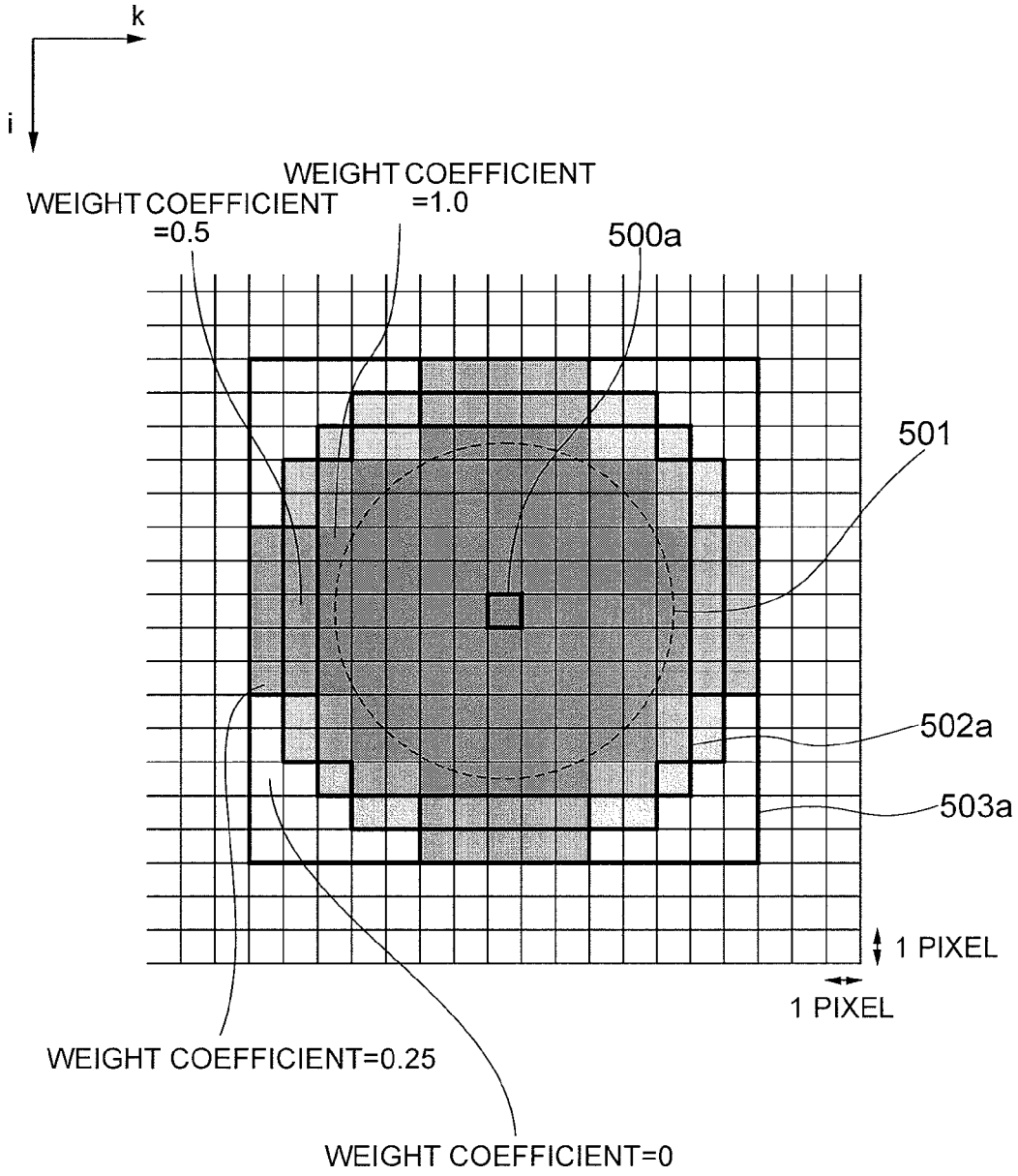
FIG. 27 is an explanatory illustration showing a modification example of the first exemplary embodiment, in which the regions with different weight coefficients are defined in four stages.
Figure 28:
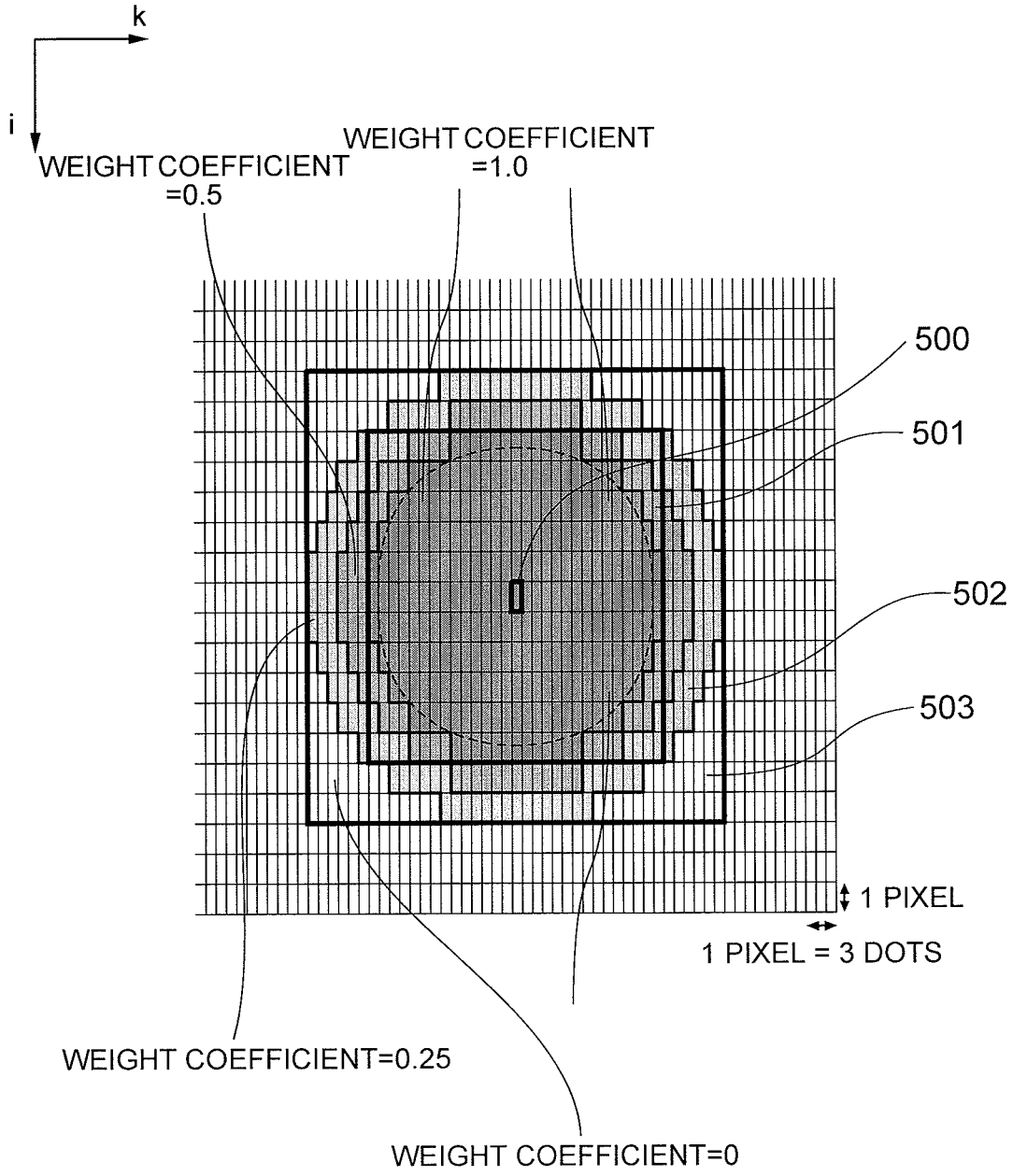
FIG. 28 is an explanatory illustration showing a modification example of the first exemplary embodiment, which directly calculates the region maximum relative transmittance Tmax(i, j) by a dot unit with a prescribed dot region of a dot unit in the second liquid crystal display element in a unit of the size of the dot of the first liquid crystal display element.

Further, as shown in FIG. 27, regarding the prescribed pixel region 503 and the pixel region 502 including the position shift amount r, the regions may be defined in four stages with different coefficients such as the regions with the coefficients 1.0, 0.5, 0.25, and 0. Furthermore, if the dots handled by the second display element image arithmetic operation section 402 and the dots handled by the first display element image arithmetic operation section 403 are in a same size, the maximum relative transmittance Tpix(i, j) in the pixel unit may not have to be calculated. In a case where one pixel is formed with three dots as in FIG. 28, the region maximum relative transmittance Tmax(i, j) in the dot unit may be calculated directly from the prescribed pixel region 503 in the dot unit of the second liquid crystal display element 114 with the dot unit of the first liquid crystal display element 113 as in FIG. 28. In FIG. 28, reference numeral 500 is a reference dot, 501 is a region shifted from the reference dot by the position shift amount r, and 502 is a dot region including the position shift amount r.

The second display element image arithmetic operation section 402 and the first display element image arithmetic operation section 403 within the arithmetic operation unit 118 are not limited to the structures which execute the conversion processing from the gradation to the relative transmittance and the conversion processing from the relative transmittance to the gradation by the arithmetic operations. For example, those sections may be so structured that inputs and outputs are calculated in advance and stored in a lookup table, and arithmetic operations are conducted by using the lookup table.

Figure 29:
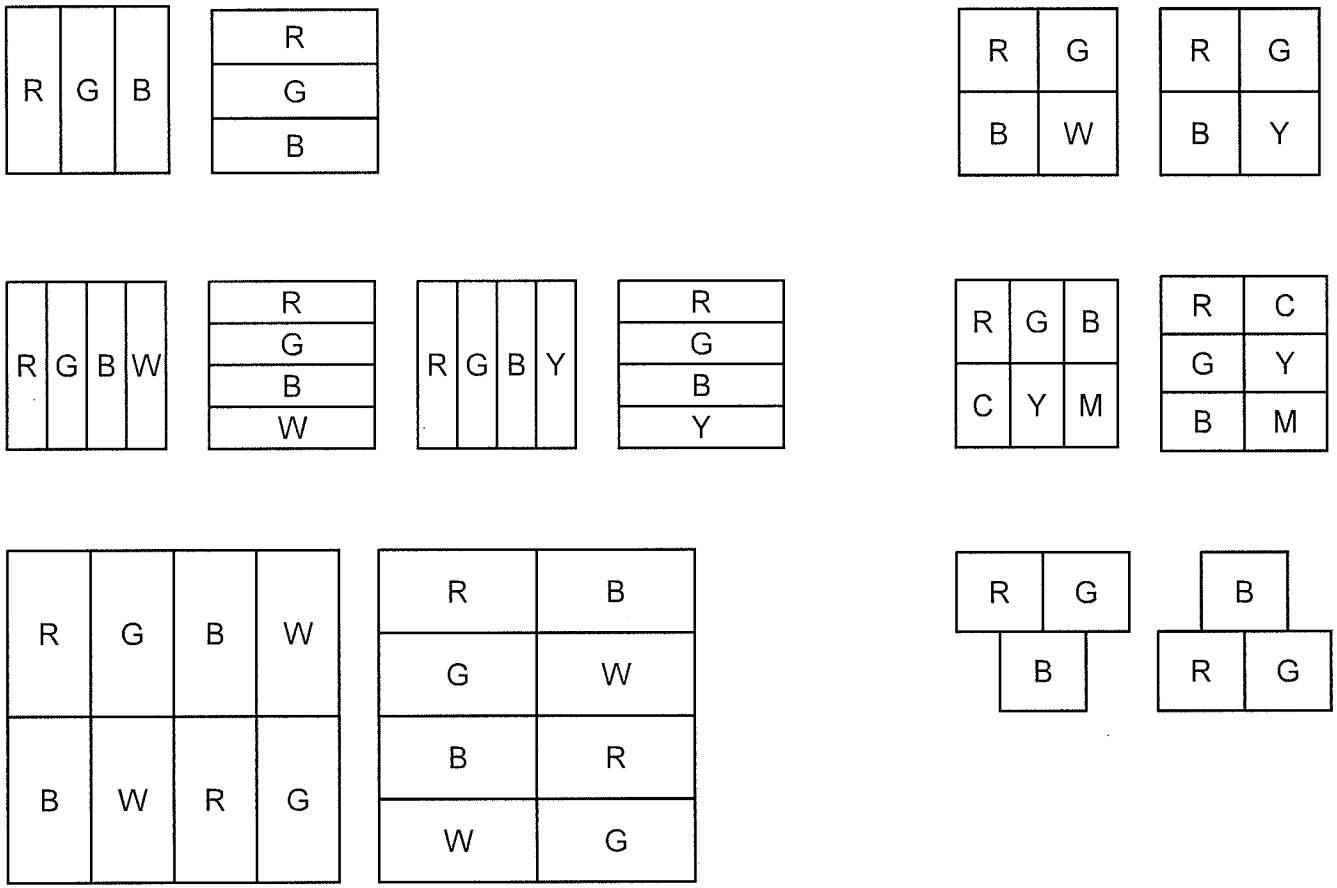
FIG. 29 shows explanatory illustrations of color structures of a first display element image arithmetic operation section other than the structure of RGB colorimetric system.

Further, the format of the image signals to be inputted is not limited to the RGB colorimetric system but may be of any types of signal format such as CMYK colorimetric system, and HSV colorimetric system. Furthermore, while the first liquid crystal display element has been described above by referring to the case where a single pixel is divided into three regions by corresponding to the color filter layer of RGB, it is not limited to the case of three colors of R, G, and B. FIG. 29 shows explanatory illustrations regarding color structures of the first display element arithmetic operation section 403 formed with those other than the RGB colorimetric system. FIG. 29 illustrates modifications of the first exemplary embodiment formed with colors of R, G, B, Y, M, C, colorless region (W), and the like.

Further, a single pixel may be formed with a large number of dots. For example, a single pixel may not have to be divided into three dot regions but may be divided into four dot regions, for example, so as to have each of the regions corresponded to R, G, G, and B. Alternatively, the four regions may be formed with the regions corresponding to each of the colors R, G, B and with a colorless region (W), for example. Also, the dot regions may be formed with a small number of dot regions by executing pseudo high resolution display by using visual sense property of human beings, for example.

Further, the layout of the dots is not limited to the longitudinal stripe layout. The dots may be in a lateral stripe layout, a matrix layout, or a delta layout.

Figure 30:
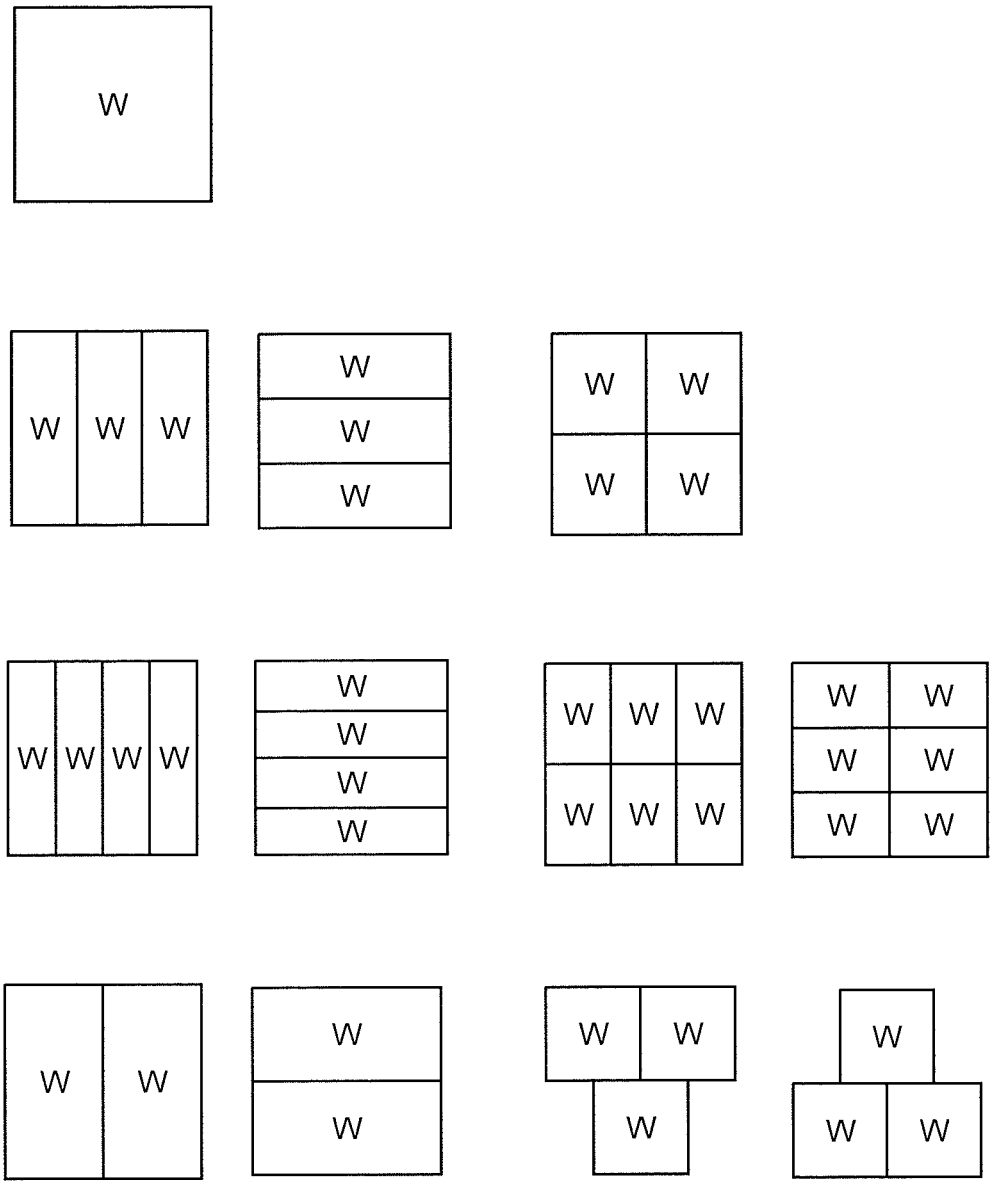
FIG. 30 shows explanatory illustrations of various kinds of modifications of the second liquid crystal display element corresponding to the color structures of the first liquid crystal display element shown in FIG. 29.

FIG. 30 shows explanatory illustrations of various kinds of modifications of the second liquid crystal display element 114 corresponding to the color structures of the first liquid crystal display element 113 shown in FIG. 29. As shown in the illustrations, for the second liquid crystal display element 114, it simply needs to have the same resolution with that of the first liquid crystal display element 113 in the pixel unit. Thus, a single pixel may be formed with a colorless single dot, or a plurality of colorless dots as a set may be taken as a single pixel.

In FIG. 1, the video source section 117, the image processing unit 105, and the liquid crystal display unit 116 are illustrated separately. However, each component may not have to be formed with separate hardware, but the three components may be within a same casing. Furthermore, the video source section 117 and the image processing unit 105 may be in a same casing, and the liquid crystal display unit 116 may be in a separate casing. Alternatively, the image processing unit 105 and the liquid crystal display unit 116 may be in a same casing, and the video source section 117 may be in a separate casing.

Further, the present invention has a specific feature in the layout of the color filter layer in the liquid crystal display unit 116 and in the image processing executed by the stacked liquid crystal display elements. Therefore, the effectiveness of the present invention is not deteriorated depending on the places at which those components are disposed.

As shown in FIG. 2, the exemplary embodiment has been described by referring to the case where the first liquid crystal display element 113 has the color filter 251, and a single pixel of the first liquid crystal display element 113 is divided into three dots by corresponding to the color filter layer of RGB. However, the color filter layer is not an essential element for overcoming a sense of parallax felt by the viewer when displaying the images to which the image processing is executed. Therefore, it is possible to form the first liquid crystal display element 113 as a monochrome-type liquid crystal display element like the second liquid crystal display element 114.

Further, the first liquid crystal display element 113 and the second liquid crystal display element 114 have been described by referring to the case of employing an IPS mode as the liquid crystal driving mode. However, the liquid crystal driving mode is not limited to the IPS mode. For example, it is possible to combine various kinds of modes such as a VA liquid crystal mode, a TN liquid crystal mode, an OCB (Optically Compensated Birefringence) liquid crystal mode, and the like.

Furthermore, the transmittance properties of those liquid crystal display elements can be combined whether it is normally white or normally black. The video signals and the voltages to be applied to the liquid crystal display elements may be set in accordance with the properties of the target liquid crystal display elements.

Further, in FIG. 2, no phase difference compensation layer is provided between the liquid crystal display panels 261, 262, and the polarization plates 201-204. However, the effects of the present invention are not deteriorated even when the phase difference compensation layer is provided in that part for improving the view angle. In a case where the phase difference compensation layer is provided, the optical characteristic and the like of the phase difference compensation layer to be inserted may be set depending on the combination with the liquid crystal mode of the liquid crystal layer.

For example, in a case where the phase difference compensation layer is inserted in the first liquid crystal display element 113 and the first liquid crystal display element 113 is driven with the IPS mode, a phase difference compensation layer having a characteristic of $nx \geqq nz > ny$ (where, nx is the refractive index in the direction that has the highest refractive index, ny is the refractive index of the direction that is orthogonal to the direction of nx within a plane in parallel to the substrate, and nz is the refractive index in the direction perpendicular to nx and ny) is inserted in such a manner that the nx direction becomes in parallel to the light absorption axis or the light transmission axis of the polarization plates 201 and 202. This makes it possible to improve the view angle characteristic of the first liquid crystal display element 113.

Further, in a case where the first liquid crystal display element 113 is driven with the VA mode, the view angle characteristic can be improved by inserting a phase difference compensation layer of $nx \geqq ny > nz$ in such a manner that the nx direction becomes in parallel to the light absorption axis or the light transmission axis of the polarization plates 201 and 202.

In a case where the first liquid crystal display element 113 is driven with the TN mode or OCB mode, the view angle characteristic can be improved by inserting a WV film, which is formed with a discotic liquid crystal layer having a negative phase difference and the axial angle of the discotic liquid crystal layer changes continuously in the thickness direction, as a phase difference compensation layer. The phase difference compensation layer may be inserted only in one side of the liquid crystal display panels 261 and 262 or may be inserted in both sides thereof.

There has been described in the above that the phase difference compensation layer is inserted at a position between the liquid crystal display panels 261, 262 and the polarization plates 201-204. In practice, however, the phase difference compensation layer may be inserted at any position as long as it is between the liquid crystal layers 231, 232 and the polarization plates 201-204. Further, not only a single phase difference compensation layer but also a plurality of phase difference compensation layers may be inserted.

Further, as shown in FIG. 2, the liquid crystal display element 113 of the exemplary embodiment described above is formed with the liquid crystal display panel 261 and a pair of polarization plates 201, 202 sandwiching the panel 261 from the outer side thereof. However, as shown in FIG. 33, there may be only a single polarization plate interposed between the liquid crystal display panel 261 and the liquid crystal display panel 262.

This makes it possible to prevent about 20% reduction of the transmittance generated between the liquid crystal display panel 261 and the liquid crystal display panel 262 caused due to having two polarization plates, so that the luminance can be set a value of about 1/(0.8) times at the time of the light transmission. Furthermore, the position shift amount due to the view angle can be decreased because the thickness between the liquid crystal layers becomes thinner. This makes it possible to reduce the capacity of the line memory required for the arithmetic operation processing.

Figure 31:
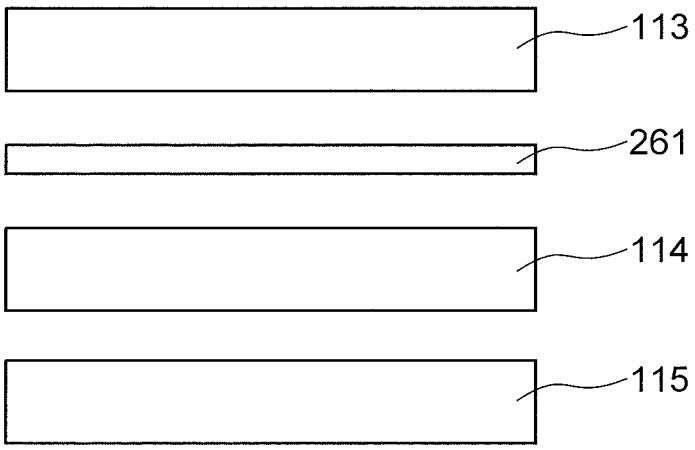
FIG. 31 is an explanatory illustration showing a modification of the exemplary embodiment, in which a light diffusion layer is disposed between a plurality of liquid crystal display elements.

Further, as shown in FIG. 31, a light diffusion layer 261 may be disposed between the first liquid crystal display element 113 and the second liquid crystal display element 114. When the second liquid crystal display element that executes the image processing is located at the far side from the viewer side, the light diffusion layer 261 (e.g., a diffusion film) having the light diffusing characteristic provided between the first liquid crystal display element 113 and the second liquid crystal display element 114 can provide an effect of reducing moiré fringes and interference fringes generated when the wirings and BM (black matrixes) of the stacked liquid crystal display elements 113 and 114 interfere with each other. Therefore, it is possible to provide more preferable images to the viewer.

Figure 32:
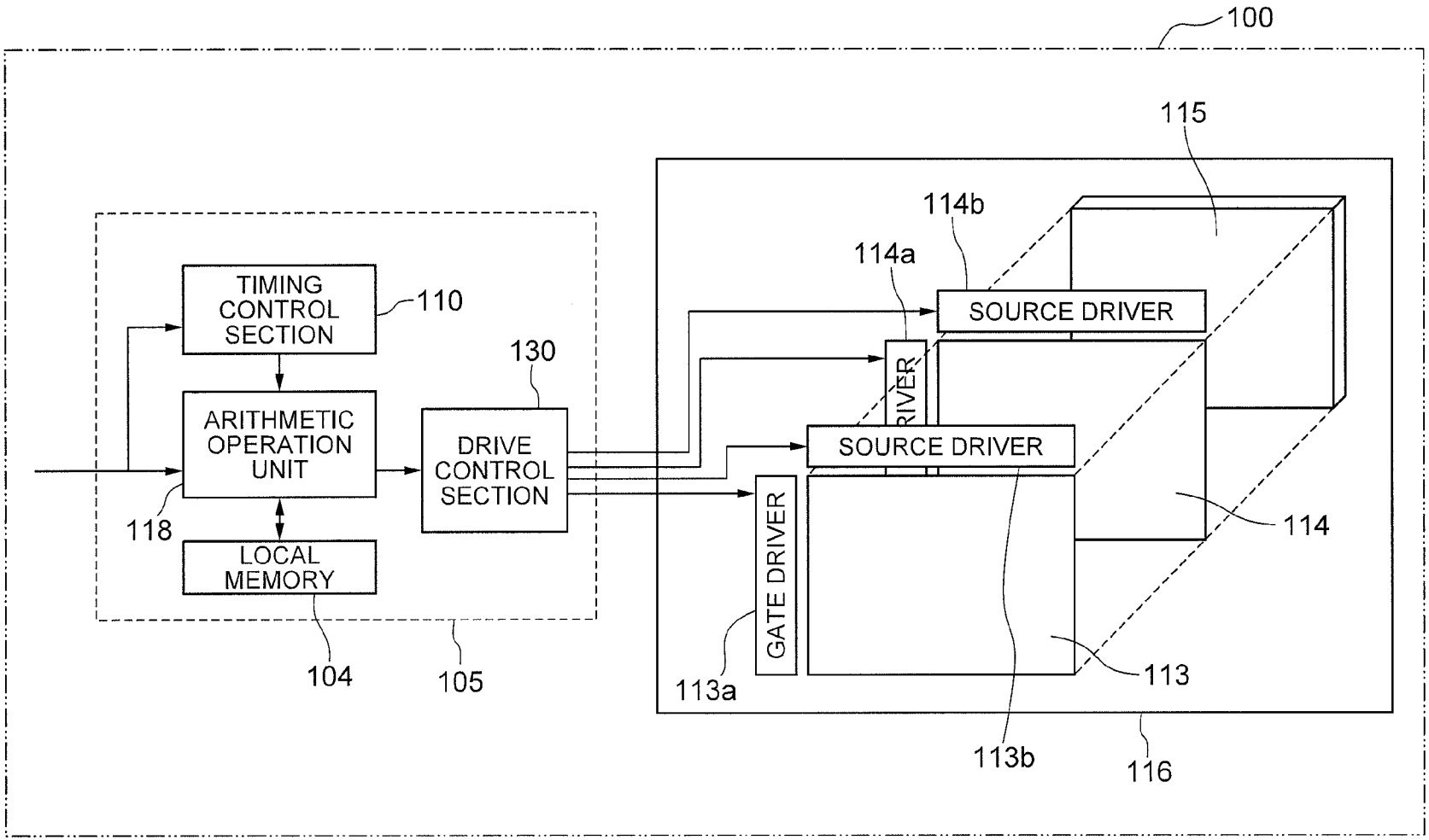
FIG. 32 is an explanatory illustration showing a modification example of the first exemplary embodiment, which is structured to generate control signals of source drivers and gate drivers required for controlling the source drivers and the gate drivers which apply voltages to the liquid crystal display elements within the liquid crystal display unit.

Further, as shown in FIG. 32, for example, it is also possible to generate control signals of source drivers 113*b*, 114*b* and gate drivers 113*a*, 114*a* required for controlling the source drivers 113*b*, 114*b* and the gate drivers 113*a*, 114*a* which apply voltages to the liquid crystal display elements 113 and 114 within the liquid crystal display unit 116. In this case, the image processing unit 105 needs to have a drive control section 130 in addition to the timing control section 110, the arithmetic operation unit 118, and the local memory 104. The drive control section 130 performs controls of the source drivers 113*b*, 114*b* and the gate drivers 113*a*, 114*a* which apply the voltages to the liquid crystal display elements 113 and 114 within the liquid crystal display unit 116.

Further, as shown in FIG. 33, the transparent substrates 212, 213 sandwiched between the liquid crystal layers 231, 232 may be formed thinner than the transparent substrates 211, 214 sandwiching the liquid crystal layer 231 of the liquid crystal display element 113 and the liquid crystal layer 232 of the liquid crystal display element 114 from the outer side.

With the structure shown in FIG. 33, the position shift amount generated due to the view angle can be decreased because the thickness between the liquid crystal layers is reduced, while keeping the mechanical strength of the stacked liquid crystal display elements with the transparent substrates 211 and 214 which sandwiches the layers from the outer side. This makes it possible to decrease the capacity of the line memory required for the arithmetic operation processing.

Further, in a case where the liquid crystal display element 113 employs the driving mode such as the TN mode with which the contrast changes depending on the view angle of the viewer since the angle of the liquid crystal molecules with respect to the substrate changes depending on the applied voltages, the rising directions of the liquid crystal molecules in the center part of the liquid crystal layers may be set to the opposite sides from each other in the neighboring liquid crystal display elements so that the characteristics of the view angle dependency can be set to inverted directions. This makes it possible to level the view angle characteristics.

Each exemplary embodiment has been described by referring to the case of using TFTs for the nonlinear elements inside the liquid crystal display elements. However, the present invention is not limited only to such case. For example, it is also possible to use thin film diodes for the nonlinear elements. Further, in a case of low resolution, the liquid crystal display element may be driven with simple matrix drive. Furthermore, as the light source 115, any types of lights sources such as a cold cathode, a white LED, an LED of three colors of RGB, and the like may be employed, and those are to be included within the scope of the present invention.

The present invention includes, within its scope, any structures as long as those capable of displaying the images of the contrast ratio that cannot be achieved with a single liquid crystal display element, through generating images having a plurality of different kinds of image processing applied thereon by executing the arithmetic operation processing (including use of a lookup table) upon receiving the mage data signals from the video source section 117, and transmitting the generated images to the liquid crystal display unit 116 that is formed by stacking a plurality of liquid crystal elements.

Further, for example, the image processing unit 105 may be formed as a logic circuit in a single or a plurality of FPGA (Field Programmable Gate Array) or ASIC (Application Specific Integrated Circuit). Furthermore, for example, the image processing performed by the image processing unit 105 can employ not only the image processing by hardware but also image processing by software.

While the present invention has been described by referring to the preferred embodiments thereof, the liquid crystal display device and the image display device of the present invention are not limited only to the exemplary embodiments. It is to be understood that the present invention includes, within its scope, various modification and changes of the structures of the above-described exemplary embodiments, e.g., adding image processing such as processing for correcting the γ curve at a prestage or post stage of the image processing, adding image processing by applying pseudo multigradation such as FRC (Frame Rate Control), etc.

As described above, the present invention is structured to extract, by having each pixel unit of the video signals as reference point, the maximum value of the relative gradation or the relative transmittance among the pixel units taken as the reference points and a group of pixel units in a region including the pixel units taken as the reference points, and to output the signals to the second liquid crystal display element based on the maximum value. Therefore, as an exemplary advantage according to the invention, the contrast ratio of the liquid crystal display device as a whole can be improved by the output from the second liquid crystal display element. This makes it possible to overcome the issues of color changes caused due to changes in the viewing directions, and to improve the contrast ratio.

Second Exemplary Embodiment and Modification Example Thereof

Figure 34:
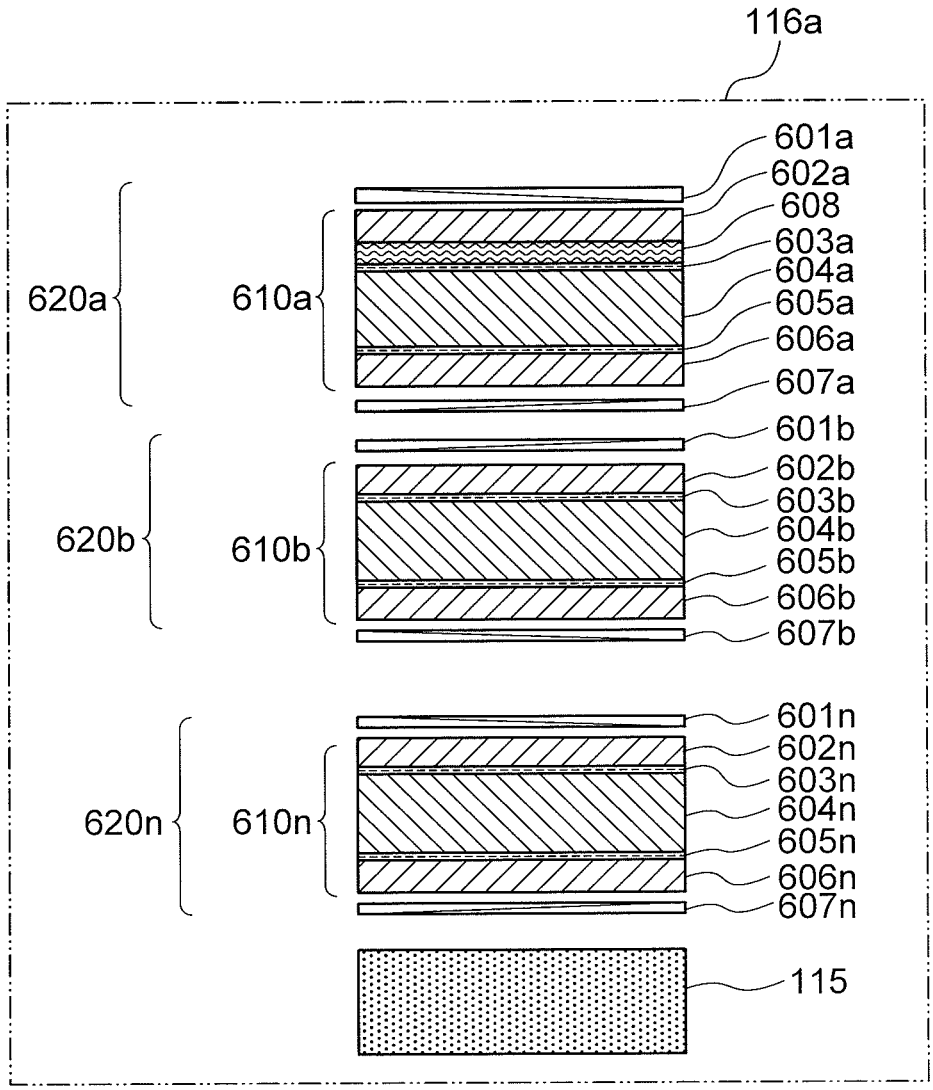
FIG. 34 is an explanatory illustration showing a sectional structure of a liquid crystal display unit in a liquid crystal display device according to a second exemplary embodiment of the invention.

FIG. 34 is an explanatory illustration showing a sectional view of a liquid crystal display unit 116*a* of a liquid crystal display device according to a second exemplary embodiment of the invention. In this exemplary embodiment, a plurality of liquid crystal display elements are used as the second liquid crystal display elements. Through stacking n-pieces of liquid crystal display elements 620*a*-620*n*, a contrast ratio of about xn:1 can be obtained, provided that a contrast ratio with a single liquid crystal display element is x:1.

Hereinafter, this structure will be described in detail. Each of the n-pieces of liquid crystal display elements 620*a*-620*n* forming the liquid crystal display unit 116*a* respectively includes a pair of polarization plates 601*a*-601*n*, 607*a*-607*n* for sandwiching liquid crystal display panels 610*a*-610*n* from the outer side. Each of the liquid crystal display panels 610*a*-610*n* respectively includes: a pair of transparent substrates 602*a*-602*n*, 606*a*-606*n*; liquid crystal layers 604*a*-604*n* sandwiched between the respective pairs of substrate transparent substrates; and alignment films 603*a*-603*n*, 605*a*-605*n* formed by being adjacent to the liquid crystal layers.

Furthermore, one of the n-pieces of liquid crystal display elements 620*a*-620*n* functions as a first liquid crystal display element 113 having a color filter layer 608, and others as (n−1)-pieces of second liquid crystal display element 114 having no color filter layer. For example, in FIG. 34, the liquid crystal display element 620*a* functions as the first liquid crystal display element 113 having the color filter layer 608, and the liquid crystal display elements 620*b*-620*n* function as the second liquid crystal display element 114 having no color filter. Then, a light source 115 is disposed on the back-face side of the lowermost layer of the n-th liquid crystal display element 620*n*.

Figure 35:
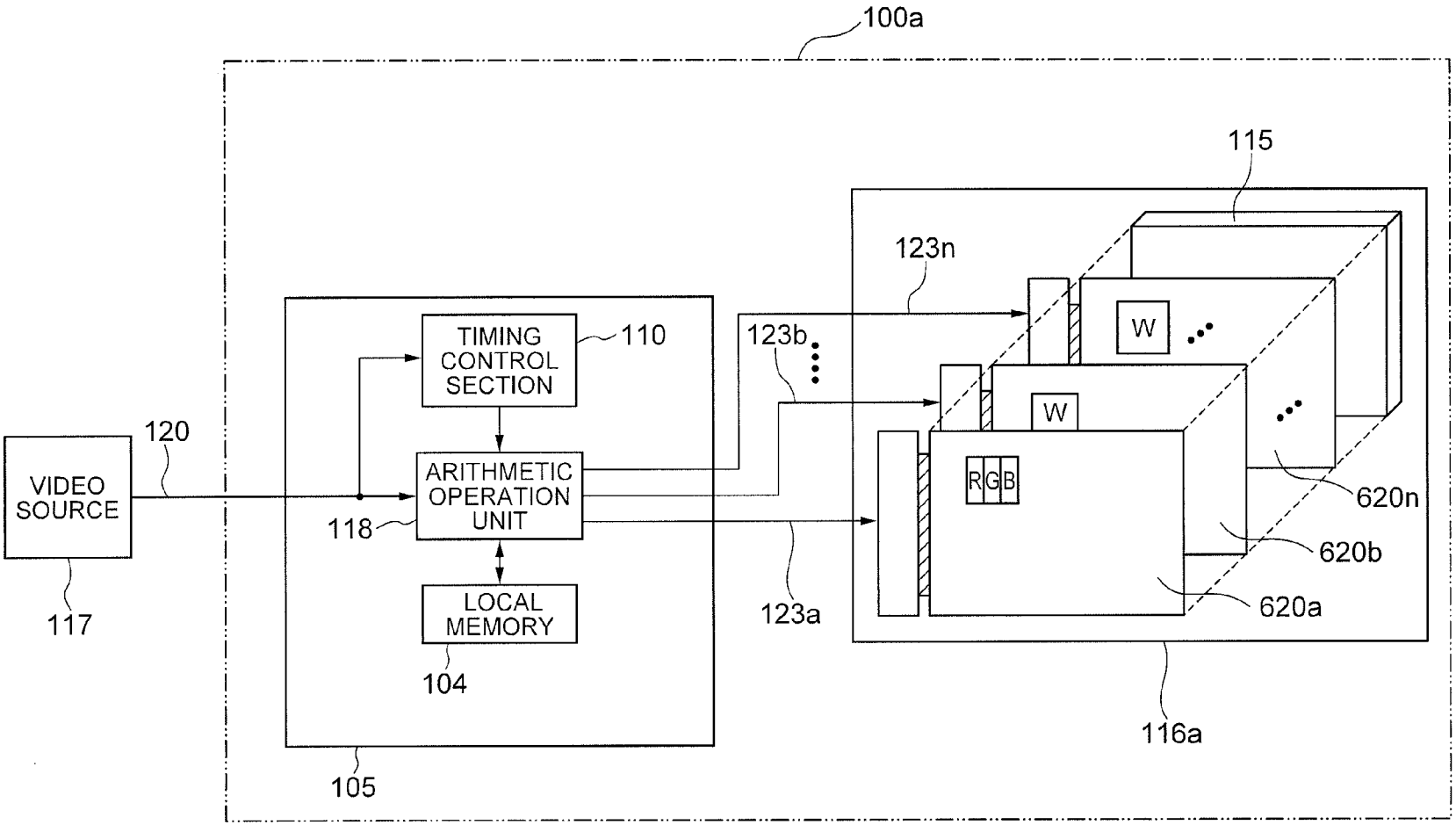
FIG. 35 is an explanatory illustration showing a structure of an image display device including the liquid crystal display unit shown in FIG. 34.

FIG. 35 is an explanatory illustration showing a structure of an image display device 100*a* including the liquid crystal display unit 116*a* shown in FIG. 34. The image processing unit 105 includes a timing control section 110 and an arithmetic operation unit 118. The image processing unit 105 applies signal conversion (image processing) on the video signals received via a transmission path 120 by using the arithmetic operation unit 118, and transmits signals for driving each liquid crystal display element to each of the plurality of liquid crystal display elements which form the liquid crystal display unit 116*a* via transmission paths 123*a*-123*n*. The timing control section 110 controls the timing for outputting the signals to the liquid crystal display unit 116*a* so that the images displayed on each of the liquid crystal display elements 620*a*-620*n* can be synchronized with each other.

As in the case of the first exemplary embodiment, the transmitting paths 123*a*-123*n* may simply need to be able to transmit the signals for driving each of the liquid crystal display elements from the image processing unit 105 to the liquid crystal display unit 116*a*. Thus, typical interface may be employed in accordance with the structure of the casing of the system. For example, in a case of external transmission between devices, digital transmission such as DVI or analog transmission such as analog RGB signals may be used. In a case of transmission within a casing, serial transmission such as LVDS or parallel transmission signals of CMOS or the like may be employed.

Figure 36:
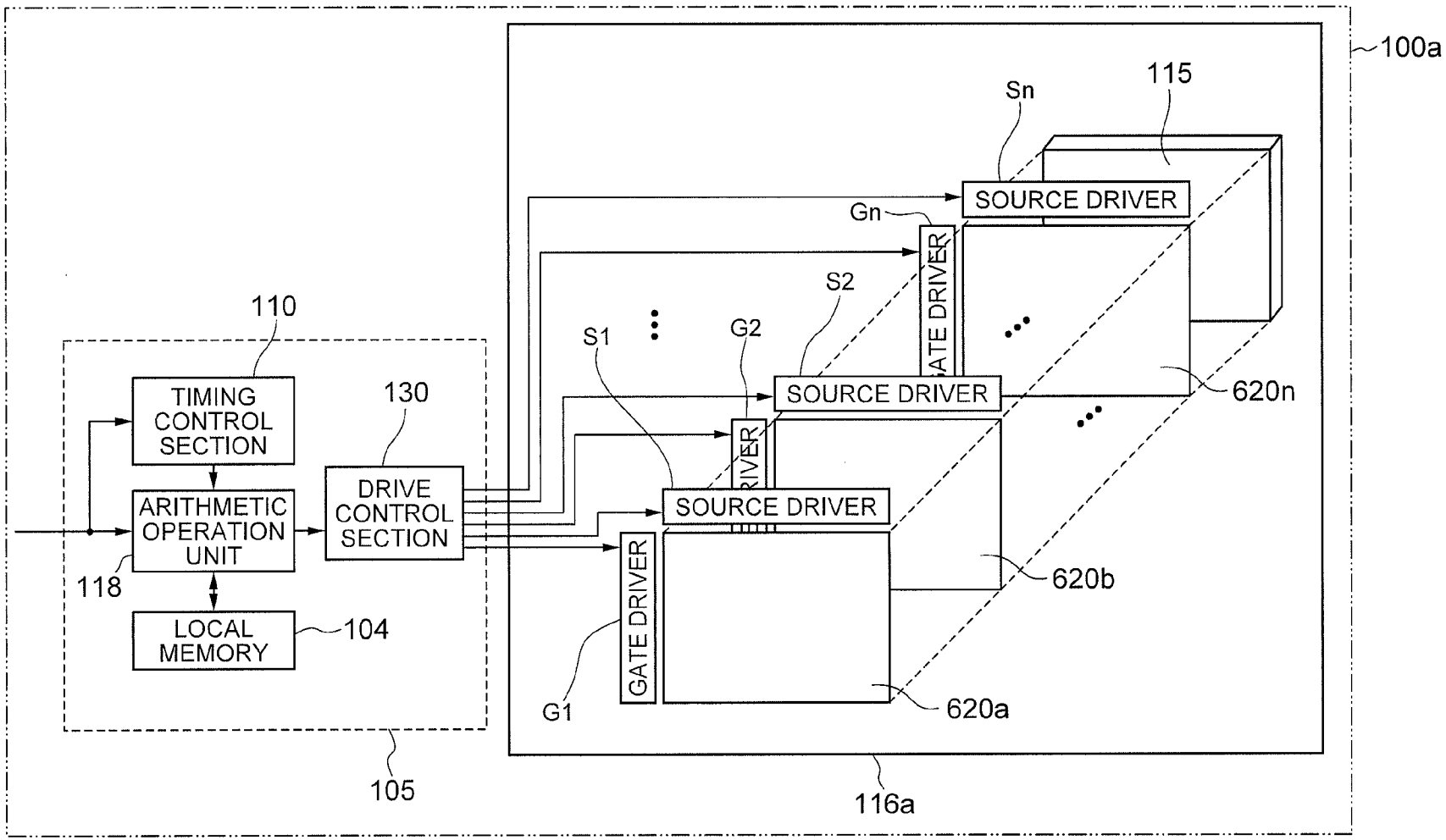
FIG. 36 is an explanatory illustration showing a modification example, in which the image display device shown in FIG. 35 is structured to generate control signals of source drivers and gate drivers required for controlling the source drivers and the gate drivers which apply voltages to the liquid crystal display elements within the liquid crystal display unit.

FIG. 36 is a modification example of the image display device 100*a* shown in FIG. 35, which is structured to generate control signals of source drivers S1-Sn and gate drivers G1-Gn required to control the source drivers S1-Sn and the gate drivers G1-Gn which apply voltages to the liquid crystal display elements 620*a*-620*n* within the liquid crystal display unit 116*a*. In this case, a drive control section 130 is provided to the image processing unit 105 in addition to the timing control section 110, the arithmetic operation unit 118, and the local memory 104.

Returning to FIG. 35, for each dot of the second liquid crystal display elements, the information processing unit 105 generates the drive signals for displaying the images based on the processing which extracts the maximum value of the relative transmittances of the video signals inputted from the video source section among the reference dots and a group of dots in a prescribed region neighboring to the reference dots by having each dot as the reference point. For example, the same processing as the processing executed on the second liquid crystal display element described in the first exemplary embodiment of the invention may be applied to the (n−1)-pieces of second liquid crystal display elements of the second exemplary embodiment.

In the case of this exemplary embodiment, the prescribed region may be set as a value that is determined in accordance with the distance between the position of the liquid crystal layer of the uppermost liquid crystal display element 620*a* and the position of the liquid crystal layer of the lowermost layer of the liquid crystal display element 620*n*. Alternatively, for example, the prescribed region may be set separately for each of the second liquid crystal display elements in accordance with the distance between the position of the liquid crystal layer of the first liquid crystal display element and the position of the liquid crystal layer of the respective liquid crystal display element.

For each of the dots (pixel unit) of the first liquid crystal display element, for example, the arithmetic operation unit 118 of the image processing unit 105 generates the drive signals for displaying the image generated based on the image on the second liquid crystal display panel and the video signals inputted from the video source section.

For each dot (pixel unit) of the first liquid crystal display panel, for example, the arithmetic operation unit 118 of the image processing unit 105 may calculate the relative transmittance T1*x*(i, j) to be displayed on the first display element with following formulae, provided that the relative transmittance of the video signals inputted from the video source section is Tx(i, j) and the product (referred to as synthesized relative transmittance hereinafter) of the relative transmittances displayed on each of the liquid crystal display elements of the (n−1)-pieces of second liquid crystal display elements is T2' (i, j), for example.

$$\text{WHEN } T_2'(i, j) = 0,\ T_{1x}(i, j) = 0 \qquad \text{[Expression 29]}$$

$$\text{WHEN } T_2'(i, j) \neq 0,\ T_{1x}(i, j) = \frac{T_x(i, j)}{T_2'(i, j)}$$

Further, in a case of executing processing using the gradation values instead of the relative transmittances, the arithmetic operation nit 118 of the image processing unit 105 may calculate, for each of the dots (pixel unit) of the first liquid crystal display element, the gradation value S1*x*(i, j) to be displayed on the first display element with following formulae, provided that the gradation value of the video signals inputted from the video source section is Sx(i, j) and the product (referred to as synthesized gradation value hereinafter) of the gradation values (referred to as relative gradation values hereinafter) obtained by dividing the gradation values displayed on the (n−1)-pieces of second liquid crystal display panels by respective gradation resolution (2N−1) is {S2(*i*, *j*)/(2N−1)}'.

$$\text{WHEN } \{S_2(i, j)/(2N-1)\}' = 0,\ S_{1x}(i, j) = 0 \qquad \text{[Expression 30]}$$

$$\text{WHEN } \{S_2(i, j)/(2N-1)\}' \neq 0,$$

$$S_{1x}(i, j) = \frac{S_x(i, j)}{\{S_2(i, j)/(2N-1)\}'}$$

In this exemplary embodiment, a single image processing unit 130 is structured to correspond to n-pieces of liquid crystal display elements 620*a*-620*n*. However, a plurality of image processing units may also be employed.

The viewer observing the liquid crystal display unit 116 observes the light transmitted through the first liquid crystal display element 113 and the second liquid crystal display element 114, so that the luminance (total transmittance) of the image observed by the viewer becomes the product of the transmittances of each liquid crystal display element. The first display element image arithmetic operation section 403 performs the arithmetic operation in such a manner that the gradation characteristic of the image displayed on the first liquid crystal display element 113 is not changed from that of the inputted image signal.

Figure 37:
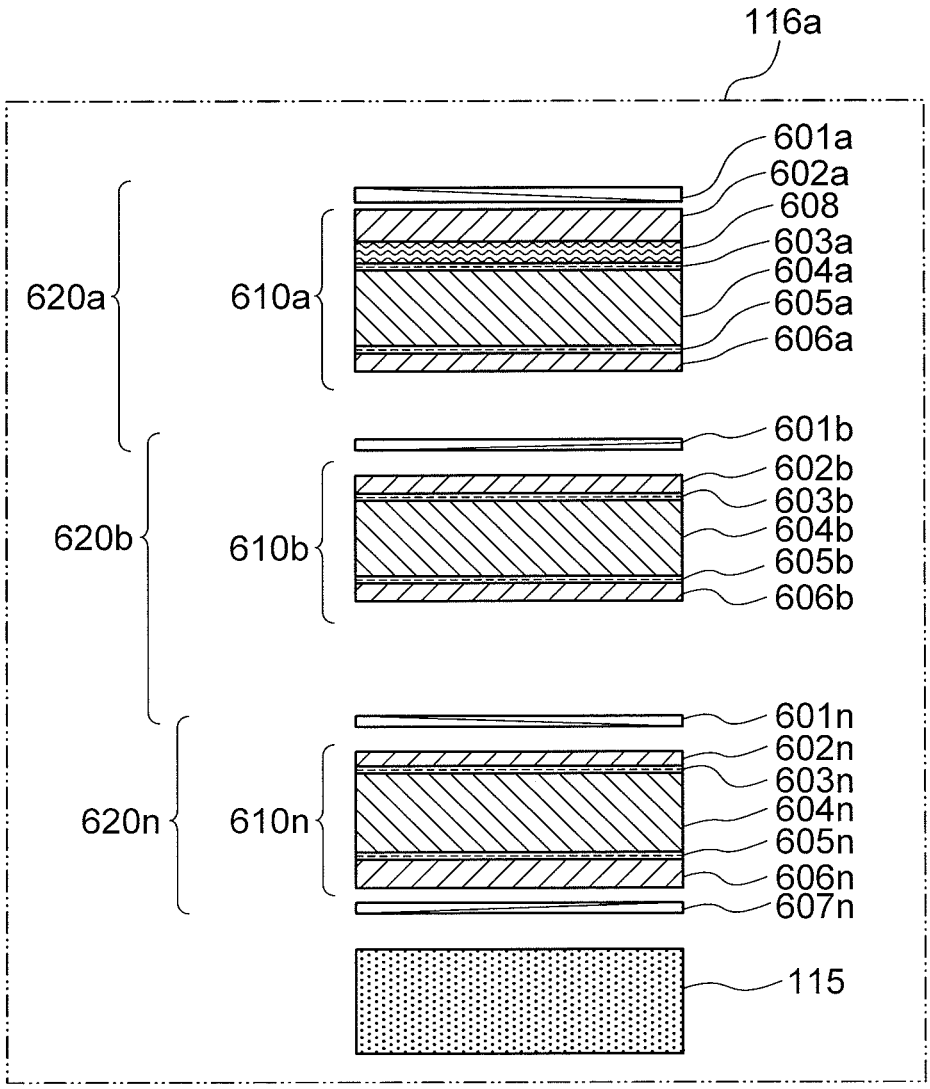
FIG. 37 is an explanatory illustration showing a modification example of the second exemplary embodiment, in which only a single polarization plate is disposed between the liquid crystal display panels.

As shown in FIG. 34, while this exemplary embodiment is structured in such a manner that each of the liquid crystal display elements 620*a*-620*n* is formed respectively with the liquid crystal display panels 610*a*-610*n* and pairs of polarization plates 601*a*-601*n*, 607*a*-607*n* sandwiching the respective panels from the outer sides, there may be provided only a single polarization plate disposed between the liquid crystal display panels. FIG. 37 is an explanatory illustration showing a modification example of the second exemplary embodiment, in which only a single polarization plate is provided between the liquid crystal display panels.

This makes it possible to prevent 20% reduction of the transmittance that may be generated between the liquid crystal display panels caused by transmitting the two polarization plates, so that the luminance can be set to a value of about 1/(0.8n−1) times at the time of the light transmission. Furthermore, the position shift amount due to the view angle can be decreased because the thickness between the liquid crystal layers becomes thinner. This makes it possible to reduce the capacity of the line memory required for the arithmetic operation processing.

Further, as shown in FIG. 37, the transparent substrates 602*b*-602*n*, 606*a*-606(*n*−1) sandwiched between the liquid crystal layers 604*a*-604*n* may be formed thinner than the transparent substrates 602*a*, 606*n* sandwiching the liquid crystal layers 604*a*-604*n* of the respective liquid crystal display elements 620*a*-620*n* from the outer side.

With such structure, the position shift amount due to the view angle can be decreased because the thickness between the liquid crystal layers is reduced, while keeping the mechanical strength of the stacked liquid crystal display elements with the transparent substrates 602*a* and 606*n* which sandwiches the layers from the outer side. This makes it possible to decrease the capacity of the line memory required for the arithmetic operation processing.

Applied Example of Exemplary Embodiments

Figure 38:
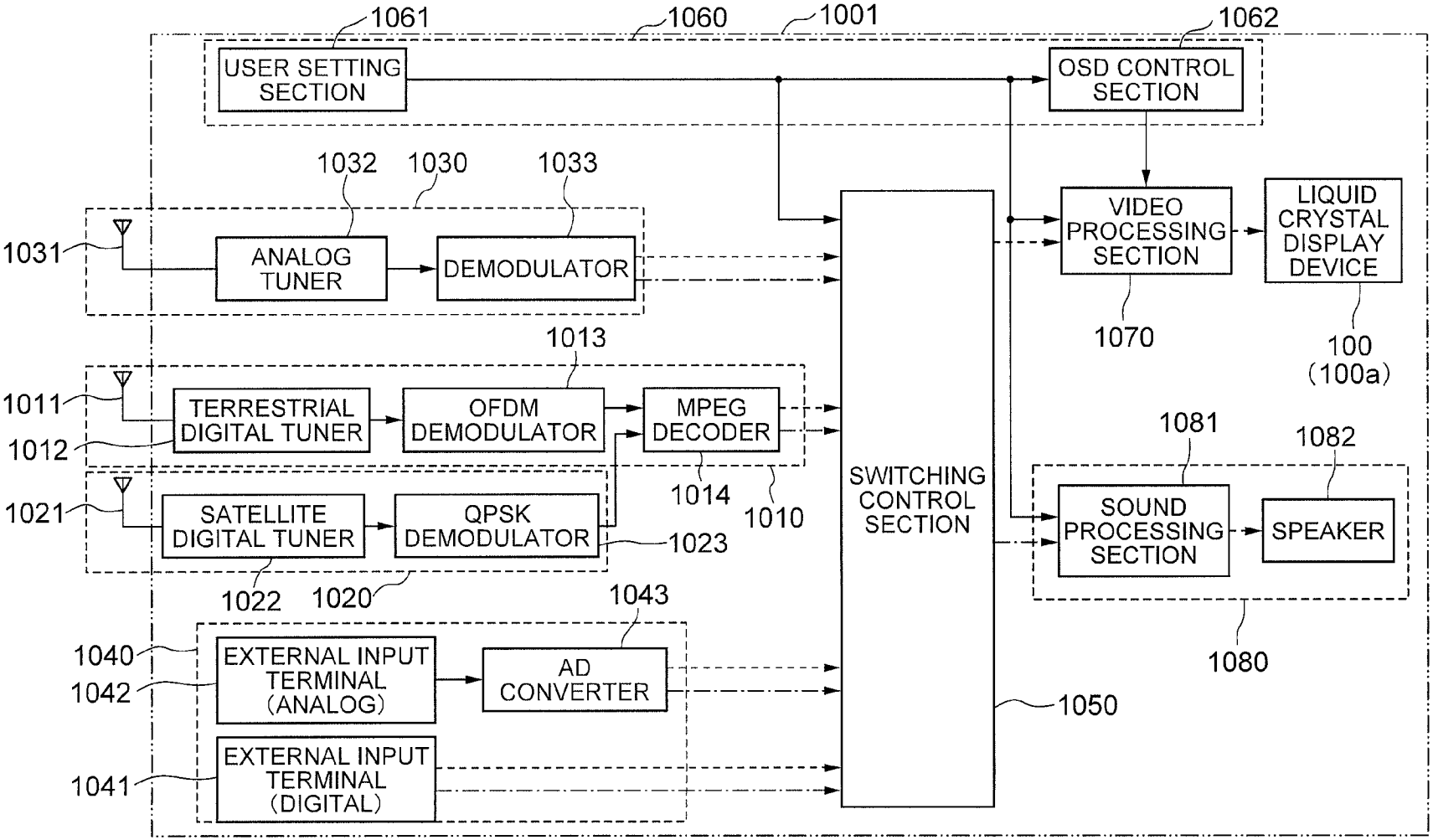
FIG. 38 is an explanatory illustration showing a structure of a television broadcast receiving device which uses the liquid crystal display device according to the first and second exemplary embodiments of the invention.
Figure 39:
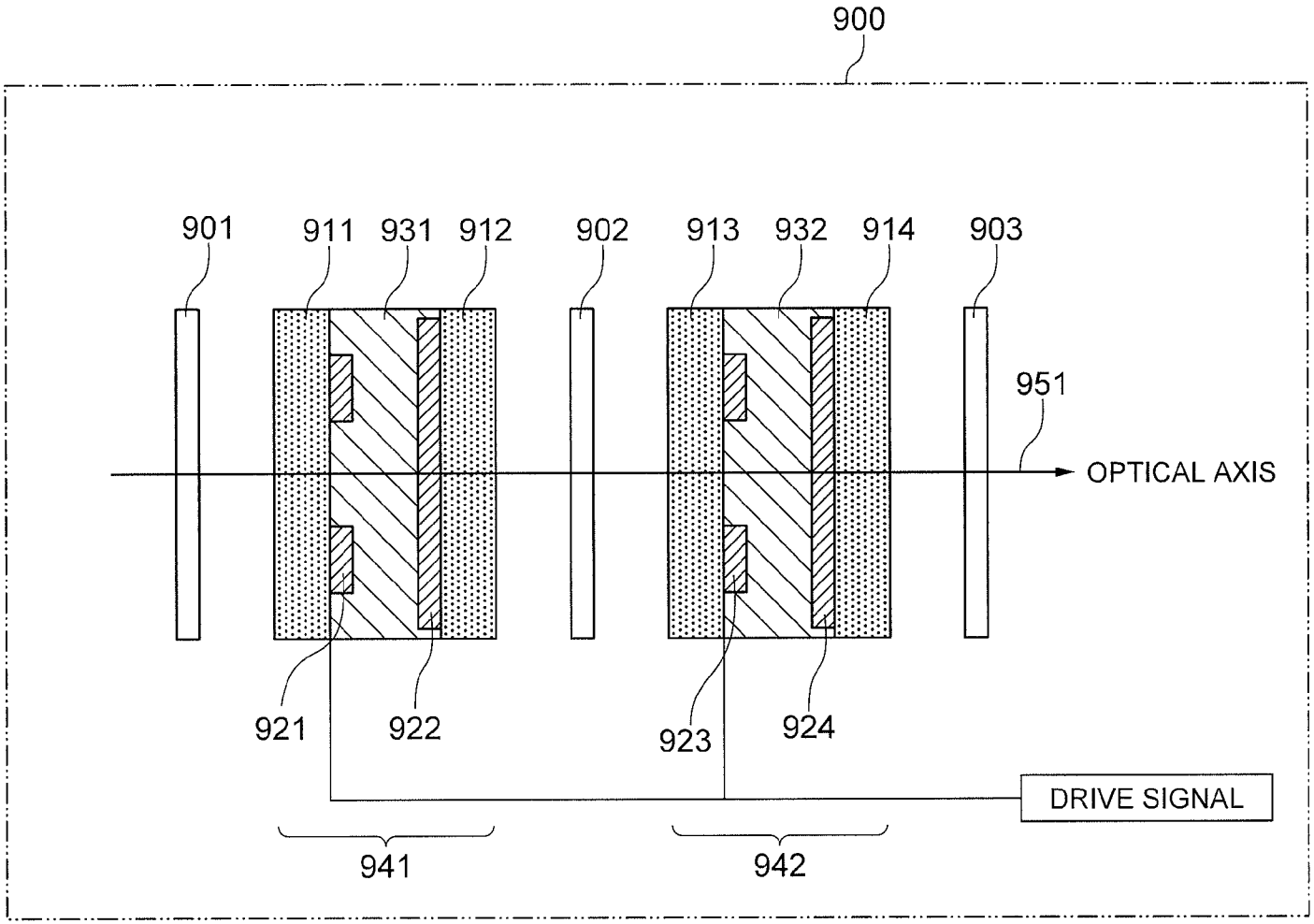
FIG. 39 is an explanatory illustration showing a structure of a liquid crystal display panel according to Patent Document 1.

FIG. 38 is an explanatory illustration showing the structure of a television broadcast receiving device 1001 to which the liquid crystal display device according to the above-described first and second exemplary embodiments of the invention is applied. The television broadcast receiving device 1001 includes: a terrestrial digital broadcast receiving section 1010 for receiving terrestrial digital broadcast; a satellite digital broadcast receiving section 1020 for receiving satellite digital broadcast; a terrestrial analog broadcast receiving section 1030 for receiving terrestrial analog broadcast; an external input processing section 1040 for receiving external input; a switching control section 1050 which selects the kinds of videos to be displayed; a setting section 1060 for setting various kinds of settings; a video processing section 1070 for displaying the videos; and a sound output section 1080 for outputting sounds. The video processing section 1070 includes the image display device 100 or 100*a* according to the first or second exemplary embodiment described above.

The terrestrial digital broadcast receiving section 1010 converts signals from a terrestrial digital tuner 1012 connected to output signals from a terrestrial broadcast reception antenna 1011 that is placed outside the television broadcast receiving device 1001 into digital video signals and digital sound signals by using an OFDM (Orthogonal Frequency Division Multiplexing) demodulator 1013, decodes the digital video signals by an MPEG (Moving Picture Export Group) decoder 1014 to generate the video signals, and inputs those signals to the switching control section 1050.

The satellite digital broadcast receiving section 1020 converts signals from a satellite digital tuner 1022 connected to output signals from a satellite digital broadcast reception antenna 1021 that is placed outside the television broadcast receiving device 1001 into digital video signals and digital sound signals by using a QPSK (Quadrature Phase Shift Keying) demodulator 1023, decodes the digital video signals by the MPEG decoder 1014 that is used in common with the terrestrial digital broadcast receiving section 1010 to generate the video signals, and inputs those signals to the switching control section 1050.

The terrestrial analog broadcast receiving section 1030 separates signals from a terrestrial analog tuner 1032 connected to output signals from a terrestrial analog reception antenna 1031 that is placed outside the television broadcast receiving device 1001 into digital video signals and digital sound signals by using a demodulator 1033 to generate the video signals, and inputs those signals to the switching control section 1050.

The external input processing section 1040 includes a digital input terminal 1041 and an analog input terminal 1042 for inputting video signals from external video sources. The input signals from the analog input terminal 1042 are digitized by an A/D converter 1043, and inputted to the switching control section 1050. For the input signals from the digital input terminal 1041, the video signals are inputted directly to the switching control section 1050.

The switching control section 1050 switches the video signals and the sound signals inputted from a plurality of video sources based on the input from the user setting section 1061, and outputs those signals to the video processing section 1070 and the sound output section 1080, respectively.

In the meantime, the setting section 1060 accepts the settings inputted by the user from the above-described user setting section 1061, and reflects those upon the switching control section 1050 and each of other sections. At the same time, the setting section 1060 forms a user setting image for supporting the user to input the settings with the use of an OSD (On Screen Display) control section 1062, and outputs it to the video processing section 1070.

The video processing section 1070 format-converts (IP conversion, scaler, etc.) the video signals inputted from the switching control section 1050, and further performs video adjustments (brightness, contrast, color tone, etc.). At the same time, the video processing section 1070 synthesizes the video signals with the user setting image inputted from the OSD control section 1062, and inputs those to the image display device 100 or 100*a* to have those displayed.

The sound output section 1080 performs processing such as analog conversion on the sound signals inputted from the switching control section 1050 by using a sound processing section 1081 to convert the signals to the sound signals that can be reproduced by a speaker 1082, and amplifies and inputs those signals to the speaker 1082 to have those reproduced.

Through employing the image display device 100 or 100*a* according to the present invention to the television broadcast receiving device 1001, a high-contrast video display can be achieved. This television broadcast receiving device 1001 is a case that is capable of receiving a variety of broadcast signals such as analog broadcast, terrestrial digital broadcast, and satellite digital broadcast, and capable of displaying the videos thereof. However, the types of the broadcast signals or the video sources are not limited only to those.

Further, the block structure of the broadcast receiving device described above is merely presented as a way of example. Other structures are to be included in the scope of the present invention, as long as those are the electronic devices to which the image display device 100 or 100*a* according to the present invention are employed. Furthermore, a high-contrast video display can be achieved not only when the image display device 100 or 100*a* according to the present invention is employed to the television broadcast receiving device but also when the image display device 100 or 100*a* is employed to other usages such as to a computer, a digital camera, etc.

While the present invention has been described by referring to the specific exemplary embodiments shown in the drawings, the present invention is not limited to those embodiments shown in the drawings. Any known structures can be employed as long as the effects of the present invention can be implemented therewith.

INDUSTRIAL APPLICABILITY

The present invention can be applied to most of occasions where a liquid crystal display device is employed in electronic devices. Particularly, the present invention is preferable for the occasions where a high contrast ratio, wide view angles, a large screen, and a high image quality are required. More specifically, the present invention is preferable for a television broadcast receiving device, a video display unit of a diagnostic imaging device, a monitor used in a broadcast station or the like, an image display unit of an electronic device used at a place where videos are provided in a dark place such as a movie theater for showing movies, etc.

What is claimed is:

1. A liquid crystal display device which displays a video signal inputted from a video source on a liquid crystal display unit, comprising:

the liquid crystal display unit that is formed by stacking a single first liquid crystal display element and a single or a plurality of second liquid crystal display element(s) for displaying an image, each of the first liquid crystal display element and the second liquid crystal element being formed with a plurality of pixel units arranged in matrix for displaying the image; and an image processing unit which, by having each pixel unit of the video signal as reference point, generates a drive signal for displaying an image based on processing which extracts a maximum value of relative gradations that are ratios of gradations with respect to a maximum gradation of the video signal or a maximum value of relative transmittances that are ratios of transmittances with respect to a maximum transmittance of the video signal among a group of pixel units including the pixel units taken as the reference points and a region including the pixel units neighboring to the pixel units taken as the reference points, and displays the image on the second liquid crystal display element at positions corresponding to the pixel units taken as the reference points based on the generated drive signal, wherein when the video signal inputted from the video source is of a display with bright-color pixel units in a dark background, the image processing unit generates, for each pixel unit of the second liquid crystal display element, the drive signal for displaying synthesized relative gradation S2 that satisfies S2≧S in a pixel unit group including the bright-color pixel units and pixel units neighboring to one of those pixel units, provided that relative gradation of the display with the bright-color pixel units based on the video signal inputted from the video source is S, and the synthesized relative gradation that is a product of the relative gradations displayed in each of the liquid crystal display elements of the second liquid crystal display elements is S2.

2. The liquid crystal display device as claimed in claim 1, wherein the image processing unit comprises:

an in-region maximum transmittance extracting section which, by having each pixel unit of the video signal as the reference point, extracts an in-region maximum relative gradation that is a maximum value of the relative gradations of the video signal among the group of pixel units including the pixel units taken as the reference points and the region in which a distance range from the pixel unit taken as the reference point includes a position shift amount calculated on a basis of an interval between the first liquid crystal display element and the second liquid crystal display element, and a viewing direction; and a second display element image arithmetic operation section which performs an arithmetic operation of image data to be displayed on the second liquid crystal display element based on the region maximum relative gradation extracted by the in-region maximum transmittance extracting section, wherein the second display element image arithmetic operation section generates the drive signal to display synthesized relative gradation S2 that is displayed on the second liquid crystal display element to satisfy S2≧Smax, provided that the region maximum relative gradatio s n extracted from the video signal is Smax, and the synthesized relative gradation displayed on the second liquid crystal display element is S2.

3. The liquid crystal display device as claimed in claim 1, wherein the image processing unit generates, for each of the pixel units of the first liquid crystal display element, the drive signal with which relative gradation S1 to be displayed on the first liquid crystal display element satisfies S1=0 when S2=0 and satisfies S1=S/S2 when S2≠0, provided that the relative gradation of the video signal inputted from the video source is S and the synthesized relative gradation displayed on the second liquid crystal display element is S2.

4. The liquid crystal display device as claimed in claim 1, wherein when the video signal inputted from the video source is of a display with bright-color pixel units in a dark background, the image processing unit generates, for each pixel unit of the second liquid crystal display element, the drive signal for displaying synthesized relative transmittance S2 that satisfies S2≧S in a pixel unit group including the bright-color pixel units and pixel units neighboring to one of those pixel units, provided that relative transmittance of the display with the bright-color pixel units based on the video signal inputted from the video source is S, and the synthesized relative transmittance that is a product of the relative transmittances displayed in each of the liquid crystal display elements of the second liquid crystal display elements is S2.

5. The liquid crystal display device as claimed in claim 4, wherein the image processing unit comprises:

an in-region maximum transmittance extracting section which, by having each pixel unit of the video signal as the reference point, extracts an in-region maximum relative transmittance that is a maximum value of the relative transmittances of the video signal among the group of pixel units including the pixel units taken as the reference points and the region in which a distance range from the pixel unit taken as the reference point includes a position shift amount calculated on a basis of an interval between the first liquid crystal display element and the second liquid crystal display element, and a viewing direction; and a second display element image arithmetic operation section which performs an arithmetic operation of image data to be displayed on the second liquid crystal display element based on the region maximum relative transmittance extracted by the in-region maximum transmittance extracting section, wherein the second display element image arithmetic operation section generates the drive signal to display synthesized relative transmittance S2 that is displayed on the second liquid crystal display element to satisfy S2≧Smax, provided that the region maximum relative transmittance extracted from the video signal is Smax, and the synthesized relative transmittance displayed on the second liquid crystal display element is S2.

6. The liquid crystal display device as claimed in claim 4, wherein the image processing unit generates, for each of the pixel units of the first liquid crystal display element, the drive signal with which relative transmittance S1 to be displayed on the first liquid crystal display element satisfies S1=0 when S2=0 and satisfies S1=S/S2 when S2≠0, provided that the relative transmittance of the video signal inputted from the video source is S and the synthesized relative transmittance displayed on the second liquid crystal display element is S2.

7. The liquid crystal display device as claimed in claim 1, wherein the first liquid crystal display element includes a color filter layer, and the second liquid crystal display element does not include a color filter layer.

8. The liquid crystal display device as claimed in claim 1, wherein neither the first liquid crystal display element nor the second liquid crystal display element includes a color filter layer.

9. The liquid crystal display device as claimed in claim 1, wherein, with respect to transparent substrates of the liquid crystal display elements sandwiching the liquid crystal layers of the stacked liquid crystal display elements from outer side, a transparent substrate sandwiched by the liquid crystal layers of the outer-side liquid crystal display elements is formed thinner.

10. A liquid crystal display control device which executes a control to display an image on a stacked first liquid crystal display element and a second liquid crystal display element, the liquid crystal display control device comprising an image processing unit which, by having each pixel unit of a video signal inputted from a video source as a reference point, generates a drive signal for displaying an image based on processing which extracts a maximum value of relative gradations or a maximum value of relative transmittances among a group of pixel units including the pixel units taken as the reference points and a region including the pixel units neighboring to the pixel units taken as the reference points, wherein when the video signal inputted from the video source is of a display with bright-color pixel units in a dark background, the image processing unit generates, for each pixel unit of the second liquid crystal display element, the drive signal for displaying synthesized relative gradation S2 that satisfies S2≧S in a pixel unit group including the bright-color pixel units and pixel units neighboring to one of those pixel units, provided that relative gradation of the display with the bright-color pixel units based on the video signal inputted from the video source is S, and the synthesized relative gradation that is a product of the relative gradations displayed in each of the liquid crystal display elements of the second liquid crystal display elements is S2.

11. An electronic device, comprising at least the liquid crystal display device of claim 1 or the liquid crystal display control device of claim 10.

12. A liquid crystal display method for displaying a video signal inputted from a video source on a video display unit, which uses, as the liquid crystal display unit, a single first liquid crystal display element and a single or a plurality of second liquid crystal display element(s) stacked on one another for displaying an image, the method comprising:

by having each pixel unit of the video signal as a reference point, generating a drive signal for displaying an image based on processing which extracts a maximum value of relative gradations that are ratios of gradations with respect to a maximum gradation of the video signal or a maximum value of relative transmittances that are ratios of transmittances with respect to a maximum transmittance of the video signal among a group of pixel units including the pixel units taken as the reference points and a region including the pixel units neighboring to the pixel units taken as the reference points; and displaying the image on the second liquid crystal display element at positions corresponding to the pixel units taken as the reference points based on the generated drive signal, wherein when the video signal inputted from the video source is of a display with bright-color pixel units in a dark background, generating, for each pixel unit of the second liquid crystal display element, the drive signal for displaying synthesized relative gradation S2 that satisfies S2≧S in a pixel unit group including the bright-color pixel units and pixel units neighboring to one of those pixel units, provided that relative gradation of the display with the bright-color pixel units based on the video signal inputted from the video source is S, and the synthesized relative gradation that is a product of the relative gradations displayed in each of the liquid crystal display elements of the second liquid crystal display elements is S2.

13. The liquid crystal display method as claimed in claim 12, comprising:

by having each pixel unit of the video signal as the reference point, extracting a region maximum relative gradation that is a maximum value of the relative gradations of the video signal among the group of pixel units including the pixel units taken as the reference points and the region in which a distance range from the pixel unit taken as the reference point includes a position shift amount calculated on a basis of an interval between the first liquid crystal display element and the second liquid crystal display element, and a viewing direction; and when performing an arithmetic operation of image data to be displayed on the second liquid crystal display element based on the extracted region maximum relative gradation, generating the drive signal to display synthesized relative gradation S2 that is displayed on the second liquid crystal display element to satisfy S2≧Smax, provided that the region maximum relative gradation extracted from the video signal is Smax, and the synthesized relative gradation displayed on the second liquid crystal display element is S2.

14. The liquid crystal display method as claimed in claim 12, comprising:

generating, for each of the pixel units of the first liquid crystal display element, the drive signal with which relative gradation S1 to be displayed on the first liquid crystal display element satisfies S1=0 when S2=0 and satisfies S1=S/S2 when S2≠0, provided that the relative gradation of the video signal inputted from the video source is S, and the synthesized relative gradation displayed on the second liquid crystal display element is S2.

15. The liquid crystal display method as claimed in claim 12, comprising when the video signal inputted from the video source is of a display with bright-color pixel units in a dark background, generating, for each pixel unit of the second liquid crystal display element, the drive signal for displaying synthesized relative transmittance S2 that satisfies S2≧S in a pixel unit group including the bright-color pixel units and pixel units neighboring to one of those pixel units, provided that relative transmittance of the display with the bright-color pixel units based on the video signal inputted from the video source is S, and the synthesized relative transmittance that is a product of the relative transmittances displayed in each of the liquid crystal display elements of the second liquid crystal display elements is S2.

16. The liquid crystal display method as claimed in claim 15, comprising:

by having each pixel unit of the video signal as the reference point, extracting a region maximum relative transmittance that is a maximum value of the relative transmittances of the video signal among the group of pixel units including the pixel units taken as the reference points and the region in which a distance range from the pixel unit taken as the reference point includes a position shift amount calculated on a basis of an interval between the first liquid crystal display element and the second liquid crystal display element, and a viewing direction; and when performing an arithmetic operation of image data to be displayed on the second liquid crystal display element based on the extracted region maximum relative transmittance, generating the drive signal to display synthesized relative transmittance S2 that is displayed on the second liquid crystal display element to satisfy $S2 \geqq Smax$, provided that the region maximum relative transmittance extracted from the video signal is Smax, and the synthesized relative transmittance displayed on the second liquid crystal display element is S2.

17. The liquid crystal display method as claimed in claim 15, comprising:

generating, for each of the pixel units of the first liquid crystal display element, the drive signal with which relative transmittance S1 to be displayed on the first liquid crystal display element satisfies $S1=0$ when $S2=0$ and satisfies $S1=S/S2$ when $S2 \neq 0$, provided that the relative transmittance of the video signal inputted from the video source is S and the relative transmittance displayed on the second liquid crystal display element is S2.

18. Liquid crystal display means for displaying a video signal inputted from a video source on a liquid crystal display unit, comprising:

the liquid crystal display unit that is formed by stacking a single first liquid crystal display element and a single or a plurality of second liquid crystal display element(s) for displaying an image, each of the first liquid crystal display element and the second liquid crystal element being formed with a plurality of pixel units arranged in matrix for displaying the image; and image processing means for, by having each pixel unit of the video signal as reference point, generating a drive signal for displaying an image based on processing which extracts a maximum value of relative gradations that are ratios of gradations with respect to a maximum gradation of the video signal or a maximum value of relative transmittances that are ratios of transmittances with respect to a maximum transmittance of the video signal among a group of pixel units including the pixel units taken as the reference points and a region including the pixel units neighboring to the pixel units taken as the reference points, and displaying the image on the second liquid crystal display element at positions corresponding to the pixel units taken as the reference points based on the generated drive signal, wherein when the video signal inputted from the video source is of a display with bright-color pixel units in a dark background, generating, for each pixel unit of the second liquid crystal display element, the drive signal for displaying synthesized relative gradation S2 that satisfies $S2 \geqq S$ in a pixel unit group including the bright-color pixel units and pixel units neighboring to one of those pixel units, provided that relative gradation of the display with the bright-color pixel units based on the video signal inputted from the video source is S, and the synthesized relative gradation that is a product of the relative gradations displayed in each of the liquid crystal display elements of the second liquid crystal display elements is S2.

19. Liquid crystal display control means for executing a control to display an image on a stacked first liquid crystal display element and a second liquid crystal display element, the liquid crystal display control means comprising image processing means for, by having each pixel unit of a video signal inputted from a video source as a reference point, generating a drive signal for displaying an image based on processing which extracts a maximum value of relative gradations or a maximum value of relative transmittances among a group of pixel units including the pixel units taken as the reference points and a region including the pixel units neighboring to the pixel units taken as the reference points, wherein when the video signal inputted from the video source is of a display with bright-color pixel units in a dark background, generating, for each pixel unit of the second liquid crystal display element, the drive signal for displaying synthesized relative gradation S2 that satisfies $S2 \geqq S$ in a pixel unit group including the bright-color pixel units and pixel units neighboring to one of those pixel units, provided that relative gradation of the display with the bright-color pixel units based on the video signal inputted from the video source is S, and the synthesized relative gradation that is a product of the relative gradations displayed in each of the liquid crystal display elements of the second liquid crystal display elements is S2.

* * * * *